US006857486B2

(12) United States Patent
Chitwood et al.

(10) Patent No.: US 6,857,486 B2
(45) Date of Patent: Feb. 22, 2005

(54) HIGH POWER UMBILICALS FOR SUBTERRANEAN ELECTRIC DRILLING MACHINES AND REMOTELY OPERATED VEHICLES

(75) Inventors: James E. Chitwood, Houston, TX (US); William Banning Vail, III, Bothell, WA (US); William G. Crossland, Seattle, WA (US); Damir S. Skerl, Houston, TX (US); Robert L. Dekle, Tulsa, OK (US)

(73) Assignee: Smart Drilling and Completion, Inc., Bothell, WA (US)

( * ) Notice: Subject to any disclaimer, the term of this patent is extended or adjusted under 35 U.S.C. 154(b) by 0 days.

(21) Appl. No.: 10/223,025

(22) Filed: Aug. 15, 2002

(65) Prior Publication Data

US 2003/0034177 A1 Feb. 20, 2003

Related U.S. Application Data

(60) Provisional application No. 60/384,964, filed on Jun. 3, 2002, provisional application No. 60/367,638, filed on Mar. 26, 2002, provisional application No. 60/353,457, filed on Jan. 31, 2002, and provisional application No. 60/313,654, filed on Aug. 19, 2001.

(51) Int. Cl.[7] ..... E21B 4/04

(52) U.S. Cl. ..... 175/104; 175/97; 175/101; 166/65.1; 166/66.4; 405/191; 114/312; 114/322; 114/328

(58) Field of Search ..... 175/97–99, 101, 175/104; 166/65.1, 66.4; 405/188–191; 114/312, 313, 322, 328, 337

(56) References Cited

U.S. PATENT DOCUMENTS 3,837,412 A 9/1974 Driver
4,016,943 A 4/1977 Cullen et al.
4,031,969 A 6/1977 Cullen et al.

(List continued on next page.)

FOREIGN PATENT DOCUMENTS

EP 0 553 908 B1 10/1996
EP 0571045 B1 8/1998
EP 1 106 777 A1 6/2001

(List continued on next page.)

OTHER PUBLICATIONS

Sarapuu, Erich, "Electrical Disintegrating Drilling", SPE Paper 300, 1962 Production Research Symposium, Apr. 12–13, 1962, pp. 201–206.

Denison, E.B., "High Data–Rate Drilling Telemetry System", SPE Paper 6775, Journal of Petroleum Technology, Feb. 1979, pp. 155–163.

Sas–Jaworsky, Alexander, et al., "Development of Composite Coiled Tubing for Oilfield Services", SPE Paper 26536, 68th Annual Technical Conference and Exhibition, Oct. 3–6, 1993, pp. 1–15.

(List continued on next page.)

*Primary Examiner*—David Bagnell
*Assistant Examiner*—Giovanna Collins

(57) ABSTRACT

The method of providing in excess of 60 kilowatts of electrical power to the electrical motor of a subterranean electric drilling machine through a substantially neutrally buoyant composite umbilical containing electrical conductors to reduce the frictional drag on the neutrally buoyant umbilical. Drilling and casing subterranean monobore wells are contemplated to distances of 20 miles from a wellsite. For drilling applications, the umbilical possesses a drilling fluid conduit. The umbilical also possesses high speed data communications such as a fiber optic cable or a coaxial cable that is used in the feedback control of the downhole electric drilling motor. Such umbilicals are also useful to provide power to remotely operated vehicles for subsea well servicing applications.

7 Claims, 26 Drawing Sheets

U.S. PATENT DOCUMENTS 4,051,908 A 10/1977 Driver
4,057,116 A 11/1977 Striegler
4,085,808 A 4/1978 Kling ..... 175/94
4,095,865 A 6/1978 Denison et al.
4,256,146 A 3/1981 Genini et al.
4,336,415 A 6/1982 Walling
4,463,814 A 8/1984 Horstmeyer et al.
4,544,041 A 10/1985 Rinaldi
4,557,538 A 12/1985 Chevalier
4,676,310 A 6/1987 Scherbatskoy et al. .... 166/65.1
4,806,115 A 2/1989 Chevalier et al.
4,842,081 A 6/1989 Parant
5,060,737 A 10/1991 Mohn
5,129,452 A 7/1992 Wilson
5,148,875 A 9/1992 Karlsson et al.
5,172,765 A 12/1992 Sas-Jaworsky et al.
5,176,180 A 1/1993 Williams et al.
5,197,553 A 3/1993 Leturno
5,271,472 A 12/1993 Leturno
5,285,008 A 2/1994 Sas-Jaworsky et al.
5,305,830 A 4/1994 Wittrisch
5,332,048 A 7/1994 Underwood et al.
5,353,872 A 10/1994 Wittrisch
5,392,715 A 2/1995 Pelrine ..... 104/138.2
5,404,953 A 4/1995 Sangesland
5,467,832 A 11/1995 Orban et al.
5,472,057 A 12/1995 Winfree
5,497,840 A 3/1996 Hudson
5,551,521 A 9/1996 Vail, III
5,553,678 A 9/1996 Barr et al.
5,582,259 A 12/1996 Barr
5,613,567 A 3/1997 Hudson
5,667,011 A 9/1997 Gill et al.
5,769,160 A 6/1998 Owens
5,828,003 A 10/1998 Thomeer et al.
5,842,149 A 11/1998 Harrell et al. ..... 702/9
5,845,722 A 12/1998 Makohl et al.
5,890,537 A 4/1999 Lavaure et al.
5,894,897 A 4/1999 Vail, III
5,908,049 A 6/1999 Williams et al.
5,913,337 A 6/1999 Williams et al.
5,921,285 A 7/1999 Quigley et al.
6,004,639 A 12/1999 Quigley et al.
6,009,825 A * 1/2000 Fulton et al. ..... 114/296
RE36,556 E 2/2000 Smith et al.
6,031,371 A 2/2000 Smart ..... 324/220
6,041,860 A 3/2000 Nazzal et al. ..... 166/250.01
6,092,610 A 7/2000 Kosmala et al.
6,112,809 A 9/2000 Angle ..... 166/66
6,148,664 A 11/2000 Baird
6,148,866 A 11/2000 Quigley et al.
6,158,531 A 12/2000 Vail, III
6,189,621 B1 2/2001 Vail, III
6,196,336 B1 3/2001 Fincher et al.
6,216,533 B1 4/2001 Woloson et al.
6,257,162 B1 * 7/2001 Watt et al. ..... 114/244
6,257,332 B1 7/2001 Vidrine et al.
6,263,987 B1 7/2001 Vail, III
6,273,189 B1 8/2001 Gissler
6,286,558 B1 9/2001 Quigley et al.
6,296,066 B1 10/2001 Terry et al.
6,325,148 B1 12/2001 Trahan et al.
6,343,649 B1 2/2002 Beck et al.
6,354,373 B1 3/2002 Vercamer et al.
6,357,485 B2 3/2002 Quigley et al.
6,359,569 B2 3/2002 Beck et al.
6,361,299 B1 3/2002 Quigley et al.
6,371,203 B2 4/2002 Frank et al.
6,374,924 B1 4/2002 Hanton et al.
6,397,946 B1 6/2002 Vail, III
6,408,943 B1 6/2002 Schultz et al.
6,419,014 B1 7/2002 Meek et al.
6,419,033 B1 7/2002 Hahn et al.
6,431,282 B1 8/2002 Bosma et al.
6,484,818 B2 11/2002 Alft et al.
6,497,280 B2 12/2002 Beck et al.
6,538,576 B1 3/2003 Schultz et al.
6,543,538 B2 4/2003 Tolman et al.
6,554,064 B1 4/2003 Restarick et al.
6,578,636 B2 6/2003 Mazorow et al.
6,663,453 B2 12/2003 Quigley et al. ..... 441/133
2002/0066556 A1 6/2002 Goode et al.
2002/0157829 A1 10/2002 Davis et al.
2002/0170711 A1 11/2002 Nuth
2002/0189806 A1 12/2002 Davidson et al.
2003/0034177 A1 2/2003 Chitwood et al.
2003/0056991 A1 3/2003 Hahn et al.
2003/0070841 A1 4/2003 Merecka et al.

FOREIGN PATENT DOCUMENTS

GB GR 2 357 101 A 6/2001
WO WO 97/08418 3/1997
WO WO 00/28188 5/2000
WO WO 00/50730 8/2000
WO WO 01/12946 A1 2/2001
WO WO 01/48352 A1 7/2001
WO WO 01/94738 A1 12/2001
WO WO 02/29441 A1 4/2002
WO WO 02/086287 A2 10/2002
WO WO 03/016671 A2 2/2003
WO WO 03/036012 A2 5/2003

OTHER PUBLICATIONS

Pavone, D.R., et al., "Application of High Sampling Rate Downhole Measurements for Analysis and Cure of Stick–Slip in Drilling", SPE Paper 28324, SPE 69th Annual Conference Technical and Exhibition, Sep. 25–28, 1994, pp. 335–345.

Sanchez, Alfredo, et al., "An Approach for the Selection and Design of Slim Downhole Motors for Coiled Tubing Drilling", SPE Paper 37054, 1996 SPE Horizontal Drilling Conference, Nov. 18–20, 1996, pp. 197–205.

Leising, L.J., et al., "Extending the Reach of Coiled Tubing Drilling (Thrusters, Equalizers and Tractors)", SPE/IADC Paper 37656, 1997 SPE/IADC Drilling Conference, Mar. 4–6, 1997, pp. 677–690.

Abyzbayev, B.I., et al., "Electrodrilling: Past Experience and Present Opportunities", SPE Paper 38624, 1997 SPE Annual Technical Conference and Exhibition, Oct. 5–8, 1997, pp. 573–588.

Selby, Bruce, et al., "Hybrid Coiled Tubing System for Offshore Re–entry Drilling and Workover", IADC/SPE Paper 39374, 1998 IADC/SPE Drilling Conference, Mar. 3–6, 1998, pp. 711–721.

Head, P.F., et al., "Electric Coiled Tubing Drilling—The First Steps toward a Smart CT Drilling System", SPE Paper 46013, 1998 SPE–ICoTA Coiled Tubing Roundtable, Apr. 15–16, 1998, pp. 61–70.

Tumer, D.R., et al., "Electric Coiled Tubing Drilling: A Smarter CT Drilling System", SPE/IADC Paper 52791, 1999 SPE/IADC Drilling Conference, Mar. 9–11, 1999, pp. 1–13.

Tumer, Daniel R., et al., "The All Electric BHA: Recent Developments towards an Intelligent Coiled–Tubing Drilling System", SPE Paper 54469, 1999 SPE/ICoTA Coiled Tubing Roundtable, May 25–26, 1999, pp. 1–10.

Filippov, Andrei, et al., "Expandable Tubular Solutions", SPE Paper 56500, 1999 SPE Annual Technical Conference and Exhibition, Oct. 3–6, 1999, pp. 1–6.
Tinkham, Scott K., et al., "Wired BHA Applications in Underbalanced Coiled Tubing Drilling", IADC/SPE Paper 59161, 2000 IADC/SPE Drilling Conference, Feb. 23–25, 2000, pp. 1–13.
Lohoefer, C. Lee, et al., "Expandable Liner Hanger Provides Cost–Effective Alternative Solution", IADC/SPE paper 59151, 2000 IADC/SPE Drilling Conference, Feb. 23–25, 2000, pp. 1–12.
Warren, Tommy M., et al., "Casing Drilling Application Design Considerations", IADC/SPE Paper 59179, 2000 IADC/SPE Drilling Conference, Feb. 23–25, 2000, pp. 1–11.
Kamp, G.P., et al., "Development of a Power and Data Transmission Thermoplastic Composite Coiled Tubing for Electric Drilling", SPE Paper 60730, 2000 SPE/ICoTA Coiled Tubing Roundtable, Apr. 5–6, 2000, pp. 1–7.
Head, Phil, et al., "Intelligent Coiled Tubing Joint Industry Project", SPE Paper 60712, 2000 SPE/ICoTA Coiled Tubing Roundtable, Apr. 5–6, 2000, pp. 1–7.
Marker, Roy, et al., "Anaconda: Joint Development Project Leads to Digitally Controlled Composite Coiled Tubing Drilling System", SPE Paper 60750, SPE/ICoTA Coiled Tubing Roundtable, Apr. 5–6, 2000, pp. 1–9.
Maranuk, C.A., et al., "A Concept of a New Steerable Drilling System for Coiled Tubing", SPE Paper 60752, 2000 SPE/ICoTA Coiled Tubing Roundtable, Apr. 5–6, 2000, pp. 1–10.
Sawaryn, S.J., "The Dynamics of Electric Submersible Pump Populations and the Implication for Dual ESP Systems", SPE Paper 63043, 2000 SPE Annual Technical Conference and Exhibition, Oct. 1–4, 2000, pp. 1–16.
Daigle, Chan L., et al., "Expandable Tubulars: Field Examples of Application in Well Construction and Remediation", SPE Paper 62958, SPE Annual Technical Conference and Exhibition, Oct. 1–4, 2000, pp. 1–14.
Shepard, S.F., et al., "Casing Drilling: An Emerging Technology", IADC/SPE Paper 67731, 2001 SPE/IADC Drilling Conference, Feb. 27 –Mar. 1, 2001, pp. 1–13.
Dupal, Kenneth K., et al., "Solid Expandable Tubular Technology—A Year of Case Histories in the Drilling Environment", SPE/IADC Paper 67770, SPE/IADC Drilling Conference, Feb. 27 –Mar. 1, 2001, pp. 1–16.
Cales, Gerry, et al., "Subsidence Remediation—Extending Well Life Through the Use of Solid Expandable Casing Systems", AADE Paper 01–NC–HO–24, AADE Houston Chapter Mar. 2001 Conference, pp. 1–16.
Head, Philip, et al., "Intelligent Coiled Tubing (ICT) for Completions and Flowlines", SPE Paper 68357, 2001 SPE/ICoTA Coiled Tubing Roundtable, Mar. 7–8, 2001, pp. 1–4.
Head, Philip, et al., "Electric Coiled Tubing Drilling (E–CTD) Project Update", SPE Paper 68441, SPE/ICoTA Coiled Tubing Roundtable, Mar. 7–8, 2001, pp. 1–9.
Turner, Dan, et al., "New D.C. Motor for Downhole Drilling and Pumping Applications", SPE Paper 68489, SPE/ICoTA Coiled Tubing Roundtable, Mar. 7–8, 2001, pp. 1–7.
Coats, E. Alan, et al., " The Hybrid Drilling Unit: An Overview of an Integrated Composite Coiled Tubing and Hydraulic Workover Drilling System", SPE Paper 74349, SPE International Petroleum Conference and Exhibition, Feb. 10–12, 2002, pp. 1–7.
Rixse, Mel, et al., "High Performance Coil Tubing Drilling in Shallow North Slope Heavy Oil", IADC/SPE Paper 74553, IADC/SPE Drilling Conference, Feb. 26–28, 2002, pp. 1–10.
Coats, E. Alan, et al., "The Hybrid Drilling System: Incorporating Composite Coiled Tubing and Hydraulic Workover Technologies into One Integrated Drilling System", IADC/SPE 74538, IADC/SPE Drilling Conference, Feb. 26–28, 2002, pp. 1–7.
Ohlinger, James J., et al., "A Comparison of Mud Pulse and E–Line Telemetry in Alaska CTD Operations", SPE Paper 74842, SPE/ICoTA Coiled Tubing Conference and Exhibition, Apr. 9–10, 2002, pp. 1–5.
Lurie, Paul, et al., "Smart Drilling with Electric Drillstring™", SPE/IADC Paper 79886, SPE/IADC Drilling Conference, Feb. 19–21, 2003, pp. 1–13.
Downton, G.C., et al., "Rotary Steerable Drilling System for the 6–in Hole", SPE/IADC 79922, SPE/IADC Drilling Conference, Feb. 19–21, 2003, pp. 1–13.
Editor, "$D^2$ Deepwater Driller Subsea, All Electric Coil Tubing Exploration System", printed from the website of www.XLTL.com, from the internet, on Aug. 13, 2003, 4 pages.

* cited by examiner

HIGH POWER UMBILICALS FOR SUBTERRANEAN ELECTRIC DRILLING MACHINES AND REMOTELY OPERATED VEHICLES

CROSS-REFERENCES TO RELATED APPLICATIONS

This application relates to Provisional Patent Application No. 60/313,654 filed on Aug. 19, 2001 that is entitled "Smart Shuttle Systems", an entire copy of which is incorporated herein by reference.

This application also relates to Provisional Patent Application No. 60/353,457 filed on Jan. 31, 2002 that is entitled "Additional Smart Shuttle Systems", an entire copy of which is incorporated herein by reference.

This application further relates to Provisional Patent Application No. 60/367,638 filed on Mar. 26, 2002 that is entitled "Smart Shuttle Systems and Drilling Systems", an entire copy of which is incorporated herein by reference.

And yet further, this application also relates the Provisional Patent Application No. 60/384,964 filed on Jun. 3, 2002 that is entitled "Umbilicals for Well Conveyance Systems and Additional Smart Shuttles and Related Drilling Systems", an entire copy of which is incorporated herein by reference.

Applicant claims priority from the above Provisional Patent Application Nos. 60/313,654, No. 60/353,457, No. 60/367,638 and No. 60/384,964.

The following applications are related to this application, but applicant does not claim priority from the following related applications.

This application relates to Ser. No. 08/323,152, filed Oct. 14, 1994, having the title of "Method and Apparatus for Cementing Drill Strings in Place for One Pass Drilling and Completion of Oil and Gas Wells", that issued on Sep. 3, 1996 as U.S. Pat. No. 5,551,521, an entire copy of which is incorporated herein by reference.

This application further relates to Ser. No. 08/708,396, filed Sep. 3, 1996, having the title of "Method and Apparatus for Cementing Drill Strings in Place for One Pass Drilling and Completion of Oil and Gas Wells", that issued on the date of Apr. 20, 1999 as U.S. Pat. No. 5,894,897, an entire copy of which is incorporated herein by reference.

This application further relates to Ser. No. 09/294,077, filed Apr. 18, 1999, having the title of "One Pass Drilling and Completion of Wellbores with Drill Bit Attached to Drill String to Make Cased Wellbores to Produce Hydrocarbons", that issued on the date of Dec. 12, 2000 as U.S. Pat. No. 6,158,531, an entire copy of which is incorporated herein by reference.

This application further relates to application Ser. No. 09/295,808, filed Apr. 20, 1999, having the title of "One Pass Drilling and Completion of Extended Reach Lateral Wellbores with Drill Bit Attached to Drill String to Produce Hydrocarbons from Offshore Platforms", that issued on the date of Jul. 24, 2001 as U.S. Pat. No. 6,263,987, an entire copy of which is incorporated herein by reference.

This application further relates to Ser. No. 09/375,479, filed Aug. 16, 1999, having the title of "Smart Shuttles to Complete Oil and Gas Wells", that issued on Feb. 20, 2001 as U.S. Pat. No. 6,189,621, an entire copy of which is incorporated herein by reference.

This application also relates to application Ser. No. 09/487,197, filed Jan. 19, 2000, having the title of "Closed-Loop System to Complete Oil and Gas Wells", that issued on Jun. 4, 2002 as U.S. Pat. No. 6,397,946, an entire copy of which is incorporated herein by reference.

This application also relates to co-pending application Ser. No. 10/162,302, filed in the U.S.P.T.O. on Jun. 4, 2002, having the title of "Closed-Loop Conveyance Systems for Well Servicing", an entire copy of which is incorporated herein by reference.

This application also relates to a co-pending application Ser. No. 10/189,570, filed the U.S.P.T.O. on the date of Jul. 6, 2002, having the title of "Installation of One-Way Valve After Removal of Retrievable Drill Bit to Complete Oil and Gas Wells", and entire copy of which is incorporated herein by reference.

Related PCT Applications

And yet further, this application also relates to co-pending PCT Application Ser. No. PCT/US00/22095, filed Aug. 9, 2000, having the title of "Smart Shuttles to Complete Oil and Gas Wells", that has International Publication Date of Feb. 22, 2001 and International Publication Number WO 01/12946 A1, an entire copy of which is incorporated herein by reference.

And finally, this application also relates to a PCT Application that will be filed after this application herein, but before the date Aug. 19, 2002, that also has the title of this application herein.

Related U.S. Disclosure Documents

This application further relates to disclosure in U.S. Disclosure Document No. 362582, filed on Sep. 30, 1994, that is entitled 'RE: Draft of U.S. Patent Application Entitled "Method and Apparatus for Cementing Drill Strings in Place for One Pass Drilling and Completion of Oil and Gas Wells'", an entire copy of which is incorporated herein by reference.

This application further relates to disclosure in U.S. Disclosure Document No. 445686, filed on Oct. 11, 1998, having the title that reads exactly as follows: 'RE: -Invention Disclosure- entitled "William Banning Vail III, Oct. 10, 1998"', an entire copy of which is incorporated herein by reference.

This application further relates to disclosure in U.S. Disclosure Document No. 451044, filed on Feb. 8, 1999, that is entitled 'RE: -Invention Disclosure- "Drill Bit Having Monitors and Controlled Actuators"', an entire copy of which is incorporated herein by reference.

This application further relates to disclosure in U.S. Disclosure Document No. 451292, filed on Feb. 10, 1999, that is entitled 'RE: -Invention Disclosure- "Method and Apparatus to Guide Direction of Rotary Drill Bit" dated Feb. 9, 1999"', an entire copy of which is incorporated herein by reference.

This application further relates to disclosure in U.S. Disclosure Document No. 452648 filed on Mar. 5, 1999 that is entitled 'RE: "-Invention Disclosure- Feb. 28, 1999 One-Trip-Down-Drilling Inventions Entirely Owned by William Banning Vail III"', an entire copy of which is incorporated herein by reference.

This application further relates to disclosure in U.S. Disclosure Document No. 455731 filed on May 2, 1999 that is entitled 'RE: -INVENTION DISCLOSURE- entitled "Summary of One-Trip-Down-Drilling Inventions", an entire copy of which is incorporated herein by reference.

This application further relates to disclosure in U.S. Disclosure Document No. 458978 filed on Jul. 13, 1999 that is entitled in part "RE: -INVENTION DISCLOSURE MAILED JUL. 13, 1999", an entire copy of which is incorporated herein by reference.

This application further relates to disclosure in U.S. Disclosure Document No. 459470 filed on Jul. 20, 1999 that is entitled in part 'RE: -INVENTION DISCLOSURE ENTITLED "Different Methods and Apparatus to "Pump-down" . . . "', an entire copy of which is incorporated herein by reference.

This application further relates to disclosure in U.S. Disclosure Document No. 462818 filed on Sep. 23, 1999 that is entitled in part "Directional Drilling of Oil and Gas Wells Provided by Downhole Modulation of Mud Flow", an entire copy of which is incorporated herein by reference.

This application further relates to disclosure in U.S. Disclosure Document No. 465344 filed on Nov. 19, 1999 that is entitled in part "Smart Cricket Repeaters in Drilling Fluids for Wellbore Communications While Drilling Oil and Gas Wells", an entire copy of which is incorporated herein by reference.

This application further relates to disclosure in U.S. Disclosure Document No. 474370 filed on May 16, 2000 that is entitled in part "Casing Drilling with Standard MWD/LWD Drilling Assembly Latched into Casing Having Releasable Standard Sized Drill Bit", an entire copy of which is incorporated herein by reference.

This application further relates to disclosure in U.S. Disclosure Document No. 475584 filed on Jun. 13, 2000 that is entitled in part "Lower Portion of Standard LWD/MWD Rotary Drill String with Rotary Steering System and Rotary Drill Bit Latched into ID of Larger Casing Having Undercutter to Drill Oil and Gas Wells Whereby the Lower Portion is Retrieved upon Completion of the Wellbore", an entire copy of which is incorporated herein by reference.

This application further relates to disclosure in U.S. Disclosure Document No. 475681 filed on Jun. 17, 2000 that is entitled in part "ROV Conveyed Smart Shuttle System Deployed by Workover Ship for Subsea Well Completion and Subsea Well Servicing", an entire copy of which is incorporated herein by reference.

This application further relates to disclosure in U.S. Disclosure Document No. 496050 filed on Jun. 25, 2001 that is entitled in part "SDCI Drilling and Completion Patents and Technology and SDCI Subsea Re-Entry Patents and Technology", an entire copy of which is incorporated herein by reference.

This application further relates to disclosure in U.S. Disclosure Document No. 480550 filed on Oct. 2, 2000 that is entitled in part "New Draft Figures for New Patent Applications", an entire copy of which is incorporated herein by reference.

This application further relates to disclosure in U.S. Disclosure Document No. 493141 filed on May 2, 2001 that is entitled in part "Casing Boring Machine with Rotating Casing to Prevent Sticking Using a Rotary Rig", an entire copy of which is incorporated herein by reference.

This application further relates to disclosure in U.S. Disclosure Document No. 492112 filed on Apr. 12, 2001 that is entitled in part "Smart Shuttle™ Conveyed Drilling Systems", an entire copy of which is incorporated herein by reference.

This application further relates to disclosure in U.S. Disclosure Document No. 495112 filed on Jun. 11, 2001 that is entitled in part "Liner/Drainhole Drilling Machine", an entire copy of which is incorporated herein by reference.

This application further relates to disclosure in U.S. Disclosure Document No. 494374 filed on May 26, 2001 that is entitled in part "Continuous Casting Boring Machine", an entire copy of which is incorporated herein by reference.

This application further relates to disclosure in U.S. Disclosure Document No. 495111 filed on Jun. 11, 2001 that is entitled in part "Synchronous Motor Injector System", an entire copy of which is incorporated herein by reference.

And yet further, this application also relates to disclosure in U.S. Disclosure Document No. 497719 filed on Jul. 27, 2001 that is entitled in part "Many Uses for The Smart Shuttle™ and Well Locomotive™", an entire copy of which is incorporated herein by reference.

This application further relates to disclosure in U.S. Disclosure Document No. 498,720 filed on Aug. 17, 2001 that is entitled in part "Electric Motor Powered Rock Drill Bit Having Inner and Outer Counter-Rotating Cutters and Having Expandable/Retractable Outer Cutters to Drill Boreholes into Geological Formations", an entire copy of which is incorporated herein by reference.

And yet further, this application also relates to disclosure in U.S. Disclosure Document No. 499,136 filed on Aug. 26, 2001, that is entitled in part 'Commercial System Specification PCP-ESP Power Section for Cased Hole Internal Conveyance "Large Well Locomotive™"', an entire copy of which is incorporated herein by reference.

Various references are referred to in the above defined U.S. Disclosure Documents. For the purposes herein, the term "reference cited in applicant's U.S. Disclosure Documents" shall mean those particular references that have been explicitly listed and/or defined in any of applicant's above listed U.S. Disclosure Documents and/or in the attachments filed with those U.S. Disclosure Documents. Applicant explicitly includes herein by reference entire copies of each and every "reference cited in applicant's U.S. Disclosure Documents". To best knowledge of applicant, all copies of U.S. Patents that were ordered from commercial sources that were specified in the U.S. Disclosure Documents are in the possession of applicant at the time of the filing of the application herein.

Related U.S. Trademarks

Various references are referred to in the above defined U.S. Disclosure Documents. For the purposes herein, the term "reference cited in applicant's U.S. Disclosure Documents" shall mean those particular references that have been explicitly listed and/or defined in any of applicant's above listed U.S. Disclosure Documents and/or in the attachments filed with those U.S. Disclosure Documents. Applicant explicitly includes herein by reference entire copies of each and every "reference cited in applicant's U.S. Disclosure Documents". In particular, applicant includes herein by reference entire copies of each and every U.S. Patent cited in U.S. Disclosure Document No. 452648, including all its attachments, that was filed on Mar. 5, 1999. To best knowledge of applicant, all copies of U.S. Patents that were ordered from commercial sources that were specified in the U.S. Disclosure Documents are in the possession of applicant at the time of the filing of the application herein.

Applications for U.S. Trademarks have been filed in the USPTO for several terms used in this application. An application for the Trademark "Smart Shuttle™" was filed on Feb. 14, 2001 that is Ser. No. 76/213676, an entire copy of which is incorporated herein by reference. The "Smart Shuttle™" is also called the "Well Locomotive™". An application for the Trademark "Well Locomotive™" was filed on Feb. 20, 2001 that is Ser. No. 76/218211, an entire copy of which is incorporated herein by reference. An application for the Trademark of "Downhole Rig" was filed on Jun. 11, 2001 that is Ser. No. 76/274726, an entire copy of which is incorporated herein by reference. An application for the Trademark "Universal Completion Device™" was filed on Jul. 24, 2001 that is Ser. No. 76/293175, an entire copy of which is incorporated herein by reference. An application for the Trademark "Downhole BOP" was filed on Aug. 17, 2001 that is Ser. No. 76/305201, an entire copy of which is incorporated herein by reference.

Accordingly, in view of the Trademark Applications, the term "smart shuttle" will be capitalized as "Smart Shuttle"; the term "well locomotive" will be capitalized as "Well Locomotive"; the term "downhole rig" will be capitalized as "Downhole Rig"; the term "universal completion device" will be capitalized as "Universal Completion Device"; and the term "downhole bop" will be capitalized as "Downhole BOP".

BACKGROUND OF THE INVENTION

1. Field of Invention

The fundamental field of the invention relates to methods and apparatus that may be used to drill and complete wells at great lateral distances from a drill site. The invention may be used to reach any lateral distance from the surface drill site, from close to the drill site, to a maximum radial distance of at least 20 miles from the surface drill site. This is accomplished by using a near neutrally buoyant umbilical that is attached to a subterranean electric drilling machine. The near neutrally buoyant umbilical is capable of providing up to 320 horsepower to do work at lateral distances of at least 20 miles. This drilling application requires near neutrally buoyant umbilicals capable of providing high power at great distances and high speed data communications to and from the surface. The near neutrally buoyant umbilical reduces the frictional drag of the umbilical within the wellbore. To convey drilling equipment to great distances also requires methods and apparatus to move heavy equipment through pipes at relatively high speeds. Similar high power umbilicals having high speed data communications to and from the surface are also useful for providing power and communications to remotely operated vehicles used for subsea service work in the oil and gas industry.

2. Description of the Related Art

The oil and gas industry does not now have the capability to drill horizontally extreme distances of approximately 20 miles to commercially meet some of the challenges that exist today. Industry extended reach-drilling capability is currently between 6 and 7 miles. Conventional drilling rigs using drill pipe and mud motors at shallow angles have established these conventional records. These wells have pushed conventional drilling technologies close to their practical limit and new methods are required for longer offsets.

The industry's lack of a 20 mile drilling capability reduces accessibility to oil and gas reserves. Many areas, both onshore and offshore, have no surface access for development drilling. Onshore, this may be due to urban development as is the case in Holland, national parks or other special areas such as the Arctic National Wildlife Refuge (ANWR), or other land uses that are sensitive to surface drilling operations. Offshore, the incentive is to maximize the use of existing structures and infrastructure by replacing expensive flowlines, manifold and trees. Near shore regions as found in the Santa Barbara Channel, and especially where ice may be present such as in the Arctic or near Sakhalin Island, or where migrating whales may limit seasonal operations provide significant incentives for this new 20 mile drilling capability.

The industry does not have an extreme reach lateral drilling system that is compatible with existing drilling and production infrastructure. If such a system were available, new roads, drill sites, pits, site remediation, permitting, etc. are all avoided in such onshore operations. Offshore, existing host structures will have greatly extended usefulness while reservoirs within 20-mile radii may be developed.

The industry does not have an extreme reach drilling capability that reduces the risk to the environment. If such a system were available, then operating from drilling and production centers would allow using subsurface access to the reservoirs. There would be no surface flowlines or facilities outside the regional drilling and production center. Extreme reach lateral drilling systems could eliminate the need for many of the flowlines on the ocean bottom in a regional development. However, centralized surface operations with fixed facilities require a paradigm shift in development drilling operations. The well drilling and maintenance equipment would not normally be mobile (except offshore on vessels) and it would normally spend its entire working life from one location.

Several references are cited below related to the topics of expandable casing, methods to expand tubulars and casings, fabricating composite umbilicals, and well management systems.

Relevant references to expandable casing includes U.S. Pat. No. 5,667,011, entitled "Method of Creating a Casing in a Borehole", which issued on Sep. 16, 1997, that is assigned to Shell Oil Company of Houston, Tex., and the following U.S. Patents, entire copies of which are incorporated herein by reference:

U.S. Pat. Nos. 5,366,012; 5,348,095; 5,240,074; 4,716,965; 4,501,327; 4,495,997; 3,958,637; 3,203,451; 3,172,618; 3,052,298; 2,447,629; 2,207,478

Relevant references to expandable casing also includes U.S. Pat. No. 6,431,282, entitled "Method for Annular Sealing", which issued on Aug. 13, 2002, that is assigned to Shell Oil Company of Houston, Tex., and the following U.S. Patents, entire copies of which are incorporated herein by reference:

U.S. Pat. Nos. 6,012,522; 5,964,288; 5,875,845; 5,833,001; 5,794,702; 5,787,984; 5,718,288; 5,667,011; 5,337,823; 3,782,466; 3,489,220; 3,363,301; 3,297,092; 3,191,680; 3,134,442; 3,126,959; 2,294,294; 2,248,028

Other relevant foreign patent documents related expandable casing include the following, entire copies of which are incorporated herein by reference:

E.P. 0,643,794; W.O. 09,933,763; W.O. 09,923,046; W.O. 09,906,670; W.O. 09,902,818; W.O. 09,703,489; W.O. 09,519,942; W.O. 09,419,574; W.O. 09,409,252; W.O. 09,409,250; W.O. 09,409,249

Other publications related to expandable casing include the following documents related to Enventure Global Technology of Houston, Tex., entire copies of which are incorporated herein by reference:

(a) Campo, D., et al., "Drilling and Recompletion Applications Using Solid Expandable Tubular Technology", SPE/IADC 72304 at 2002 SPE/IADC Middle East Drilling Technology Conference and Exhibition, 11 Mar. 2002.

(b) Moore, M., et al., "Field Trial Proves Upgrades to Solid Expandable Tubulars", OTC 14217 at 2002 Offshore Technology Conference, 6–9 May 2002.

(c) Grant, T., et al., "Deepwater Expandable Openhole Liner Case Histories: Learnings Through Field Applications", OTC 14218 at 2002 Offshore Technology Conference, 6–9 May 2002.

(d) Dupal, K., et al., "Realization of the Mono-Diameter Well: Evolution of a Game-Changing Technology", OTC 14312 at 2002 Offshore Technology Conference, 6–9 May 2002.

(e) Moore, M., et al., "Expandable Linear Hangers: Case Histories", OTC 14313 at 2002 Offshore Technology Conference, 6–9 May 2002.

(f) Nor, N., et al., "Transforming Conventional Wells to Bigbore Completions Using Solid Expandable Tubular Technology", OTC 14315 at 2002 Offshore Technology Conference, 609 May 2002.

(g) Merritt, R., et al., "Well Remediation Using Expandable Cased-Hole Liners—Summary of Case Histories", Texas Tech University's Southwestern Petroleum Short Course—2002 Conference.

(h) Cales, G., et al., "Subsidence Remediation—Extending Well Life Through the Use of Solid Expandable Casing Systems", AADE 01-NC-HO-24 at March 2001 Conference.

(i) Dupal, K., et al., "Solid Expandable Tubular Technology—A Year of Case Histories in the Drilling Environment", SPE/IADC 67770 at 2001 SPE/IADC Drilling Conference 27 Feb.–1, Mar. 2001.

(j) Dupal, K., et al., "Well Design With Expandable Tubulars Reduces Costs and Increases Success in Deepwater Applications", Deep Offshore Technology, 2002.

(k) Daigle, C., et al., "Expandable Tubulars: Field Examples of Application in Well Construction and Remediation", SPE 62958 at SPE Annual Technical Conference and Exhibition, 1–4 Oct. 2000.

(l) Bullock, M., et al., "Using Expandable Solid Tubulars to Solve Well Construction Challenges in Deep Waters and Maturing Properties", IBP 275 00 at the Rio Oil & Gas Conference, 16–19 Oct. 2000.

(m) Mack, A., et al., "In-Situ Expansion of Casing and Tubing—Effect on Mechanical Properties and Resistance to Sulfide Stress Cracking", NACE 00164 at the NACE Expo Corrosion 2000 Conference, 26–30 Mar. 2000.

(n) Lohoefer, C., et al., "Expandable Liner Hanger Provides Cost-Effective Alternative Solution", IADC/SPE 59151 at 2000 IADC/SPE Drilling Conference, 23–25 Feb. 2000.

(o) Filippov, A., et al., "Expandable Tubular Solutions", SPE 56500 at 1999 SPE Annual Technical Conference and Exhibition, 3–6 Oct. 1999.

(p) Haut, R., et al., "Meeting Economic Challenge of Deepwater Drilling with Expandable-Tubular Technology", Deep Offshore Technology Conference, 1999.

(q) Bayfield, M., et al., "Burst and Collapse of a Sealed Multilateral Junction: Numerical Simulations", SPE/IADC 52873 at 1999 SPE/IADC Drilling Conference, 9–11 Mar. 1999.

Relevant references related to expandable casing also include U.S. Pat. No. 6,354,373, entitled "Expandable Tubing for a Well Bore Hole and Method of Expanding", which issued on Mar. 12, 2002 , that is assigned to the Schlumberger Technology Corporation of Houston, Tex., and the following U.S. Patents, entire copies of which are incorporated herein by reference:

U.S. Pat. Nos. 6,012,522; 5,631,557; 5,494,106; 5,366,012; 5,348,095; 5,337,823; 5,200,072; 5,083,608; 5,014,779; 4,976,322, 5,830,109; 4,716,965; 4,501,327; 4,495,997; 4,308,736; 3,948,321; 3,785,193; 3,691,624; 3,489,220; 3,477,506; 3,364,993; 3,353,599; 3,326,293; 3,054,455; 3,028,915; 2,734,580; 2,447,629; 2,214,226; 1,652,650; 341,327

Other relevant foreign patent documents related to expandable casing include the following, entire copies of which are incorporated herein by reference:

S.U. 1,747,673; S.U. 1,051,222; W.O. 93/25799

Relevant references for methods to expand tubulars and casings include U.S. Pat. No. 6,325,148, entitled "Tools and Methods for Use with Expandable Tubulars", which issued on Dec. 4, 2001, that is assigned to Weatherford/Lamb, Inc. of Houston, Tex., and the following U.S. Patents, entire copies of which are incorporated herein by reference:

U.S. Pat. Nos. 6,070,671; 6,029,748; 5,979,571; 5,960,895; 5,924,745; 5,901,789; 5,887,668; 5,785,120; 5,706,905; 5,667,011; 5,636,661; 5,560,426; 5,553,679; 5,520,255; 5,472,057; 5,409,059; 5,366,012; 5,348,095; 5,322,127; 5,307,879; 5,301,760; 5,271,472; 5,267,613; 5,156,209; 5,052,849; 5,052,483; 5,014,779;

U.S. Pat. Nos. 4,997,320; 4,976,322; 4,883,121; 4,866,966; 4,848,469; 4,807,704; 4,626,129; 4,581,617; 4,567,631; 4,505,612; 4,505,142; 4,502,308; 4,487,630; 4,483,399; 4,470,280; 4,450,612; 4,445,201; 4,414,739; 4,407,150; 4,387,502; 4,382,379; 4,362,324; 4,359,889; 4,349,050; 4,319,393; 3,977,076; 3,948,321; 3,820,370; 3,785,193; 3,780,562; 3,776,307; 3,746,091; 3,712,376; 3,691,624; 3,689,113; 3,669,190; 3,583,200; 3,489,220; 3,477,506; 3,354,955; 3,353,599; 3,326,293; 3,297,092; 3,245,471; 3,203,483; 3,203,451; 3,195,646; 3,191,680; 3,191,677; 3,186,485; 3,179,168; 3,167,122; 3,039,530; 3,028,915; 2,633,374; 2,627,891; 2,519,116; 2,499,630; 2,424,878; 2,383,214; 2,214,226; 2,017,451; 1,981,525; 1,880,218; 1,301,285; 988,504

Other relevant foreign patent documents related to methods to expand tubulars and casings include the following, entire copies of which are incorporated herein by reference:

W.O. 99/23354; W.O. 99/18328; W.O. 99/02818; W.O. 98/00626;

W.O. 97/21901; W.O. 94/25655; W.O. 93/24728; W.O. 92/01139

G.B. 2329918A; G.B. 2320734A; G.B. 2313860B; G.B. 2216926A;

G.B. 1582392; G.B. 1457843; G.B. 1448304; G.B. 1277461;

G.B. 997721; G.B. 792886; G.B. 730338;

E.P. 0 961 007 A2; E.P. 0 952 305 A1; E.P. WO93/25800; D.E. 4133802C1; D.E. 3213464A1

Another relevant publication related to methods to expand tubulars and casings includes the following, an entire copy of which is incorporated herein by reference:

Metcalfe, P. "Expandable Slotted Tubes Offer Well Design Benefits", Petroleum Engineer International, vol. 69, No. 10 (October 1996), pp 60–63.

Relevant references for fabricating composite umbilicals includes U.S. Pat. No. 6,357,485, entitled "Composite Spoolable Tube", which issued on Mar. 19, 2002, that is assigned to the Fiberspar Corporation, and the following U.S. Patents, entire copies of which are incorporated herein by reference:

U.S. Pat. Nos. 6,286,558; 6,148,866; 5,921,285; 6,016,845; 646,887; 1,930,285; 2,648,720; 2,690,769; 2,725,713; 2,810,424; 3,116,760; 3,277,231; 3,334,663; 3,379,220; 3,477,474; 3,507,412; 3,522,413; 3,554,284; 3,579,402; 3,604,461; 3,606,402; 3,692,601; 3,700,519; 3,701,489; 3,734,421; 3,738,637; 3,740,285; 3,769,127; 3,783,060; 3,828,112; 3,856,052; 3,856,052; 3,860,742; 3,933,180; 3,956,051; 3,957,410; 3,960,629; RE29,122; 4,053,343; 4,057,610; 4,095,865; 4,108,701; 4,125,423; 4,133,972; 4,137,949; 4,139,025; 4,190,088; 4,200,126; 4,220,381; 4,241,763; 4,248,062; 4,261,390; 4,303,457; 4,308,999; 4,336,415; 4,463,779; 4,515,737; 4,522,235; 4,530,379; 4,556,340; 4,578,675; 4,627,472; 4,657,795; 4,681,169; 4,728,224; 4,789,007; 4,992,787; 5,097,870; 5,170,011; 5,172,765; 5,176,180; 5,184,682; 5,209,136; 5,285,008; 5,285,204; 5,330,807; 5,334,801; 5,348,096; 5,351,752; 5,428,706; 5,435,867; 5,443,099; RE35,081; 5,469,916; 5,551,484; 5,730,188; 5,755,266; 5,828,003; 5,921,285; 5,933,945; 5,951,812; 6,016,845; 6,148,866; 6,286,558; 6,004,639; 6,361,299

Other relevant foreign patent documents related to fabricating composite umbilicals include the following, entire copies of which are incorporated herein by reference:

DE 4214383; EP 0024512; EP 352148; EP 505815; GB 553,110; GB 2255994; GB 2270099

Other relevant publications related to fabricating composite umbilicals include the following, entire copies of which are incorporated herein by reference:

(a) Fowler Hampton et al.; "Advanced Composite Tubing Usable", The American Oil & Gas Reporter, pp. 76–81 (September 1997).

(b) Fowler Hampton et al.; "Development Update and Applications of an Advanced Composite Spoolable Tubing", Offshore Technology Conference held in Houston Tex. from May 4th to 7th, 1998, pp. 157–162.

(c) Hahan H. Thomas and Williams G. Jerry; "Compression Failure Mechanisms in Unidirectional Composites", NASA Technical Memorandum pp 1–42 (August 1984).

(d) Hansen et al.; "Qualification and Verification of Spoolable High Pressure Composite Service Lines for the Asgard Field Development Project", paper presented at the 1997 Offshore Technology Conference held in Houston Tex. from May 5th to 8th, 1997, pp. 45–54.

(e) Haug et al.,; "Dynamic Umbilical with Composite Tube (DUCT)", Paper presented at the 1998 Offshore Technology Conference held in Houston Tex. from May 4th to 7th, 1998, pp.699–712.

(f) Lundberg et al.; "Spin-off Technologies from Development of Continuous Composite Tubing Manufacturing Process", Paper presented at the 1998 Offshore Technology Conference held in Houston, Tex. from May 4th to 7th, 1998, pp. 149–155.

(g) Marker et al.; "Anaconda: Joint Development Project Leads to Digitally Controlled Composite Coiled Tubing Drilling System", Paper presented at the SPEI/COTA, Coiled Tubing Roundtable held in Houston, Tex. from 5th to 6th of Apr., 2000, pp. 1–9.

(h) Measures R. M.; "Smart Structures with Nerves of Glass", Prog. Aerospace Sc. 26(4):289–351 (1989).

(i) Measures et al.; "Fiber Optic Sensors for Smart Structures", Optics and Lasers Engineering 16: 127–152 (1992)

(j) Poper Peter; "Braiding", International Encyclopedia of Composites, Published by VGH, Publishers, Inc., 220 English 23rd Street, Suite 909, New York, N.Y. 10010.

(k) Quigley et al., "Development and Application of a Novel Coiled Tubing String for Concentric Workover Services", Paper presented at the 1997 Offshore Technology Conference held in Houston, Tex. from 5th to 8th of May 1997, pp. 189–202.

(l) Sas-Jaworsky II and Bell Steve "Innovative Applications Stimulated Coiled Tubing Development", World Oil, 217 (6): 61 (June 1996).

(m) Sas-Jaworsky II and Mark Elliot Teel; "Coiled Tubing 1995 Update: Production Applications", World Oil, 216 (6): 97 (June 1995).

(n) Sas-Jaworsky, A. and J. G. Williams, "Advanced composites enhance coiled tubing capabilities", World Oil, pp. 57–69 (April 1994).

(o) Sas-Jaworsky, A. and J. G. Williams, "Development of a composite coiled tubing for oilfield services", Society of Petroleum Engineers, SPE 26536, pp. 1–11 (1993).

(p) Sas-Jaworsky, A. and J. G. Williams, "Enabling capabilities and potential application of composite coiled tubing", Proceedings of World Oil's 2nd International Conference on Coiled Tubing Technology, pp. 2–9 (1994).

(p) Sas-Jaworsky II Alex; "Developments Position CT for Future Prominence", The American Oil & Gas Reporter, pp. 87–92 (March 1996).

(r) Moe Wood T., et al.; "Spoolable, Composite Tubing for Chemical and Water Injection and Hydraulic Valve Operation", Proceedings of the 11th International Conference on Offshore Mechanics and Arctic Engineering-1992, vol. III, Part A-Materials Engineering, pp. 199–207 (1992).

(s) Shuart J. M. et al.; "Compression Behavior of 45°-Dominated Laminates with a Circular Hole of Impact Damage", AIAA Journal 24(1): 115–122 (January 1986).

(t) Silverman A. Seth, "Spoolable Composite Pipe for Offshore Applications", Materials Selection & Design pp. 48–50 (January 1997).

(u) Rispler K. et al.; "Composite Coiled Tubing in Harsh Completion/Workover Environments", paper presented at the SPE Gas Technology Symposium and Exhibition held in Calgary, Alberta, Canada, on Mar. 15–18, 1998, pp. 405–410.

(v) Williams G. J. et al.; "Composite Spoolable Pipe Development, Advancements, and Limitations", Paper presented at the 2000 Offshore Technology Conference held in Houston Tex. from 1st to 4th of May 2000, pp. 1–16.

A relevant reference for well management systems includes U.S. Pat. No. 6,257,332, entitled "Well Management System", which issued on Jul. 10, 2001, that is assigned to the Halliburton Energy Services, Inc., an entire copy of which incorporated herein by reference.

Typical procedures used in the oil and gas industries to drill and complete wells are well documented. For example, such procedures are documented in the entire "Rotary Drilling Series" published by the Petroleum Extension Service of The University of Texas at Austin, Austin, Tex. that is included herein by reference in its entirety comprised of the following:

Unit I—"The Rig and Its Maintenance" (12 Lessons);
Unit II—"Normal Drilling Operations" (5 Lessons);
Unit III—Nonroutine Rig Operations (4 Lessons);
Unit IV—Man Management and Rig Management (1 Lesson);
and Unit V—Offshore Technology (9 Lessons). All of the individual Glossaries of all of the above Lessons in their entirety are also explicitly included herein, and all definitions in those Glossaries shall be considered to be explicitly referenced and/or defined herein.

Additional procedures used in the oil and gas industries to drill and complete wells are well documented in the series entitled "Lessons in Well Servicing and Workover" published by the Petroleum Extension Service of The University of Texas at Austin, Austin, Tex. that is included herein by reference in its entirety comprised of all 12 Lessons. All of the individual Glossaries of all of the above Lessons in their entirety are also explicitly included herein, and any and all definitions in those Glossaries shall be considered to be explicitly referenced and/or defined herein.

Entire copies of each and every reference explicitly cited above in this section entitled "Description of the Related Art" are incorporated herein by reference.

At the time of the filing of the application herein, the applicant is unaware of any additional art that is particularly relevant to the invention other than that cited in the above defined "related" U.S. Patents, the "related" co-pending U.S. Patent Applications, the "related" co-pending PCT Application, and the "related" U.S. Disclosure Documents that are specified in the first paragraphs of this application.

SUMMARY OF THE INVENTION

An object of the invention is to provide high power umbilicals for subterranean electric drilling.

Another object of the invention is to provide high power umbilicals that allow subterranean electric drilling machines to drill boreholes of up to 20 miles laterally from surface drill sites.

Another object of the invention is to provide high power umbilicals that allow the subterranean liner expansion tools to install casings within monobore wells to distances of up to 20 miles laterally from surface drill sites.

Another object of the invention is to provide high power near neutrally buoyant umbilicals for subterranean electric drilling to reduce the frictional drag on the umbilicals.

Yet another object of the invention is to provide a high power near neutrally buoyant umbilical that possesses high speed data communications and also provides a conduit for drilling mud.

Another object of the invention is to provide an umbilical that delivers in excess of 60 kilowatts to a downhole electric motor that is a portion of a subterranean electric drilling machine.

Yet another object of the invention is to provide a novel feedback control of a downhole electric motor that is a part of a subterranean electric drilling machine.

Yet another object of the invention is to provide high power umbilicals to operate subsea remotely operated vehicles.

Another object of the invention is to provide an umbilical to operate a subsea remotely operated vehicle that possesses high speed data communications and provides a conduit for fluids.

Yet another object of the invention is to provide a novel feedback control of a downhole electric motor that comprises a portion of a remotely operated vehicle.

DESCRIPTION OF THE PREFERRED EMBODIMENTS

Figure 1:
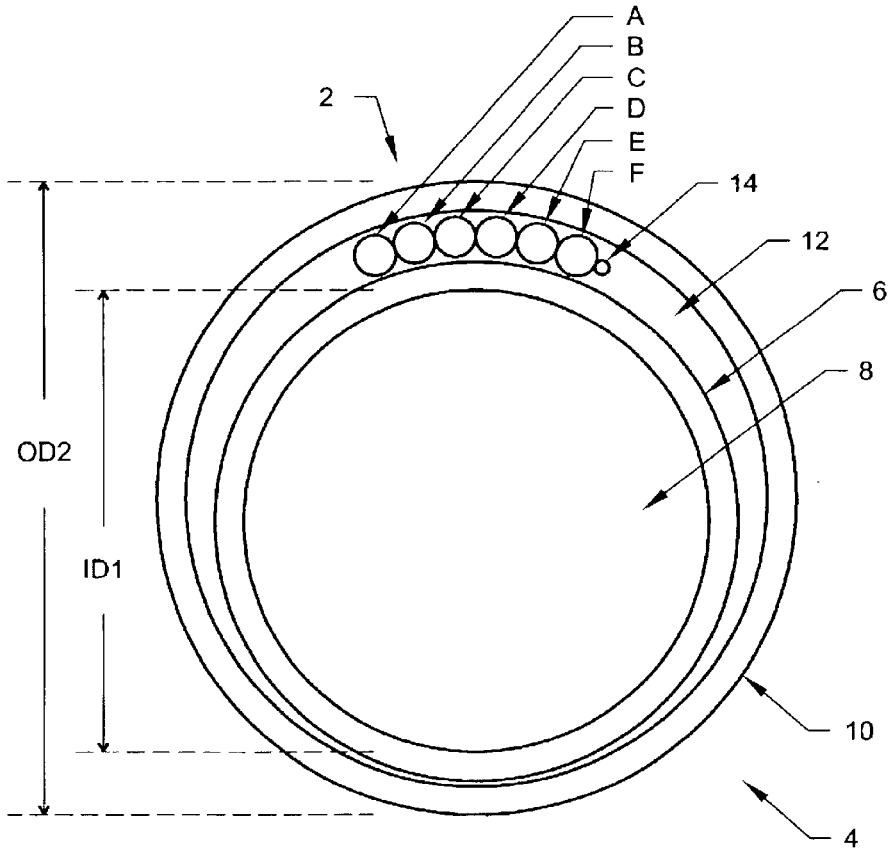
FIG. 1 shows a section view of a umbilical that is substantially neutrally buoyant in drilling mud within the well which provides a conduit for drilling fluids that is capable of providing 320 horsepower of electrical power at a distance of up to 20 miles.

FIG. 1 shows a section view of a preferred embodiment of an umbilical 2. In this preferred embodiment, substantial portions of the umbilical are fabricated from one or more composite materials. Consequently umbilical 2 is also called a composite umbilical. Composite umbilical 2 provides a connection between the surface and other downhole tools (such as a subterranean electric drilling machine to be described later) which is capable of performing useful work at great distances from a well site. In the preferred embodiment shown in FIG. 1, the umbilical is capable of performing useful work at the distance of 20 miles away from a surface drilling site. This statement means that the umbilical is capable of performing useful work at any distance between 0 miles to 20 miles away from a wellsite. This connection is called an umbilical and it does not rotate like drill pipe and its capabilities are different from those of coiled tubing used in drilling operations.

In particular, FIG. 1 shows an umbilical that is substantially neutrally buoyant in any specific density of drilling mud 4 that is present in a wellbore. The drilling mud 4 may also be called the drilling fluid. The symbol for the density of drilling mud is ρ(drilling mud). In this particular example of a preferred embodiment, the density of drilling mud present in the wellbore is 12 lbs/gallon.

In FIG. 1, the composite umbilical is partially fabricated from inside pipe 6. In FIG. 1, the umbilical has an inside diameter of ID1. In this particular embodiment, the inside diameter ID1 is equal to 4.5 inches. The inside diameter forms a hollow region through which fluids may be sent to, and from downhole. Put another way, the inside diameter forms a conduit through which fluids may be sent from the surface downhole, or from downhole to the surface. Therefore, the umbilical possesses a fluid conduit for conducting drilling fluids through the interior of the umbilical. The fluids present within the inside pipe are shown by element 8 in FIG. 1. The density of the fluids 8 is defined to be the symbol ρ(umbilical fluid). For example, drilling mud may be sent downhole through the 4.5 inch ID pipe. The ID of this pipe is also called the interior of this pipe. The inside pipe 6 has wall thickness T1, but this legend is not shown in FIG. 1 for brevity. In this preferred embodiment, the wall thickness of the inside pipe T1 is 0.25 inches. The wall of the inside pipe 6 is made from a composite material. This composite wall may have many layers of different composite materials made of different materials, each layer having a different specific gravity. As an example of one preferred embodiment, the composite material may be a carbon-based composite material. For reasons of simplicity, those layers are not shown in FIG. 1. However, there will be an average specific gravity of the interior pipe that is defined to be SG(inside pipe). In this preferred embodiment, the specific gravity of the inside pipe is equal to 1.5.

In FIG. 1, the composite umbilical is partially fabricated from outside pipe 10. In FIG. 1, the umbilical has an outside diameter of OD2 and this legend is shown in FIG. 1. In this preferred embodiment, the outside diameter OD2 is equal to 6.00 inches O.D. Consequently, the external portion of the composite umbilical appears to be a pipe having the outside diameter of OD2. The outside pipe 10 has wall thickness T2, but this legend is not shown in FIG. 1 for brevity. In this preferred embodiment, the wall thickness of the outside pipe T2 is 0.25 inches. The wall of the outside pipe 10 is made from a composite material. This composite wall may have many layers of different composite materials made of different materials, each layer having a different specific gravity. In one preferred embodiment, the composite material may be a carbon-based composite material. Those layers are not shown in FIG. 1 for simplicity. For example, an outer layer of composite material may be chosen to be particularly abrasion resistant. As one example, the outer layer of composite material may be made of a carbon-based composite material. However, there will be an average specific gravity of the outside pipe that is defined to be SG(outside pipe). In this preferred embodiment, the specific gravity of the outside pipe is equal to 1.5.

As shown in FIG. 1, the interior pipe 6 is asymmetrical located within the exterior pipe 10 that forms an the asymmetric volume 12 between the two pipes. Within the asymmetric volume 12 between the two pipes are insulated current carrying electric wires designated by the legends A, B, C, D, E, and F in FIG. 1. Also shown in FIG. 1 is high speed data link 14. This high speed data link provides high speed data communications from the surface to downhole equipment, and from the downhole equipment to the surface. High speed data link 14 is selected from a list including a fiber optic cable, a coaxial cable, and twisted wire cables. In the particular preferred embodiment of the invention shown in FIG. 1, the high speed data link is chosen to be a fiber optic cable. The asymmetric volume 12 between the two pipes that contains wires A, B, C, D, E, and F, and the fiber optic cable, is otherwise filled with syntactic foam material. This syntactic foam material is often made from silica microspheres that are embedded in a filler material, such as epoxy resin or other composite materials. The syntactic foam material has a specific gravity that is defined as SG(syntactic foam material). In this preferred embodiment of the invention, the specific gravity of the syntactic foam material is 0.825. In this preferred embodiment of the invention, syntactic foam material possessing silica microspheres is provided by the Cumming Corporation. The Cumming Corporation is located at 225 Bodwell Street, Avon, Mass. 02322. The Cumming Corporation can also be reached by telephone at (508) 580-2660 or by the internet at www.emersoncumming.com. The details on the syntactic foam material may be reviewed in detail in Attachment 28 to Provisional Patent Application No. 60/384,964, that has the Filing Date of Jun. 3, 2002, an entire copy of which is incorporated herein by reference. Using silica microspheres in a syntactic matrix provides the necessary buoyancy in high pressure wellbores. The high axial strength of the composite pipe construction compensates for variations in axial loads caused by mud weight and other density variations.

Figure 4:
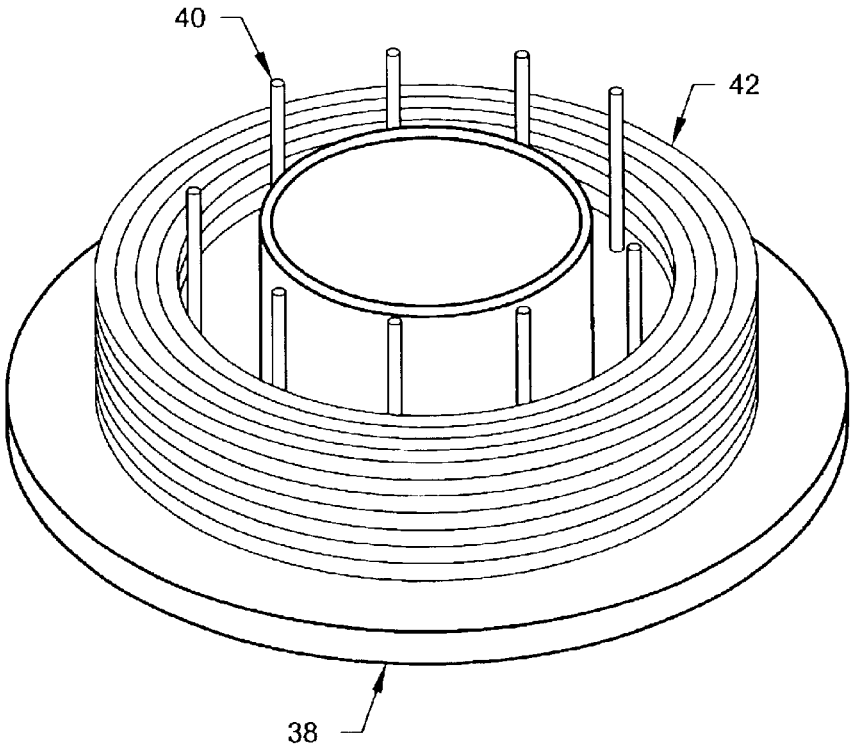
FIG. 4 shows an umbilical carousel in the process of being constructed.

In FIG. 1, wires A, B, C, D, E, and F are 0.355 inches O.D. insulated No. 4 AWG Wire. The insulation is rated at 14,000 volts DC, or 0-peak AC. Wires A, B, and C comprise the first independent three phase delta circuit. Wires D, E, and F comprise the second independent three phase delta circuit. Each separate circuit is capable of providing 160 horsepower (119 kilowatts) over an umbilical length of 20 miles at the temperature of 150 degrees C. So, combined, the umbilical can deliver a total of 320 horsepower (238 kilowatts) at 20 miles to do work at that distance. At 320 horsepower, less than 1 watt per foot of power is dissipated in the form of heat, which makes this a practical design even if the umbilical is completely wound up on an umbilical carousel as shown in a later figure (FIG. 4). In this preferred embodiment, wires A, B, C, D, E, and F are No. 4 AWG stranded silver plated copper wire which are covered with insulation rated to 14,000 VDC at 200 degrees C., where each wire has a DC resistance of 0.250 ohms per 1000 feet at the temperature of 20 degrees C., where the nominal outside diameter of each insulated wire is 0.355 inches, and where each wire weighs 180 lbs/1000 feet. Each wire is Part Number FEP4FLEXSC provided by Allied Wire & Cable, Inc. which is located at 401 East 4th Street, Bridgeport, Pa. 19405, which may be reached by telephone at (800) 828-9473. The details on Allied Part Number FEP4FLEXSC may be reviewed in Attachment 27 to Provisional Patent Application No. 60/384,964, that has the Filing Date of Jun. 3, 2002, an entire copy of which is incorporated herein by reference.

If the inside pipe 6 is carrying 12 lb per gallon mud, and if the exterior pipe is immersed in 12 lb per gallon mud in the well, then the upward buoyant force in the above preferred embodiment of the umbilical is plus 5.9 lbs per 1000 feet of this umbilical. Assuming a coefficient of friction of 0.2, the total frictional "pull-back" on 20 miles of this umbilical is only 124 lbs. This "pull-back" does not include any differential fluid drag forces. This umbilical was chosen to have an extreme length which shows that the essentially neutrally buoyant umbilical overcomes most friction problems associated with umbilicals disposed in wells. For the details of this calculation of a net upward force of 5.9 lbs as described above, please refer to "Case J" of Attachment 34 to Provisional Patent Application No. 60/384,964, that has the Filing Date of Jun. 3, 2002, an entire copy of which is incorporated herein by reference. Those particular calculations were performed on the date of Nov. 12, 2001. In these calculations, the density of water of 62.43 lbs/cubic foot was used to calculate the net forces acting on volumes having particular specific gravities. Please also see other relevant buoyancy calculations in Attachments 29 to 35 of Provisional Patent Application No 60/384,964.

The phrase "substantially neutrally buoyant", "essentially neutrally buoyant", "near neutral buoyant", and "approximately neutrally buoyant" may be used interchangeably. For a substantially neutrally buoyant umbilical, or near neutrally buoyant umbilical, the downward force of gravity on a section of the umbilical of a given length is approximately balanced out by the upward buoyant force of well fluid acting on the umbilical of that given length. The density of mud in the well is strongly influenced by any cuttings from any drilling machine attached to the umbilical (to be described later). Similarly, the density of the fluids inside pipe 6 may also be strongly influenced by any cuttings from the drilling machine (if reverse flow is used). So, the density of the drilling mud 4 and the density of fluids present within the pipe 8 may vary with distance along the length of the umbilical. However, at any position along the length of the umbilical which is disposed in the well, the umbilical may be designed to be "substantially neutrally buoyant", "essentially neutrally buoyant", "near neutral buoyant" or "approximately neutrally buoyant". In addition, using the design principles described herein, the entire length of the umbilical may be designed to be on average "substantially neutrally buoyant", "essentially neutrally buoyant", "near neutral buoyant", or "approximately neutrally buoyant" over the entire length of the umbilical that is disposed within a wellbore.

An umbilical that is "substantially neutrally buoyant", "essentially neutrally buoyant", "near neutral buoyant", or "approximately neutrally buoyant" greatly reduces the frictional drag on the umbilical as it moves in the wellbore. That statement is evident from the following. The net force on a length of umbilical from gravity and buoyant forces is F. The coefficient of sliding friction is k. Therefore, the net "pull back force" P for the given length of the umbilical is given by:

$$P=Fk \qquad \text{Equation 1.}$$

The requirement of a near neutrally buoyant umbilical greatly reduces the frictional drag on the umbilical as it moves in the wellbore. This is a particularly important point. If an umbilical is "substantially neutrally buoyant", "essentially neutrally buoyant", "near neutral buoyant", or "approximately neutrally buoyant" then the frictional drag on the umbilical is greatly reduced as it moves through the wellbore. There are other details to consider such as the starting friction, any sticky substances in the well, drag due to viscous forces, etc. However, Equation 1 forms the basis for providing high electrical power through umbilicals at great distances such as 20 miles from a drilling site. As stated before in relation to this preferred embodiment, with a net force on 1,000 feet of the umbilical being only plus 5.9 lbs (an upward force), assuming a coefficient of friction of 0.2, the total frictional "pull-back" on 20 miles of this umbilical is only 124 lbs.

The preferred embodiment also calls for other reasonable design requirements on the umbilical. The umbilical needs significant axial strength (to pull the drilling machine from the well in the event of equipment failure downhole as explained later) that would require a 160,000 lbs design load. The umbilical must provide an internal pressure capacity (shut-in pressure capacity of the well) of about 10,000 psi. The collapse resistance of the umbilical must exceed a 6,000 psi differential pressure. The umbilical must have the ability to work in at least 120 degrees C., and preferably, 150 degrees C. Composites are now routinely used at 120 degrees C., and experiments are now being conducted on composites at 150 degrees C. Hollow high-strength glass may replace carbon fiber composites for a cost savings, but there will be a weight penalty, thereby increasing frictional drag.

The umbilical may occasionally be damaged during its use and require field repairs. Repairs will be accomplished by cutting out the damaged part and using field installable end connections to rejoin the intact umbilical sections. The end connections will also join various sections of umbilical that may be stored separately at the surface. These couplings are expected to slightly reduce the ID and increase the umbilical OD.

The particular asymmetric design shown in FIG. 1 was selected as a preferred embodiment in part because it illustrates the various considerations necessary to design and build such a high power umbilical that is neutrally buoyant in well fluids. Other more symmetric designs for such an umbilical are shown in another preferred embodiment shown in FIG. 20 below. The references cited above in the section entitled "Description of the Related Art" provide the generally known methods used in the industry to construct composite umbilicals.

Figure 2:
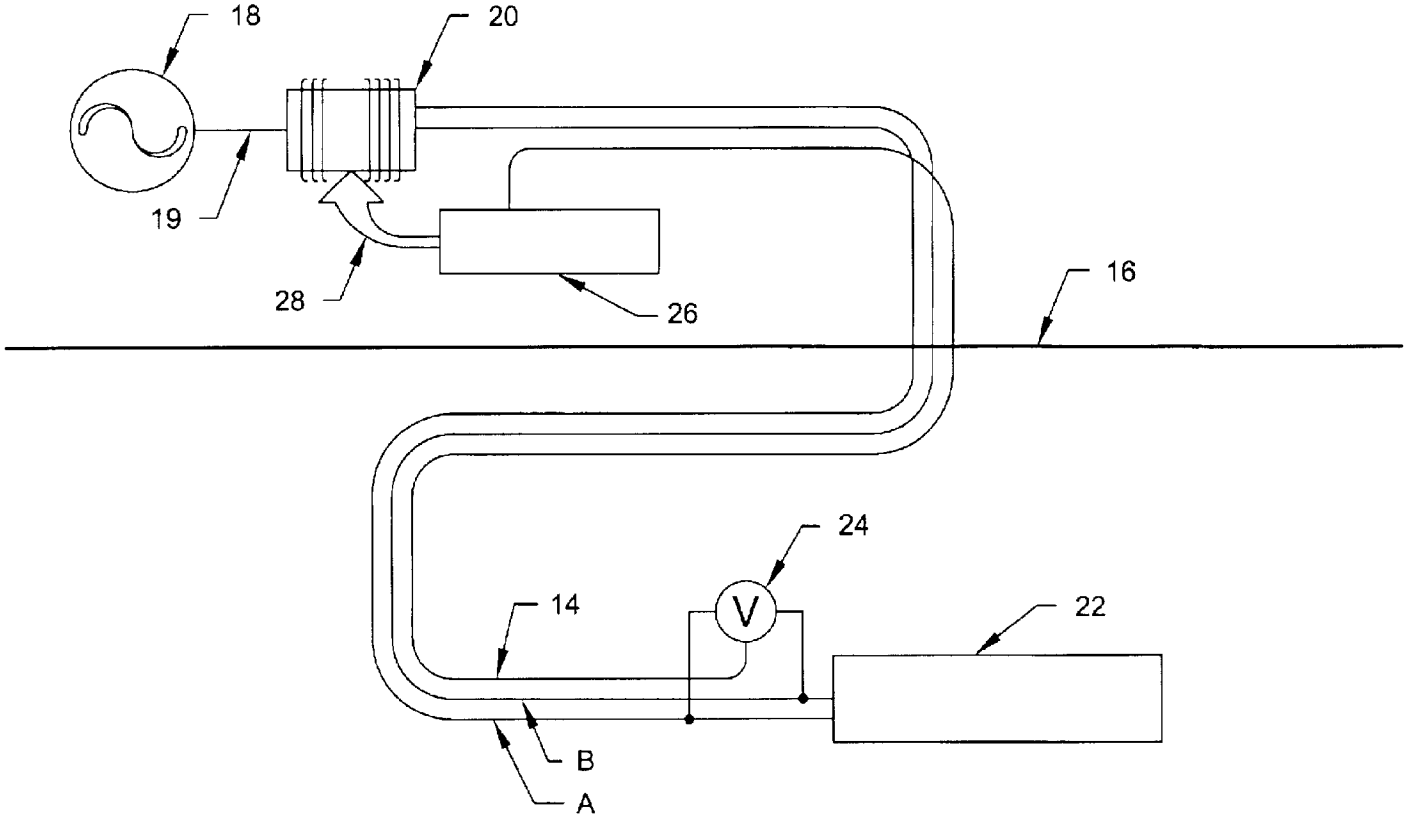
FIG. 2 shows the uphole and downhole power management system for the composite umbilical shown in FIG. 1.

FIG. 2 shows the uphole and downhole power management system for the composite umbilical shown in FIG. 1. Wires A, B, and fiber optic cable 14, which were identified in FIG. 1, are shown in FIG. 2. In FIG. 2, the surface of the earth is shown figurative as element 16. Any function shown above element 16 is identified as an "uphole function", and any function shown below element 16 is identified as a "downhole function".

In FIG. 2, only wires A and B of a first three phase delta circuit are shown. Three phase delta is an AC circuit having three wires (for example A, B, and C), each wire of which carries a an AC current, and there exists a voltage difference between each wire. There exists phase relationships between the current vs. time in each wire. There exits phase relationships between the voltage vs. time in each wire. However, in FIG. 2, wire C is not shown for simplicity. Electrical generator 18 provides three phase delta power through cable 19 to variable voltage and frequency converter 20. The variable voltage and frequency converter possesses electronics that provides measurement of the voltages, currents and phases of the three phase delta circuit (although that electronics is not shown in FIG. 2 for the purposes of simplicity). Electrical power is delivered by wires A and B to the downhole electrical load 22. In one preferred embodiment, the electrical load is a downhole electric motor. The voltage, current, the relevant phases, and other parameters of the electrical load are measured with sensing unit 24. Sensing unit 24 is marked with the legend "V" indicating that at least the voltage V is measured between wires A and B at electrical load 22. Sensing unit 24 is attached to the electrical input terminals of the downhole electrical load. If this is a downhole electrical motor, the sensing unit 24 is attached to the electrical input terminals of the electric motor.

Sensing unit 24 also possesses suitable electronics that sends the measured downhole information to the surface through optical fiber 14. The downhole information is sent by optical fiber 14 that provides the measured information to computer system 26. The measured downhole information is digitized with related instrumentation (not shown for the purposes of simplicity in FIG. 2), and the downhole information is forwarded uphole by light pulses sent through the optical fiber 14.

In FIG. 2, the computer system 26 also possesses related electronics to implement the following. The computer system and related electronics provides commands to the variable voltage and frequency converter 20 by electronic feedback loop 28 to provide the necessary voltage, current, phases, and frequency as required by the downhole load 22. Consequently, FIG. 2 shows a closed-loop, dynamic feedback system, where downhole load parameters are measured, the information is sent uphole, and the uphole system is automatically adjusted to provide what is required to properly operate the electrical load. The point is that the feedback loop 28 from computer 20 is used to produce the required frequency, voltage, current and phases required by the downhole load 22. This is an example of the feedback control of the downhole load 22, which may be a downhole electric motor in several preferred embodiments.

In an alternative embodiment of feedback control, the feedback loop from computer 26 in FIG. 2 is used to control the RPM of a motor generator whose 0-peak output voltage may be easily varied, which provides conveniently controlled frequency and voltage outputs, although that minor variation of the preferred embodiment is not shown in a separate figure for the purposes of brevity. In this case, the feedback loop from computer 26 is first used to control the RPM of the motor, and is also used for the second purpose to control the output voltage, frequency, and phase from the generator attached to the motor which makes the motor generator assembly.

Additional measured downhole load parameters are also sent uphole through the optical fiber. For example, in one preferred embodiment, element 22 in FIG. 2 is an electrical motor, and as an example, the measured RPM, the current drawn by the motor through its input terminals, the voltage across its input terminals, and the phases of the voltages and current vs. time, the temperature, torque, etc. of that electrical motor can be sent uphole through the optical fiber 14. In other preferred embodiments, the electrical load 22 is a submersible electric drilling machine, and in another embodiment, the electrical load is a remotely operated vehicle.

The system shown in FIG. 2 controls a first three phase delta circuit that energizes wires A, B, and C in FIG. 1. A second similar system to that shown in FIG. 2 controls the power derived to wires D, E and F from a second three phase delta circuit. For simplicity, the second three phase delta circuit is not shown in FIG. 2. Such a system is capable of delivering 320 horsepower through an umbilical disposed in a wellbore shown in FIG. 1 that has a length of up to 20 miles. This is important, because most of the available motors for downhole use are AC motors, and are not DC motors.

The AC power management system shown in FIG. 2 has at least several advantages. First, DC voltages are not used which would generally require a "chopper" to convert DC to AC to operate most currently available downhole electric motors. Such high power choppers are complex, often large, and generate considerable heat. Second, no downhole transformer is necessary because of the active closed-loop feedback system shown in FIG. 2.

However, the basic feedback control of downhole parameters as such as voltage and current are also useful for a DC power management system for DC electric motors that can be used in a subterranean electric drilling machine. Accordingly, another preferred embodiment of the invention is controlling DC voltages with an analogous system as outlined in FIG. 2.

Figure 3:
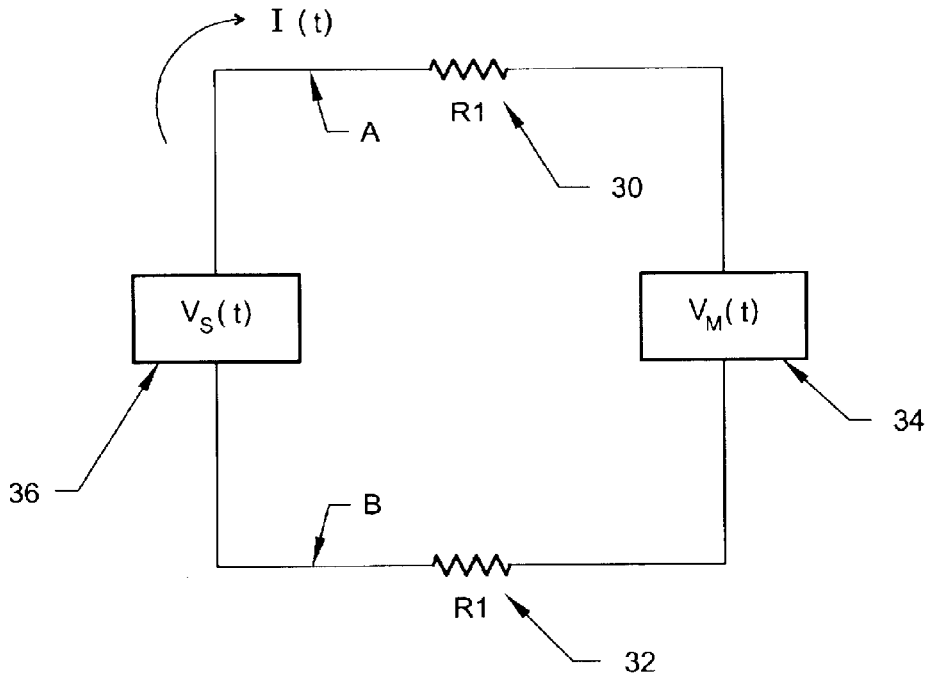
FIG. 3 shows an electrical block diagram representing two conductors from one three phase delta circuit providing up to 160 horsepower of electrical power at a distance of up to 20 miles.

FIG. 3 shows how three phase power of 160 horsepower (119 kilowatts) can be delivered through the electrical conductors in FIGS. 1 and 2 to distances of 20 miles. This means that this power can be delivered from 0 miles to 20 miles away from a drill site for example. Two "legs" of the three phase delta circuit are shown in FIG. 3 as wires A and B (wire C of the three phase delta circuit is not shown for simplicity). The resistances of a length of 20 miles of the wire is simulated with resistors having the magnitude of resistance in ohms of "R1". The legend "R1" appears in FIG. 3. These two resistors are also respectively labeled as elements 30 and 32. In a preferred embodiment, the load at the end of the umbilical is simulated with a downhole electric motor 34 requiring 2,500 volts 0-peak at 45 amps 0-peak between any two wires of the three phase wiring system operating at 60 Hz. As a practical case, this "downhole motor" could in principle be comprised of two each REDA, 4 Pole Motors, each requiring 1250 volts 0-peak, at 45 amps 0-peak, having a nominal RPM of about 1700 RPM. The current flowing through wires A and B is represented by the legend I(t) in FIG. 3. This required motor voltage is represented by the legend $V_M(t)$. The closed-loop, dynamic feedback system described in FIG. 2 automatically and continuously adjusts the voltage provided downhole to the motor that is measured with sensing unit 24 in FIG. 2. In this preferred embodiment, typically, the variable voltage and frequency converter 20 in FIG. 2 provides 6,182 volts 0-peak and provides 45 amps 0-peak between any two legs of the three phase circuit. The supplied voltage is represented by element 36 in FIG. 3. The voltage supplied by the voltage and frequency converter 20 is represented by the legend $V_S(t)$ in FIG. 3. The point of this is that using the above described feedback system and reasonable gauge wiring, it is possible to actually deliver 160 horsepower (119 kilowatts) at a distance of 20 miles.

FIG. 3 shows a first independent circuit that provides 2,500 volts 0-peak to a load, a motor in this preferred embodiment, at distances of up to 20 miles between wires A, B, and C respectively, and the motor may draw up to 45 amps 0-peak between any pairs of wires, A-B, B-C, or C-A. A second independent circuit, that is not shown for simplicity, also provides 2,500 volts 0-peak to another motor at distances to 20 miles between wires D, E, and F respectively, and that motor may also draw up to 45 amps 0-peak from any wire D,E, and F. Such voltages and currents are necessary for two series operated REDA 4 Pole Motors, each rated for 80 Horsepower (as shown in a later figure, FIG. 8). REDA is a manufacturer called "Reda Div. Camco International, Inc." that may be reached at 4th & Dewey, Bartlesville, Okla. 74005, having the telephone number of (918) 661-2000, that has a website that may be reached through www. schlumberger. com.

In summary, the umbilical 2 in FIG. 1 must carry high power and high speed communications (320 hp—two circuits of 160 hp each—and fiber optic communications). An A.C. voltage, transformerless, downhole electrical power arrangement is used. The input power and voltage are managed topside to maintain constant downhole load voltage. In one preferred embodiment, one of the two circuits is dedicated to the downhole mud pump (or Smart Shuttle™) service, while the second circuit operates other Downhole Rig™ functions such as the rotation and weight loading of a drilling bit, which will be described in later figures. In various preferred embodiments, the various downhole motors feature soft start controls allowing the topside power supply to reliably track power demand.

In the above preferred embodiment, a three phase delta power circuit is used. In principle, any electrical power system may be used including 208 Y and related power systems, and ordinary single phase power systems.

FIG. 4 shows an umbilical carousel in the process of being constructed. This equipment is similar to flexible pipe handling equipment now used in the industry. A first carousel flange 38 possesses interior spokes 40 that forms the inside diameter of the umbilical carousel. Wound on those interior spokes is the umbilical 42. A second carousel flange (not shown) encloses the wound up umbilical, although it not shown in the interest of brevity. In one preferred embodiment, the umbilical 42 is the same umbilical as shown in FIG. 1 that is 6 inches OD. The umbilical may be stored and operated as a single line. However, the umbilical is preferably divided into several smaller lengths, as an example 5 miles each, and stored on smaller carousals or drums to reduce the fluid friction losses as compared to one 20-mile continuous length. A level wind is provided on each carousel to correctly wrap the pipe as it is pulled from the well and returned to the carousel for storage.

Each carousel holding 5 miles of the 6 inch OD umbilical is approximately 8 ft tall with an outside diameter of 22 ft. The mud filled umbilical weighs approximately 234 tons. Unless this equipment is installed on offshore vessels, it is not easily moved. For this reason, drilling centers where the rig is assembled are expected to use the equipment over its useful life. Such carousals may be supplied by Coflexip Stena Offshore, Inc. located at 7660 Woodway, Suite 390, Houston, Tex. 77063, having the telephone number (713) 789-8540, which has its website at www.coflexip.com. Such carousals may also be supplied by Oceaneering International, Inc. located at 11911 FM 529, Houston, Tex. 77401, having telephone number (713) 329-4500, which has its website at www.oceaneering.com.

Much surface equipment is needed in support of handling the umbilical. This surface equipment is briefly described in the following. Much of this equipment may be supplied by a firm located in Holland called Huisman-Itrec, that may be located at Admiraal Trompstraat 2—3115 HH Schiedam, P.O. Box 150—3100 AD Schiedam, The Netherlands, Harbour No. 561, having the telephone number of 31(0) 10 245 22 22, that has its website at www.Huisman-Itrec.com.

Stripper heads and surface blow-out preventers (BOP's) provide an OD pressure seal to the umbilical, although no figures are provided to show this feature for simplicity. This equipment has a similar function to a coiled tubing stripper head, except it handles the larger umbilical OD sizes. In practice, the actual sealing element is expected to be dual 13 ⅝" annular stripping BOPs with grease injection to lubricate the sealing elements as the umbilical moves through the sealing elements. This approach of dual stripping units allows the umbilical mechanical couplings to be transitioned into the well. The surface BOPs provide for surface well control in the event of a well kick. These (shear, pipe & blind ram) BOPs will be located between the wellhead and the stripping annular units.

An injector unit is required on the surface, although no figure is shown for simplicity. A 100-ton linear traction unit is preferred for this application. The injection unit provides drilling umbilical pushing and pulling loads at speeds to 10 feet per second. The maximum loads will be at low speeds. Speed will be limited by mudflows within the wellbore. This injector unit has a function similar to a coiled tubing injector but practically is closer in size and performance to a pipeline tensioner used to lay flexible pipe. Similar units are used for the handling and installation of flexible pipe by such firms as Coflexip Stena Offshore, Inc.; Wellstream, Inc.; and NKT Flexibles I/S. The address of Coflexip Stena Offshore, Inc. has been provided above. Wellstream, Inc. is a subsidiary of Halliburton Energy Services, and may be reached at 10200 Bellaire Boulevard, Houston, Tex. 77072-5299, having the telephone number of (281) 575-4033. NKT Flexibles I/S is a firm located in Denmark having the address of Priorparken 510, DK-2605 Broendby, Denmark, having the telephone of 45 43 48 30 00, that has its website at www.nktflexible-s.com.

Figure 14:
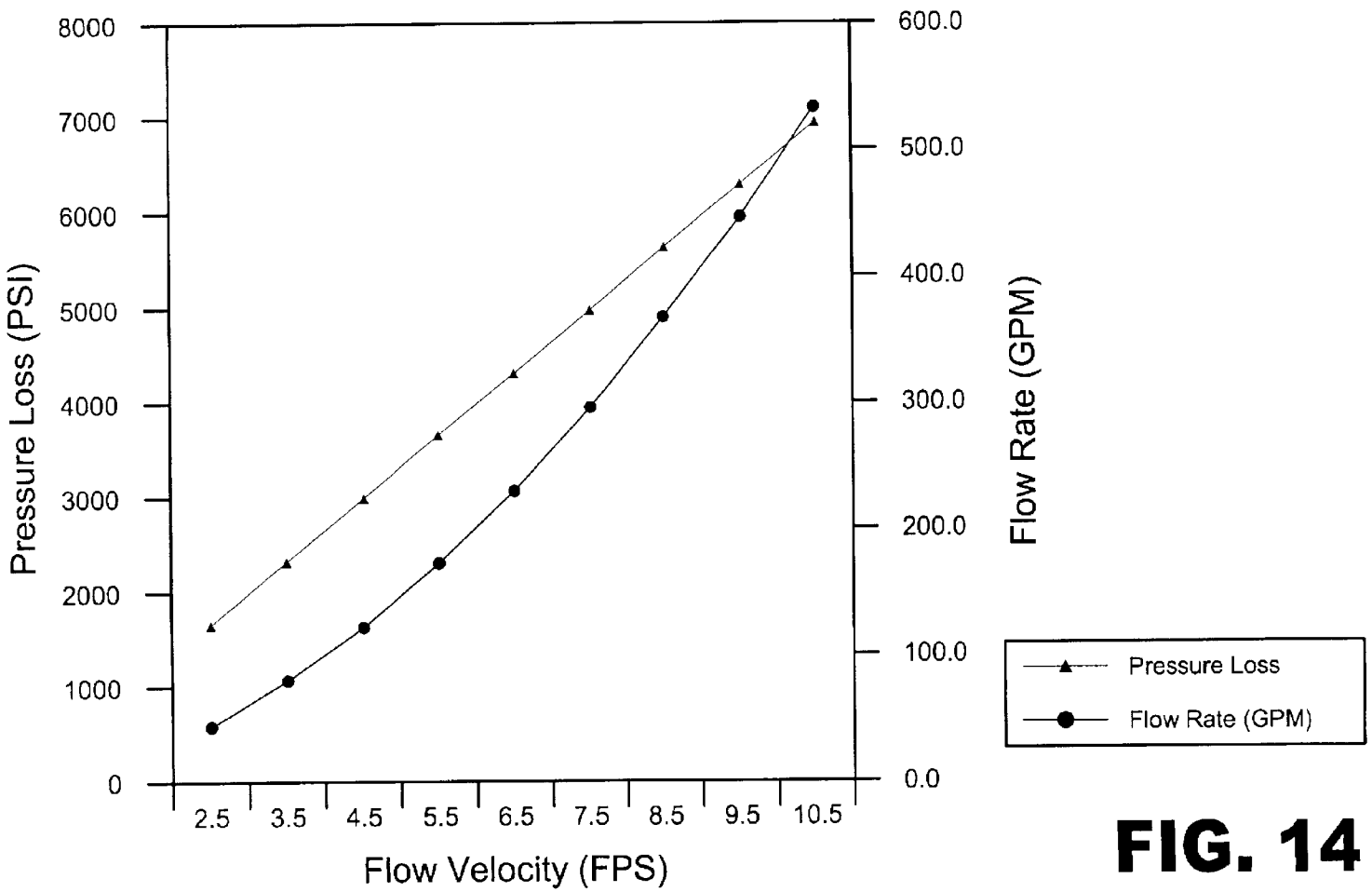
FIG. 14 shows relevant parameters related to fluid flow rates through the umbilical.

A surface mud system is required for the umbilical, although no figures showing this feature are provided for the sake of brevity. A large volume of working mud will be needed to manage the umbilical volume while tripping in the hole. For 20-mile offset operations, an active mud tank volume of 3,500 barrels may be required. This is similar to some large offshore drilling rigs in capacity. A minimum of two 750 hp surface mud pumps will be required for the preferred embodiment. The other details concerning the mud system will be presented in relation to a forthcoming figure (FIG. 14).

A surface rig is needed to support umbilical and casing operations, although no figure is presented showing this detail in the interests of brevity. The surface rig handles and makes-up the casing as it is run into the hole. In many respects, it is similar to conventional coiled tubing drilling rigs, except it is much larger in size. During drilling operations, the best method for joining expandable casing is continuing to develop. Enventure Global Technology is developing an expandable threaded joint. Enventure also has commercially available various sizes of expandable pipes and can supply various means of joining lengths of the expandable pipe. Enventure Global Technology may be reached at 16200-A Park Row, Houston, Tex. 77084, having the telephone number of (281) 492-5000, that has its website at www.EnventureGT.com. Other alternatives of joining expandable is to weld long casing strings (similar to J-laying pipelines). The arrangement of surface rig equipment is compatible with both alternatives.

Figure 5:
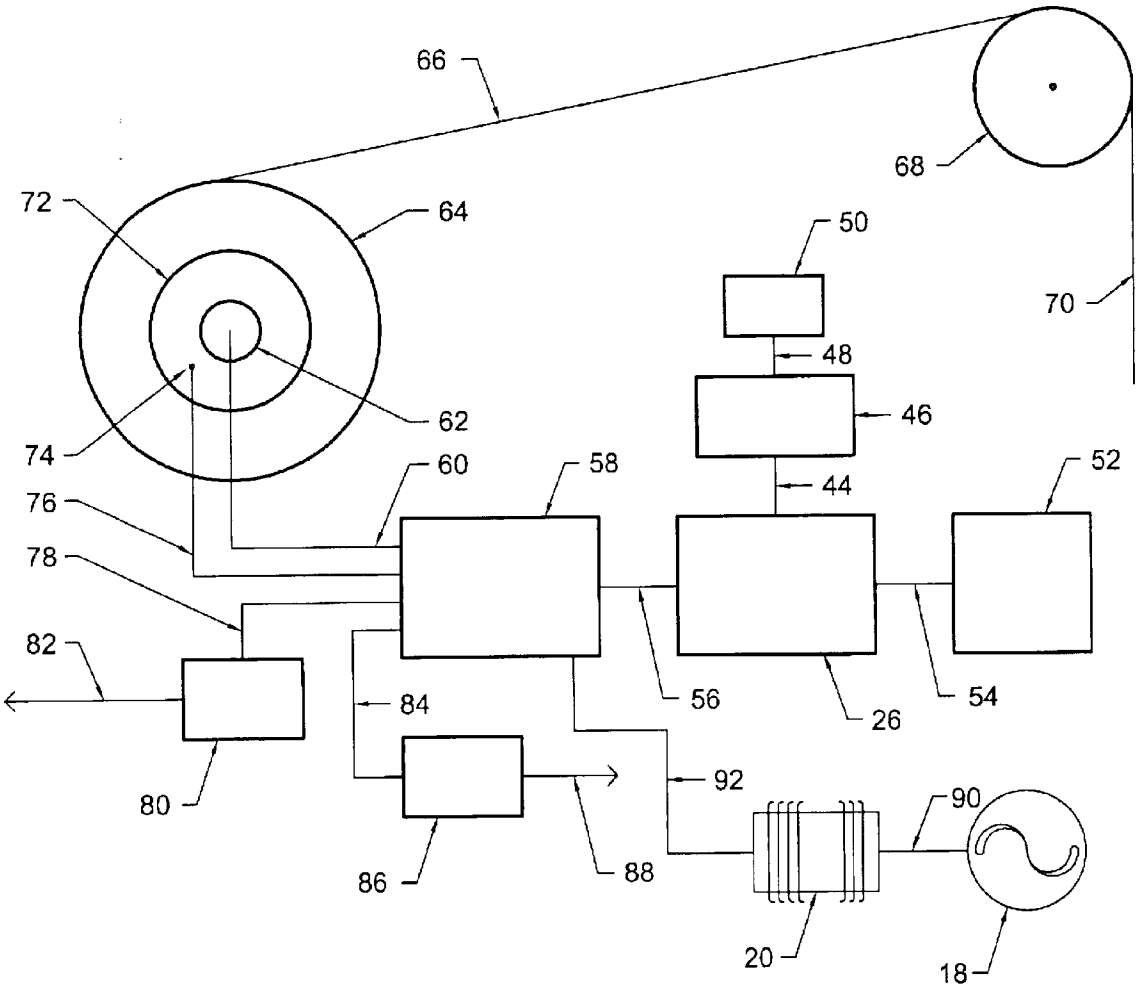
FIG. 5 shows a computerized uphole management system for the umbilical that provides for the closed-loop automatic control of all uphole and downhole functions.

FIG. 5 shows a computerized uphole management system for the umbilical. It is a portion of a preferred embodiment of an automated system to drill and complete oil and gas wells. It is also a portion of a preferred embodiment of a closed-loop system to drill and complete oil and gas wells. FIG. 5 shows the computer control of the umbilical carousel in a preferred embodiment of the invention.

In FIG. 5, computer system 26 (previously described in FIG. 2) has typical components in the industry including one or more processors, one or more non-volatile memories, one or more volatile memories, many software programs that can run concurrently or alternatively as the situation requires, etc., and all other features as necessary to provide computer control of all of the uphole functions. In this preferred embodiment, this same computer system 26 also has the capability to acquire data from, send commands to, and otherwise properly operate and control all downhole functions. Therefore LWD and MWD data is acquired by this same computer system when appropriate. As a consequence, in one preferred embodiment, the computer system 26 has all necessary components to interact with a subterranean electric drilling machine. In a "closed-loop" operation of the system, information obtained downhole from the downhole system is sent to the computer system that is executing a series of programmed steps, whereby those steps may be changed or altered depending upon the information received from the downhole sensor located within the downhole system.

In FIG. 5, the computer system 26 has a cable 44 that connects it to display console 46 that has one or more display screens. The display console 46 displays data, program steps, and any information required to operate the entire uphole and downhole system. The display console is also connected via cable 48 to alarm and communications system 50 that provides proper notification to crews that servicing is required. Data entry and programming console 52 provides means to enter any required digital or manual data, commands, or software as needed by the computer system, and it is connected to the computer system via cable 54.

In FIG. 5, computer system 26 provides commands over cable 56 to the electronics interfacing system 58 that has many functions. One function of the electronics interfacing system is to provide information to and from any downhole load through cabling 60 that is connected to the slip-ring 62, as is typically used in the industry. Another function of the electronics interfacing system is to provide power to any downhole load through cabling 60 that is connected to the slip-ring 62. The slip-ring 62 is suitably mounted on the side of the assembled umbilical carousel 64 in FIG. 5. Information provided to slip-ring 62 then proceeds to wires A, B, C, D, E, F, and G within the umbilical wound up on the umbilical carousel. The umbilical 66 proceeds to an sheave and tensioner device 68 and then the umbilical proceeds downward at location 70 towards the injection unit and on to the stripper heads and surface blow-out preventers (BOP's). The sheave an tensioner device 68 may place appropriate tension on the umbilical as required.

In FIG. 5, electronics interfacing system 58 also provides power and electronic control of the hydraulic system 72 that controls the umbilical carousel through the connector at location 74. Cabling 76 provides the electrical connection between the electronics interfacing system 58 and the hydraulic system 72 that controls the umbilical carousel. In addition, electronics interfacing system 58 has output cable 78 that provides commands and control to the drilling rig hardware control system 80 that controls various drilling rig functions and apparatus including the rotary drilling table motors, the mud pump motors, the pumps that control cement flow and other slurry materials as required, and all electronically controlled valves, and those functions are controlled through cable bundle 82 which has an arrow on it in FIG. 5 to indicate that this cabling goes to these enumerated items.

In relation to FIG. 5, electronics interfacing system 58 also has cable output 84 to ancillary surface transducer and communications control system 86 that provides any required surface transducers and/or communications devices required for communications with the downhole equipment. In a preferred embodiment, ancillary surface and communications system 86 provides acoustic transmitters and acoustic receivers as may be required to communicate to and from certain downhole equipment. The ancillary surface and communications system 86 is connected to the required transducers, etc. by cabling 88 that has an arrow in FIG. 5 designating that this cabling proceeds to those enumerated transducers and other devices as may be required. Electrical generator 18 provides three phase delta power to variable voltage and frequency converter 20 by cable 90. The output from the voltage and frequency converter 20 is provided by cable 92 to the electronics interfacing system 58. Power to wires A, B, C, D, E, F, and G, and signals to the fiber optic cable 14 (not shown in FIG. 5, but which are defined in FIG. 1) are provided from the electronics interfacing system 58 through cabling 60 that is connected to the slip-ring 62. The cabling 60 and the slip-ring provide the suitable electrical and fiber optic connections. Cabling 60 possesses connection to wires A, B, C, D, E, F, and G, and to the fiber optic cable 14. In certain preferred embodiments, there are two separated generators and voltage and frequency converters to independently control to first three phase delta system having wires A, B, and C, and the second thee phase delta system having wires D, E, and F.

With respect to FIG. 5, and to the closed-loop system to drill and complete oil and gas wells, standard electronic feedback control systems and designs are used to implement the entire system as described above, including those described in the book entitled "Theory and Problems of Feedback and Control Systems", "Second Edition", "Continuous(Analog) and Discrete(Digital)", by J. J. DiStefano III, A. R. Stubberud, and I. J. Williams, Schaum's Outline Series, McGraw-Hill, Inc., New York, N.Y., 1990, 512 pages, an entire copy of which is incorporated herein by reference. Therefore, in FIG. 5, the computer system 58 has the ability to communicate with, and to control, all of the above enumerated devices and functions that have been described to this point.

To emphasize one major point in FIG. 5, computer system 26 has the ability to receive information from one or more downhole sensors for the closed-loop system to drill and complete oil and gas wells. This computer system executes a sequence of programmed steps, but those steps may depend upon information obtained from at least one sensor located within the downhole system. This computer system provides the automatic control of the umbilical and any uphole and downhole functions related to the deployment of that umbilical.

Figure 6:
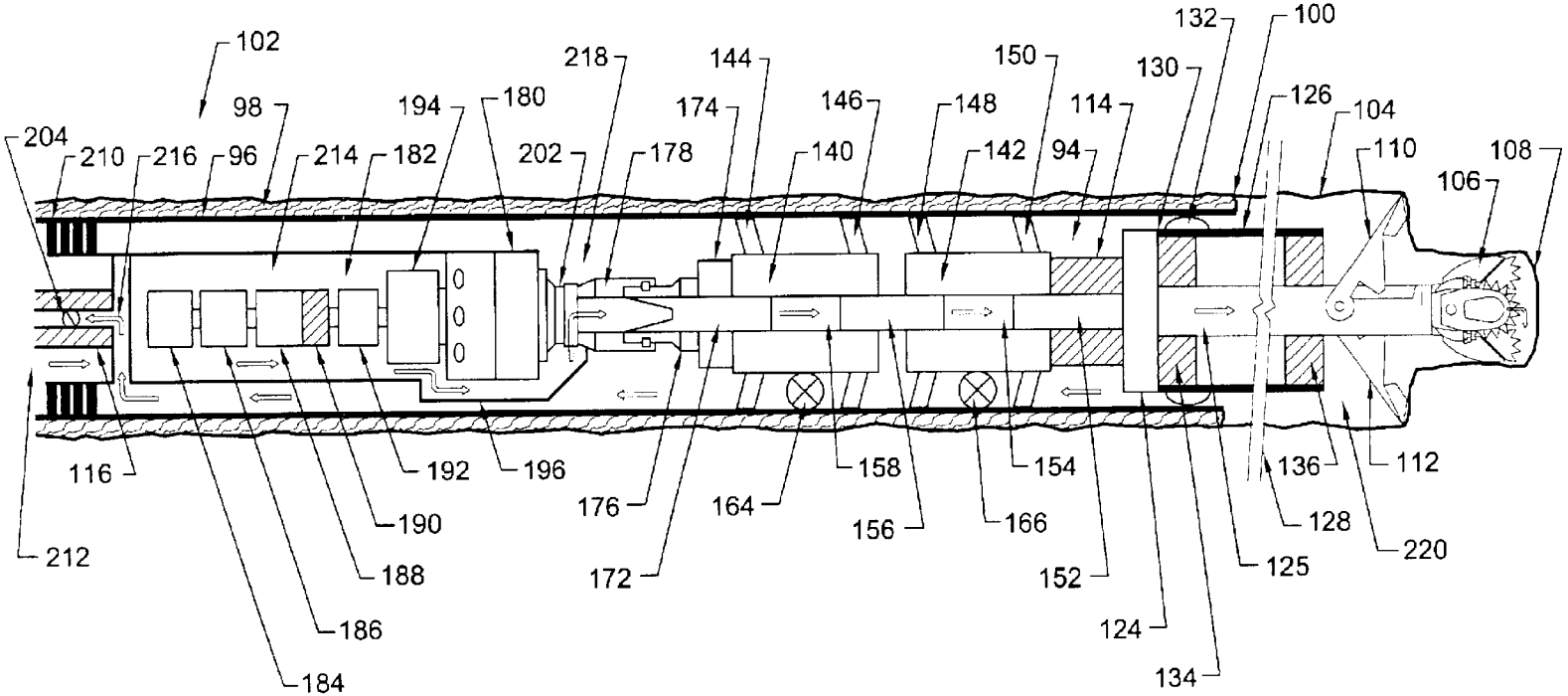
FIG. 6 generally shows the subterranean electric drilling machine that is disposed within a previously installed borehole casing during the process of drilling a new borehole and simultaneously installing a section of expandable casing.

FIG. 6 generally shows the subterranean electric drilling machine 94 that is disposed within a previously installed borehole casing 96 that is surrounded by existing downhole cement 98. The previously installed casing ends at location 100. The inside diameter of the previously installed casing is defined as "ID Casing", but this legend is not shown on FIG. 6 for simplicity. The outside diameter of the previously installed casing is defined as "OD Casing", but this legend is not shown on FIG. 6 for simplicity. The wall thickness of the previously installed casing is defined as "WT Casing", but this legend is not shown in FIG. 6 for simplicity. The previously installed casing is located within a geological formation 102.

As shown in FIG. 6, the subterranean electric drilling machine is in the process of drilling a new borehole 104 into the geological formation. Pilot bit 106 is shown drilling the pilot hole 108. The OD of the pilot bit is defined as "OD Pilot Bit", but that legend is not shown in FIG. 6 for brevity. The ID of the pilot hole is defined as "ID Pilot Hole", but that legend is not shown in FIG. 6 for brevity. Undercutters 110 and 112 expand the new borehole to full diameter. The OD of the undercutters 110 and 112 when in the fully extended position is defined as "OD Undercutters", but that legend is not shown in FIG. 6 for the purpose of brevity. The overall ID of the new borehole so drilled is defined to be "ID of New Hole", but that legend is not shown in FIG. 6 for the purposes of brevity. The pilot bit 106 and the undercutters 110 and 112 together form the entire "drill bit" of this assembly. This drill bit is an example of an "expandable drill bit", also called a "retrievable drill bit", that is also called a "retractable drill bit". The following references describe such drill bits: U.S. Patents: U.S. Pat. No. 3,552,508, C. C. Brown, entitled "Apparatus for Rotary Drilling of Wells Using Casing as the Drill Pipe", that issued on Jan. 5, 1971, an entire copy of which is incorporated herein by reference; U.S. Pat. No. 3,603,411, H. D. Link, entitled "Retractable Drill Bits", that issued on Sep. 7, 1971, an entire copy of which is incorporated herein by reference; U.S. Pat. No. 4,651,837, W. G. Mayfield, entitled "Downhole Retrievable Drill Bit", that issued on Mar. 24, 1987, an entire copy of which is incorporated herein by reference; U.S. Pat. No. 4,962,822, J. H. Pascale, entitled "Downhole Drill Bit and Bit Coupling", that issued on Oct. 16, 1990, an entire copy of which is incorporated herein by reference; and U.S. Pat. No. 5,197,553, R. E. Leturno, entitled "Drilling with Casing and Retrievable Drill Bit", that issued on Mar. 30, 1993, an entire copy of which is incorporated herein by reference. Some experts in the industry call this type of drilling technology to be "drilling with casing". For the purposes herein, the terms "retrievable drill bit", "retrievable drill bit means", "retractable drill bit" and "retractable drill bit means" may be used interchangeably. The combination of the pilot bit and retractable drill bit may also be replaced under certain circumstances with a bicenter drill bit. The retrievable drill bits and the bicenter bits are rotary drill bits.

When the undercutters 110 and 112 are retracted into their closed positions, then they can be pulled through the unexpaded casing, and then the entire subterranean electric drilling machine can removed from the previously installed casing because in their retracted positions, the OD of the undercutters is less than the ID of the expandable casing and the ID of the previously installed casing. However, when the undercutters are in their extended position as shown in FIG. 6, the subterranean electric drilling machine is used to drill the new borehole.

The downhole electric motor 114 of the subterranean drilling machine obtains its electrical energy from umbilical 116. The downhole electric motor 114 is a rotary motor. In one preferred embodiment, the umbilical is the lower end of the particular composite umbilical that is shown in FIG. 1. Various electrical wires and connectors along the length of the subterranean electric drilling machine conduct electrical power from the umbilical to the downhole electric motor (which are designated figuratively by element 118 which is not shown in FIG. 6 for the purposes of brevity). Downhole electric motor 114 also possesses internal sensors indicating the voltages between various inputs to the motor, the current drawn by various inputs to the motor, the power consumed by the motor, the temperature of the motor, the RPM of the motor, the torque delivered by the motor, etc. That information is digitized, sent thorough suitable electrical circuitry and connectors along the length of subterranean drilling machine (designated figuratively by element 120 which is not shown in FIG. 6 for brevity), which digital information is then sent uphole through the fiber optical cable 14 within the umbilical in the form of suitable light pulses. Commands from the surface are also send downhole through the same bidirectional communications path. Such commands including changing RPM of the motor, etc.

The downhole electric motor has an output shaft which is figuratively designated by element 122, which is not shown in FIG. 6 for brevity. Electric motor output shaft 122 proceeds through the swivel and seal unit 124 to turn rotary shaft 125 which in turn rotates the undercutters 110 and 112 and the pilot bit 106. Rotary shaft 125 is also called the "drilling work string" or simply the "drill pipe". In this preferred embodiment, the undercutters 110 and 112, and the pilot bit 106 comprise the "drill bit". Therefore, in this preferred embodiment, electrical energy provided by umbilical 116 to downhole electric motor 114 rotates the drill bit and bores the new borehole 104 into the geological formation.

In FIG. 6, expandable casing 126 generally surrounds rotary shaft 125. Expandable casing is described in various references in the above section entitled "Description of the Related Art". The initial OD of the expandable casing (before expansion) is defined to be "Initial OD of Expandable Casing", but that legend is not shown in FIG. 6 for brevity. The initial ID of the expandable casing (before expansion) is defined to be "Initial ID of Expandable Casing", but that legend is not shown in FIG. 6 for brevity. The initial wall thickness of the expandable casing (before expansion) is defined to be the "Initial WT of Expandable Casing", but that legend is not shown in FIG. 6 for brevity. The length of the expandable casing 126 is defined to be "Length of Expandable Casing", but that legend is not shown in FIG. 6 for brevity. The Length of the Expandable Casing can be quite long, and in one preferred embodiment can be at least several thousand feet long. In such a situation, the length of the rotary shaft 125 would be approximately the same length.

In FIG. 6, the length of the submersible electric drilling machine is defined to be "Length of Submersible Electric Drilling Machine", but that legend is not shown in FIG. 6 for brevity. The Length of the Expandable Casing can be much longer than the Length of Submersible Electric Drilling Machine. The broken lines 128 in FIG. 6 indicate that the Length of the Expandable Casing can be quite long compared to the Length of the Submersible Electric Drilling Machine. The various elements in FIG. 6 are not in proportion.

Figure 7:
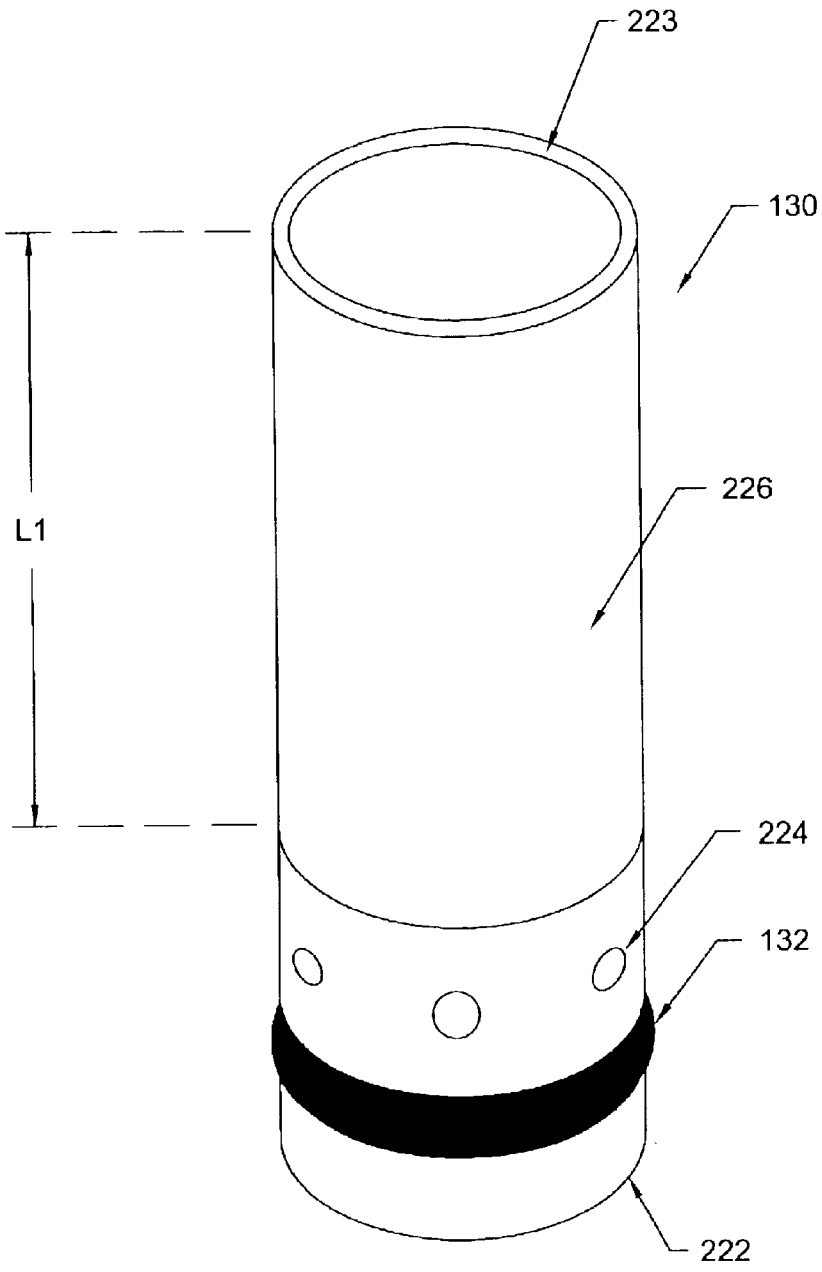
FIG. 7 shows the casing hanger.
Figure 10:
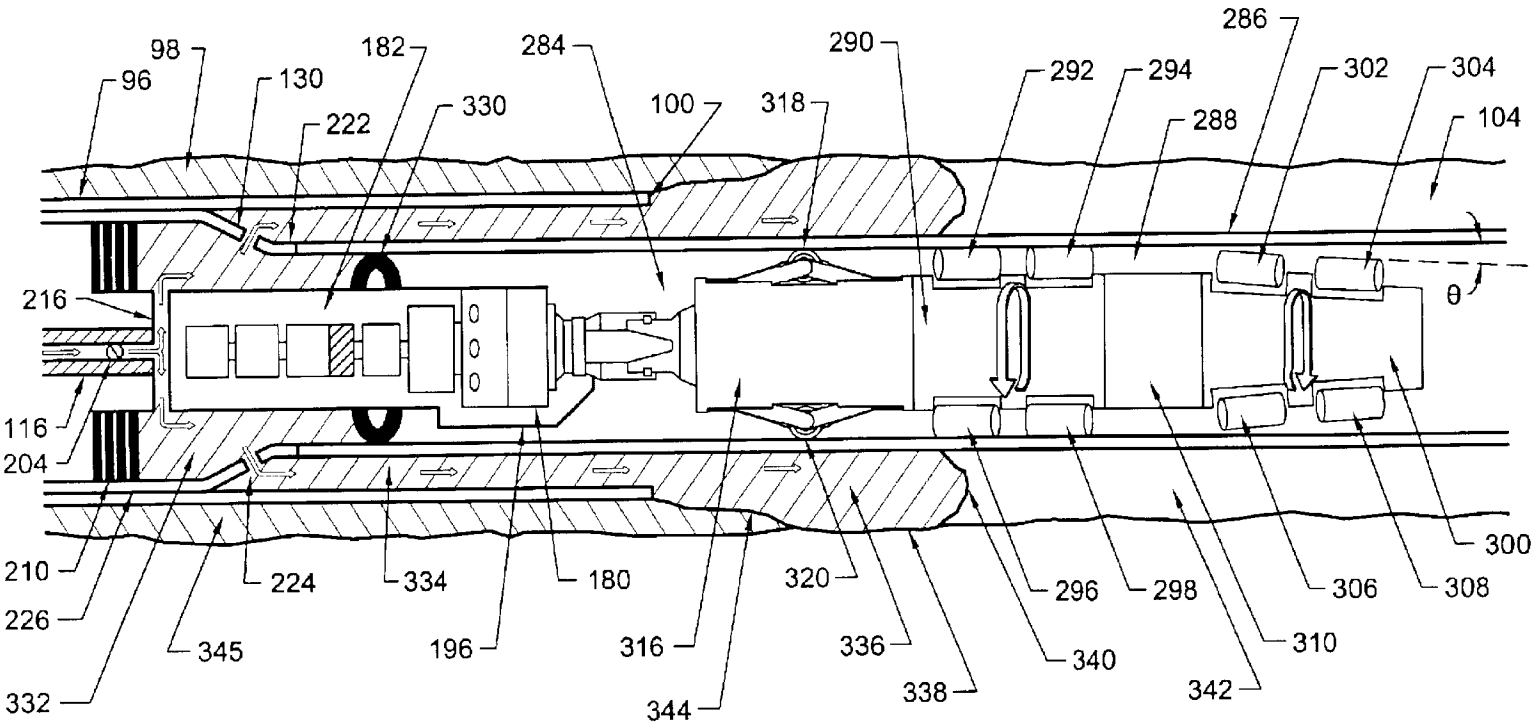
FIG. 10 shows a section view of the subterranean liner expansion tool positioned within an unexpanded casing that is injecting new cement into the new borehole.
Figure 12:
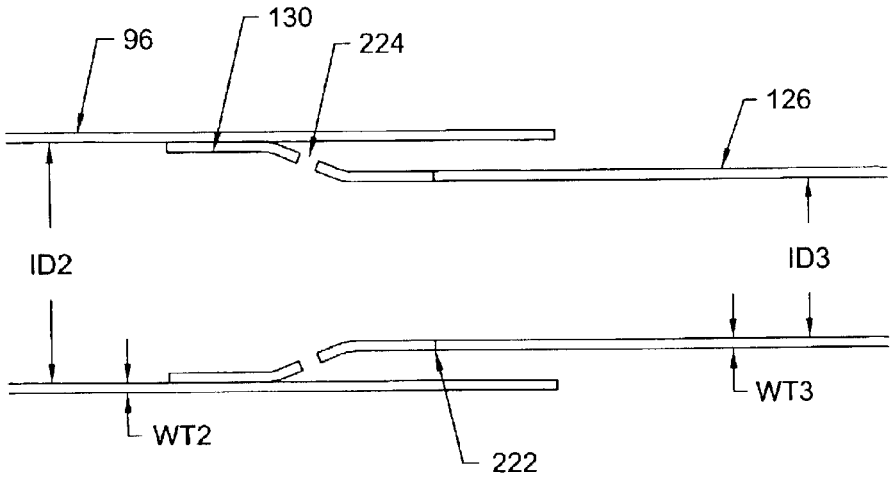
FIG. 12 shows the casing hanger after a portion of it has been expanded with the casing hanger setting tool inside the previously installed casing.

In FIG. 6, the expandable casing 126 is attached to the casing hanger 130. The casing hanger is shown in FIG. 7, and will be described in detail below. A portion of the casing hanger is surrounded by casing hanger seal 132. The casing hanger setting tool 134 is located within the casing hanger 130. When the new borehole 104 has been completed, the casing hanger setting tool 134 is used to expand the casing hanger so that it can make positive hydraulic and mechanical contact to the interior of the previously installed downhole casing that is adjacent to the casing hanger seal. FIG. 10 below shows the casing hanger after it has been expanded with the casing hanger setting tool, but that will be described in detail in relation to that FIG. 10. FIG. 12 below also shows the casing hanger after it has been expanded with the casing hanger setting tool, but that will be described in detail in relation to that FIG. 12.

Drilling operations typically require means to directionally drill, means to determine the location and direction of drilling, and means to perform measurements of geological formation properties during the drilling operations. Tool section 136 provides the rotary steering device for directional drilling and the LWD/MWD instrumentation packages. Here LWD means "Logging While Drilling" and "MWD" means "Measurement While Drilling". Typically, MWD instrumentation provides at least the location and direction of drilling. The LWD instrumentation provides typical geophysical measurements which include induction measurements, laterolog measurements, resistivity measurements, dielectric measurements, magnetic resonance imaging measurements, neutron measurements, gamma ray measurements; acoustic measurements, etc. This information may be used to determine the amount of oil and gas within a geological formation. Power for this instrumentation is obtained from the umbilical 116.

In FIG. 6, various electrical wires and connectors along the length of the subterranean electric drilling machine conduct electrical power from the umbilical to the rotary steering device and to the MWD/LWD instrumentation (which are designated figuratively by element 138 which are not shown in FIG. 6 for the purposes of brevity). The sensors on the direction steering device and the MWD and LWD instrumentation provide information that is digitized, sent thorough suitable electrical circuitry and connectors along the length of subterranean drilling machine (designated figuratively by element 139 which is not shown in FIG. 6 for brevity), which digital information is then sent uphole through the fiber optical cable 14 within the umbilical in the form of suitable light pulses. Commands from the surface are also send downhole through the same bidirectional communications path. For example, commands to change the direction of drilling may be sent downhole through this bidirectional communications path.

In FIG. 6, first anchor and weight on bit mechanism (AWOBM) 140 and second anchor and weight on bit mechanism (AWOBM) 142 selectively anchor the subterranean electric drilling machine and provide suitable weight on bit for drilling purposes. First AWOBM possesses anchor means 144 and 146. Second AWOBM possesses anchor means 148 and 150. This is an example of a tandem anchor system. In one preferred embodiment, the tandem anchor means 144, 146, 148 and 150 are comprised of inflatable packer-like elements.

In FIG. 6, first shaft 152 couples second AWOBM to the downhole electric motor 114. In one preferred embodiment, the first shaft 152 is of fixed length. In another preferred embodiment, first shaft 152 is an extensible shaft. Mud flow channel 154 is shown in FIG. 6 that will be more fully described later.

In FIG. 6, second shaft 156 couples the first AWOBM to the second AWOBM. Second shaft 156 is an extensible shaft. In one preferred embodiment, first AWOBM can move itself with respect to one end of the second shaft 156, and second AWOBM can also move itself with respect to the opposite end of shaft 156. In one embodiment, simple electric motor operated threaded screws and nuts suitably coupled to second shaft 156 are used to provide such motion. Those threaded screws, nuts, and electric motors are not shown in FIG. 6 for the propose of simplicity. For other examples of related mechanisms, please refer to the following references: (a) Roy Marker, et al., in the paper entitled "Anaconda: Joint Development Project Leads to Digitally Controlled Composite Coiled Tubing Drilling System", SPE 60750, presented at the SPE/ICoTA Coiled Tubing Roundtable, Houston, Tex., Apr. 5–6, 2000, and particularly in FIG. 8 entitled "Tractor-driven BHA", an entire copy of which is incorporated herein by reference; and (b) U.S. Pat. No. 5,794,703 that issued on Aug. 18, 1998 that is entitled "Wellbore Tractor and Method of Moving an Item Through a Wellbore", an entire copy of which is incorporated herein by reference.

First anchor and weight on bit mechanism (AWOBM) 140 and second anchor and weight on bit mechanism (AWOBM) 142 provide extension mechanisms with electric powered assemblies that are used to advance the casing and provide bit weight during drilling operations. These mechanisms also resist the drilling torque of the bit by anchoring the rotary motor. In a preferred embodiment, the anchor packers are inflated and deflated with motor driven progressing cavity pumps. Using dedicated PCPs simplifies controls and valves to operate the mechanism.

First anchor and weight on bit mechanism (AWOBM) 140 and second anchor and weight on bit mechanism (AWOBM) 142 are high strength anchor assemblies which provide axial load capacity at a relative slow axial advance rate. Should the suspended casing weight (in the vertical wellbore) during casing running procedures exceed the umbilical strength rating, then this mechanism may be used to lower the casing into the near horizontal wellbore.

In FIG. 6, various electrical wires and connectors along the length of the subterranean electric drilling machine conduct electrical power from the umbilical to the first anchor and weight on bit mechanism (AWOBM) 140 and to the second anchor and weight on bit mechanism (AWOBM) 142 (which are designated figuratively by element 160 which are not shown in FIG. 6 for the purposes of brevity). The first anchor and weight on bit mechanism (AWOBM) 140 and second anchor and weight on bit mechanism (AWOBM) 142 have many sensors including force sensors, torque sensors, position sensors, speed sensors, etc. Information from these sensors are sent thorough suitable electrical circuitry and connectors along the length of subterranean drilling machine (designated figuratively by element 162 which is not shown in FIG. 6 for brevity), which digital information is then sent uphole through the fiber optical cable 14 within the umbilical in the form of suitable light pulses. Commands from the surface can also be sent downhole through this bidirectional communications path. For example, detailed commands can be sent to change the locations of first AWOBM 140 and second AWOBM 142 or to change the effective load placed on the drilling bit by these mechanisms.

In FIG. 6, first mud cuttings and bypass port (MCBP) 164 allows mud and drill cuttings to pass by the first AWOBM 140. Second mud cutting and bypass port (MCBP) 166 allows mud and drill cutting to pass by the second AWOBM 142. These are electrically operated ports. Various electrical wires and connectors along the length of the subterranean electric drilling machine conduct electrical power from the umbilical to the first MCBP and to the second MCBP (which are designated figuratively by element 168 which are not shown in FIG. 6 for the purposes of brevity). The first MCBP and to the second MCBP have many sensors providing temperature, pressure, etc. The information from these sensors are sent through suitable electrical circuitry and connectors along the length of subterranean drilling machine (designated figuratively by element 170 which is not shown in FIG. 6 for brevity), which digital information is then sent uphole through the fiber optical cable 14 within the umbilical in the form of suitable light pulses. Commands from the surface can also be sent downhole through this bidirectional communications path. For example, detailed commands can be sent to close first MCBP and to the second MCBP to prevent a well blow-out.

In FIG. 6, mud carrying shaft 172 is attached to the first AWOBM by housing 174. The female side of universal mud and electrical connector 176 is attached to the male side of universal mud and electrical connector 178. Progressing cavity pump 180 is driven by a downhole pump motor assembly generally designated by element 182. A progressing cavity pump is abbreviated as a "PCP". Progressing cavity pump 180 also includes an integral flexible shaft as is typical in the industry. In one preferred embodiment, the downhole pump motor assembly generally designated by element 182 is comprised of protector 184; first 80 horsepower electric motor 186 requiring 1250 volts at 45 amps that runs at the nominal RPM of 1700 RPM; second 80 horsepower electric motor 188 requiring 1250 volts at 45 amps that also runs at the nominal RPM of 1700 RPM; universal motor base 190; gearbox protector 192; and gearbox 194 having a 4:1 reduction. The downhole pump motor assembly and a portion of the progressing cavity pump 180 is covered by shroud 196.

Various electrical wires and connectors along the length of the subterranean electric drilling machine conduct electrical power from the umbilical to the downhole pump motor assembly (which are designated figuratively by element 198 which are not shown in FIG. 6 for the purposes of brevity). The subterranean electric drilling machine has has many sensors including voltage sensors, current sensors, torque sensors, temperature sensors, RPM sensors, etc. The information from these sensors are sent thorough suitable electrical circuitry and connectors along the length of subterranean drilling machine (designated figuratively by element 200 which is not shown in FIG. 6 for brevity), which digital information is then sent uphole through the fiber optical cable 14 within the umbilical in the form of suitable light pulses. Commands from the surface can also be sent downhole through this bidirectional communications path. For example, detailed commands can be sent to change the the RPM of first electric motor 186 and second electric motor 188.

FIG. 6 also shows three-way valve 202. This three-way valve is used to change the direction of mud flow inside the subterranean electric drilling machine. The functions of the three way 202 valve will be described below.

FIG. 6 also shows umbilical mud valve 204. This mud valve is used to shut off mud flow, or otherwise prevent well blow-outs. The mud valve 204 has a total of three positions: (a) open, namely it allows mud to flow through as shown in FIG. 6; (b) stop (not allow any mud to flow straight through); and (c) vent to the annulus between the umbilical 116 and the ID of the previously installed casing 212 so that cement or cuttings can be cleaned from within the umbilical (which state is not shown in FIG. 6 for simplicity).

Various electrical wires and connectors along the length of the subterranean electric drilling machine conduct electrical power from the umbilical to three-way valve 202 and to the umbilical mud valve 204 (which are designated figuratively by element 206 which are not shown in FIG. 6 for the purposes of brevity). The three-way valve 202 and the umbilical mud valve 204 possess many sensors including pressure sensors, voltage sensors, current sensors, and temperature sensors, etc. The information from these sensors are sent thorough suitable electrical circuitry and connectors along the length of subterranean drilling machine (designated figuratively by element 208 which is not shown in FIG. 6 for brevity), which digital information is then sent uphole through the fiber optical cable 14 within the umbilical in the form of suitable light pulses. Commands from the surface can also be sent downhole through this bidirectional communications path. For example, detailed commands can be sent to change set the three-way valve 202 into any position, or to close, or open, umbilical valve 204.

In addition, Smart Shuttle™ seal 210 is shown in FIG. 6. Smart Shuttle seal 210 is attached to a portion of shroud 180. For the purposes of succinct reference within this disclosure, the above entire list of Provisional Patent Applications, the U.S. Patents that have issued, the Pending U.S. Patent Applications that appear under the title of "Cross-References to Related Applications", the foreign pending Patent Applications under "Related PCT Applications", and the above U.S. Disclosure Documents under of "Related U.S. Disclosure Documents", all having William Banning Vail III as at least one of the inventors, is owned by the firm Smart Drilling and Completion, Inc. ("SDCI"), and therefore this intellectual property is defined herein to be the "SDCI Intellectual Property" or simply "SDCI IP" as an abbreviation. Smart Drilling and Completion, Inc. may be reached at 3123-198th Place S.E., Bothell, Wash. 98012, having the telephone number of (425) 486-8789, that has the website of www.Smart-Drilling-and-Completion.com. The Smart Shuttle is extensively described in the above defined "SDCI IP". The principal of operation of the Smart Shuttle is also described below in relation to FIG. 24. The shroud 196 extends to the left in FIG. 6 so that the Smart Shuttle™ seal 210 is installed on a portion of that shroud.

In a preferred embodiment shown in FIG. 6. A reverse mud circulation system has been configured with the umbilical in the wellbore. Fresh mud travels from the surface down the annuli between the well casing and the umbilical designated by element 212. The right-hand side of FIG. 6 is "down" in FIG. 6. Fresh mud travels down from the surface as indicated by various arrows throughout the subterranean drilling machine. Clean mud then flows through the interior of the shroud 214 to the three-way valve 202. In one preferred embodiment, the three-way valve directs mud into the input of the progressing cavity pump so that the pump boosts the pressure of the mud delivered to the drill bit. This is called "Position A" of the three-way mud valve. The detailed tubing and other hardware necessary to accomplish the details of "Position A" is not shown in FIG. 6 for the purpose of simplicity. In "Position A", clean mud then flows through the interior of the male side of universal mud and electrical connector 178; then through the female side of universal mud and electrical connector 176; then through mud carrying shaft 172; then through mud flow channel 158; then through the interior of second shaft 156; then through mud flow channel 154; then through the interior of first shaft 152; then through the swivel and seal unit 124; then through rotary shaft 125; and then through the mud channels in pilot bit 108.

In FIG. 6, cuttings laden mud then returns to the surface through the following path. The cuttings laden mud flows up between the outside diameter of the expandable casing 126 and the inside diameter of the new borehole 104; then through the second mud cutting and bypass port (MCBP) 166; then through the first mud cuttings and bypass port (MCBP) 164; then through the volume between the exterior of the shroud 196 and the ID of the previously installed borehole casing 96; then through cross-over system 216; and then into umbilical 116 and through the umbilical mud valve 204 and then to the surface of the earth through the remainder of the umbilical disposed in the wellbore.

Cuttings laden mud returns to the surface flowing through the ID of the umbilical. The purpose is to keep the wellbore clean. The subterranean electric drilling machine 94 may be recovered to the surface while cuttings and mud fill the umbilical. Time to circulate the umbilical clean is not needed prior to tripping out of the hole.

In the preferred embodiment illustrated in FIG. 6, the clean mud is provided a booster pressure to improve bit hydraulics. If a bit is selected that produces fine cuttings, the PCP mud pump is compatible with pumping the cuttings filled mud. In an alternative design, the benefit for pumping the cuttings is a reduction in backpressure held on the geological formation.

In FIG. 6, there are two other positions of the three way-valve 202, "Position B", and "Position C". In "Position B" of the three-way valve, the PCP pump 180 is not used to boost the mud pressure delivered through the mud channels of the pilot bit 108. Here, clean mud flows through the interior of the shroud 214 to the three-way valve 202, and then directly into the male side of universal mud and electrical connector 178 and through the remaining portions of the subterranean electric drilling machine to the mud channels of the pilot bit 108. The detailed configuration of pipes and other related hardware to accomplish this mode of operation is not shown in FIG. 6 for the purpose of brevity.

In FIG. 6, Position C of the three-way valve 202 allows the entire subterranean drilling machine to move within the previously installed borehole casing 96. The fluid filled region defined between the subterranean drilling machine and the interior of the previously installed borehole casing is designated by element 218 in FIG. 6. As previously stated, the fluid filled region defined between the inside of the previously installed casing and the outside diameter of the umbilical, which is the annuli between the well casing and the umbilical, is designated by element 212. In "Position C" of the three-way valve 202, fluids are pumped from the region 218 into region 212. If there is a good seal between the exterior of the umbilical and the borehole at the surface produced by the stripper heads and surface blow-out preventers (BOP's), then the existence of the Smart Shuttle™ seal 210 causes the subterranean drilling machine to go down into the well. Reversing the PCP, causes the subterranean electric drilling machine to reverse direction. For a more detailed description of the operation of a Smart Shuttle, please refer to the above defined "SDCI IP", entire copies of which are incorporated herein by reference. "Position C" of the three-way valve 202 provides an important function to rapidly trip the subterranean electric drilling machine to the surface and back should any drilling component need maintenance or replacement. This capability provides operational flexibility for the system. Based upon existing designs with currently available downhole electric motors and progressing cavity pumps, practical speeds of 10 feet per second can be anticipated while pulling a load of at least 4,000 lbs.

In FIG. 6, the fluid filled region between the casing hanger seal 132 and the pilot bit 106 is designated by element 220. During drilling operations, the mud pressure in region 212 is defined to be P1; the mud pressure in the interior of the shroud defined by element 214 is P2; the mud pressure at the input to the three-way valve 202 is P3; the mud pressure within the male side of universal mud and electrical connector 178 is P4; the mud pressure inside the mud channels of the pilot bit 108 is P5; the pressure within region 220 is P5; the pressure within region 218 is P6; and the pressure within the umbilical 116 is P6.

The subterranean electric drilling machine in FIG. 6 provides other benefits. Since the anchor points secure the drilling machine in the well's casing and mudflow paths must pass through valves within the machine, the entire unit serves the function of a downhole packer with safety valve and serves as a BOP located downhole, or Downhole BOP™. The BOP is comprised of first mud cuttings and bypass port (MCBP) 164, second mud cutting and bypass port (MCBP) 166, and the umbilical mud valve 204 provide the required functions of a BOP located downhole.

It is also worthwhile to make a few more comments about the downhole electric motor 114. This electric motor rotates the drilling bit. This electric motor may possess a gearbox to match the bit's speed requirements. Monitoring the motor's power, RPM, torque, current drawn, voltage drawn etc., provides significant information about the condition of the bit and its drilling performance. As one particular example, the electric motor is chosen to be a REDA 4 pole, 80 horsepower, electric motor requiring 1250 volts at 45 amps that runs at the nominal RPM of 1700 RPM that is 5.4 inches OD and 31.5 inches long. The RPM of this motor may be conveniently varied by varying the frequency of the voltage applied to it as is indicated by FIG. 2 and the related description. In one preferred embodiment, the RPM of the electric motor in the subterranean electric drilling machine is varied between about 900 RPM to 2,500 RPM. In this one preferred embodiment, the particular REDA motor does not need a gearbox for this application. In another preferred embodiment, two such REDA motors are operated in series that provide a net downhole motor capable of providing 160 horsepower to a rotating drill bit at the rotation speed between 900 RPM and 2,500 RPM. The RPM and other parameters of the downhole motor are controlled by computer system 26 in FIG. 5. Another preferred embodiment uses the electric motor described in U.S. Disclosure Document No. 498,720 filed on Aug. 17, 2001 that is entitled in part "Electric Motor Powered Rock Drill Bit Having Inner and Outer Counter-Rotating Cutters and Having Expandable/Retractable Outer Cutters to Drill Boreholes into Geological Formations", an entire copy of which is incorporated herein by reference.

The drilling fluid transitions from a nonrotating element which is first shaft 152, into a rotating pipe that is rotary shaft 125. The swivel and seal unit 124 prevents fluid leaks in this area. Unlike a swivel-packing gland, this seal operates at a relative low differential pressure. Suitable rotating seal assemblies are commercially available for these conditions. Electric power and communications from the fixed (non-rotating) components to the rotating assembly is required. An inductive connection or a slip-ring assembly will provide the power, communication and control linkage through the swivel and seal unit 124 to the fiber optic communication system and the power available through the umbilical. However, the details for either the inductive connection or slip-ring assembly are not shown in FIG. 6 in the interests of simplicity.

FIG. 6 as described above drills the borehole with the long section of expandable casing 126 carried into the new hole 104 as the new hole is drilled. However, in an alternative preferred embodiment, a short section of expandable pipe 126 is used to drill the borehole, then the subterranean electric drilling machine is retrieved from the wellbore, and then that machine conveys into the well the long section of expandable casing 126 to be cemented and expanded into place within the new borehole 104.

FIG. 6 as described, uses the pilot bit 106 and the two undercutters 110 and 112 as the "drill bit" to drill the new borehole 104. However, a bicenter bit as is used in the industry could also be used as the "drill bit" in FIG. 6, provided it had suitable dimensions to be withdrawn through the ID of the unexpanded state of the expandable casing 126, and through the interior of the previously installed borehole casing 96.

In relation to FIG. 1, wires A, B, and C comprise the first independent three phase delta circuit. Wires D, E, and F comprise the second independent three phase delta circuit. Each separate circuit is capable of providing 160 horsepower (119 kilowatts) over an umbilical length of 20 miles. In relation to FIG. 6, and in one preferred embodiment, the first independent three phase delta circuit provides up to 160 horsepower to the downhole electric motor 114. In relation to FIG. 6, and in one preferred embodiment, the second independent three phase delta circuit provides up to 160 horsepower to the downhole pump motor assembly 182 in FIG. 6. In one preferred embodiment, each first and second circuit are independently controlled. So, combined, the umbilical shown in FIG. 1 can deliver a total of 320 horsepower (238 kilowatts) at 20 miles to do work at that distance.

FIG. 7 shows the casing hanger 130. The casing hanger was identified with element 130 in FIG. 6. A portion of the casing hanger is surrounded by casing hanger seal 132. The casing hanger seal was also previously identified with element 132 in FIG. 6.

The expandable casing 126 shown in FIG. 6 is attached to the casing hanger 130. In one embodiment, the casing hanger is attached to the expandable casing by a threaded joint. In this embodiment, that threaded joint appears at end of casing hanger 222, although the threads on the casing hanger are not shown in FIG. 7 for simplicity. The opposite end of the casing hanger is shown as element 223. In another preferred embodiment, the casing hanger can be manufactured integral with the expandable casing. A cement flowby port 224 is used during the cementing process as further explained in relation to FIG. 10. The expandable hanger contact area is generally designated as element 226 in FIG. 7. The length of the expandable hanger contact area is designated by the legend L1 in FIG. 7.

Figure 8:
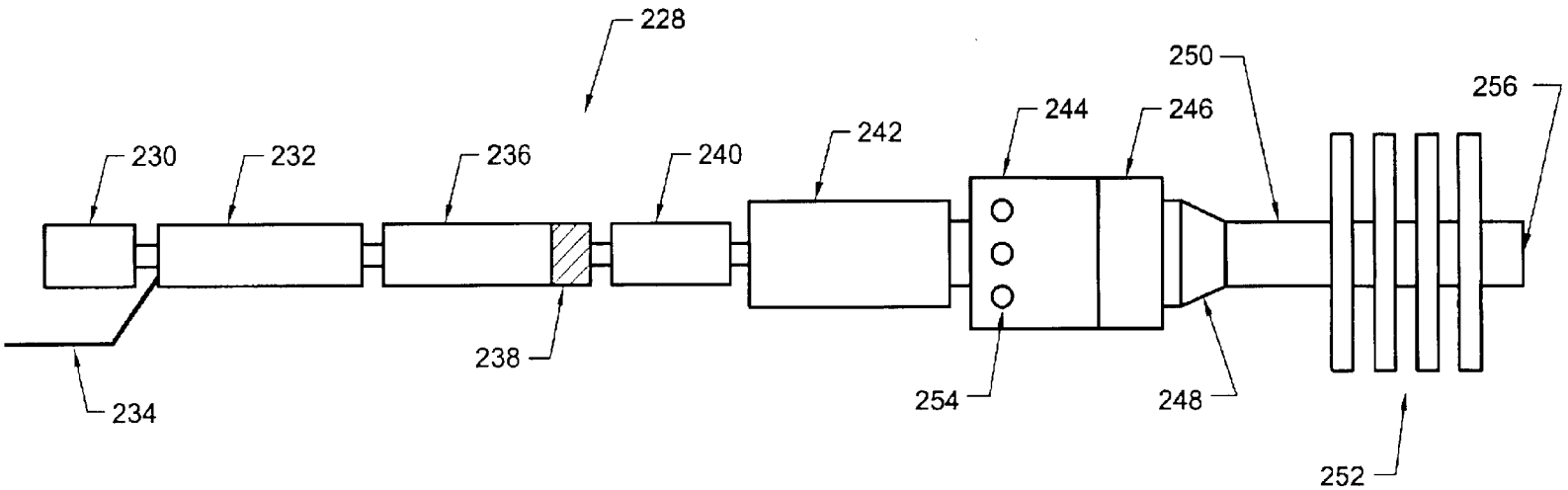
FIG. 8 shows detail for a downhole pump motor assembly that is related to the downhole pump motor assembly in FIG. 6.

FIG. 8 shows more detail for the downhole pump motor assembly that is related to element 182 in FIG. 6. Elements 180, 184, 186, 188, 190, 192 and 194 were previously identified in FIG. 6. Those same elements are related to the elements appearing in the following.

FIG. 8 generally shows a downhole pump motor assembly identified as element 228 which is configured as a Smart Shuttle™. In one preferred embodiment, various parts from REDA are used to make a downhole pump motor assembly 182. REDA may be located as defined above. In the embodiment, element 230 is a REDA protector for a bottom drive motor that is 5.4 inches OD, and 4.5 feet long. In this embodiment, element 232 is a first REDA 4 pole, 80 horsepower, electric motor requiring 1250 volts at 45 amps that runs at the nominal RPM of 1700 RPM that is 5.4 inches OD and 31.5 inches long. Element 234 is a power cable providing electrical power to the downhole pump motor assembly 228. In this embodiment, element 236 is a second REDA 4 pole, 80 horsepower, electric motor requiring 1250 volts at 45 amps that runs at the nominal RPM of 1700 RPM that is 5.4 inches OD and 31.5 inches long. Element 238 is a REDA universal motor base part number UMB-B1 for a bottom drive motor that is 5.4 inches OD and 1.7 feet long. Element 240 is REDA gearbox protector part number BSBSB having 4 mechanical seals that is 5.4 inches OD and 10.6 feet long. Element 242 is a REDA gearbox having a 4:1 gear reduction that is 6.8 inches OD and 10.9 feet long. Element 244 is a Netzsch flexible shaft that is 7.87 inches OD and 10 feet long. Netzsch Oilfield Products is located at 119 Pickering Way, Exton, Pa. 19341, having the telephone number of (610) 363-8010, that has the website of www.netzchusa.com. Element 248 is a Netzsch progressing cavity pump part number NM090*3L (EX) that is 7.87 inches OD and 11.8 feet long. Element 248 is a crossover. Element 250 is 4 inch tubing. Element 252 is a Smart Shuttle seal. Element 254 is an intake port into the Netzsch progressing cavity pump. Element 256 is the discharge outlet from the Netzsch progressing cavity pump.

The downhole pump motor assembly identified as element 228 needs a cablehead, centralizers, bypass valves, sensors, and intelligent controls to make one embodiment of a Smart Shuttle™. Such a Smart Shuttle will have a minimum pulling force of 4400 lbs, a maximum transit speed of 11 feet per second, that operates within 9 ⅝ inch O.D., 53.5 lb/foot casing. It has variable speed, is reversible, and has high speed bidirctional communications with instrumentation on the surface of the earth.

Figure 9:
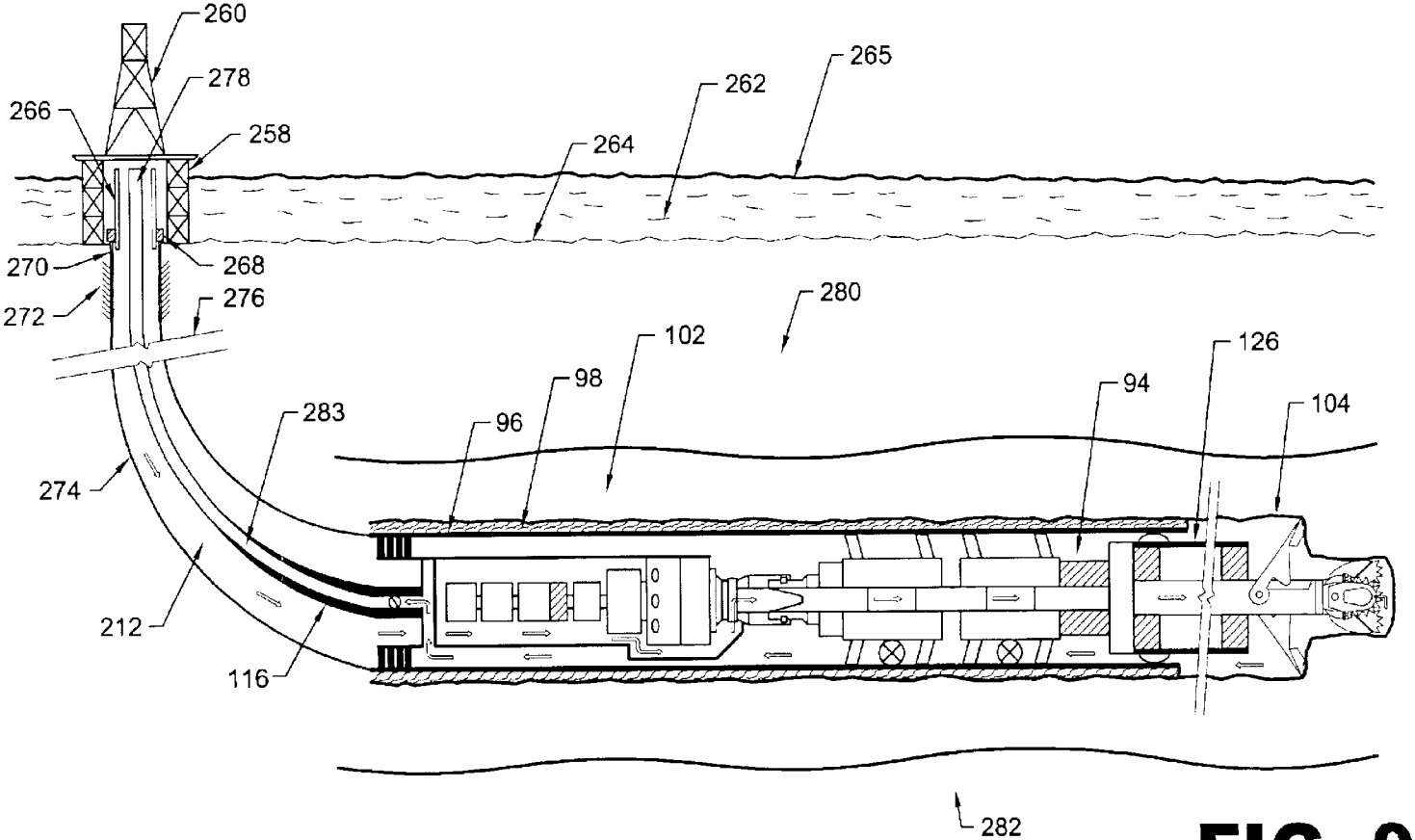
FIG. 9 shows a subterranean electric drilling machine boring a new borehole from an offshore platform.

FIG. 9 shows a subterranean electric drilling machine boring a new borehole from an offshore platform. FIG. 9 shows the subterranean electric drilling machine 94 deployed within a previously installed borehole casing 96 that is surrounded by existing downhole cement 98 that is in the process of drilling the new borehole 104 into geological formation 102, which elements were previously defined in relation to FIG. 6. Also shown in FIG. 9 is the expandable casing 126 that was also defined in FIG. 6. The subterranean electric drilling machine was thoroughly described in FIG. 6.

In FIG. 9, an offshore platform 258 has a hoisting mechanism 260 that is surrounded by ocean 262 that is attached to the bottom of the ocean 264. The ocean surface is shown by element 265. Riser 266 is attached to blow-out preventer 268. Surface casing 270 is cemented into place with cement 272. A section of previously installed casing 274 extends from the lower portion of the surface casing 270 to the previously installed borehole casing 96. The broken line 276 shows that the section of previously installed casing 274 can be many thousands of feet long. Previously installed casing 274 may actually be comprised of different lengths of casings having different inside diameters, outside diameters, and weights, but that detail is not shown in FIG. 9 in the interest of simplicity. Other conductor pipes, surface casings, intermediate casings, liner strings, or other pipes may be present, but they are not shown for simplicity. The upper portion of the umbilical 278 proceeds to the stripper heads and surface blow-out preventers (BOP's), then proceeds to location 70 in FIG. 5, and is then wound up on the umbilical carousel 64 in FIG. 5. In this preferred embodiment, the computerized uphole management system for the umbilical as shown FIG. 5 is mounted on the offshore platform. In FIG. 9, other geological formations represented by element 280 are located above geological formation 102. Other geological formations represented by element 282 are below geological formation 102.

In FIG. 9, the directions of the arrows show the mud flow. Fresh mud travels from the surface down the annuli between the well casing and the umbilical designated by element 212. Element 212 was previously defined in FIG. 6. Cuttings laden mud returns to the offshore platform 258 on the interior of the umbilical 283. The arrows show the mud flow pattern in the vicinity of the subterranean electric drilling machine 94. This mud flow system is called a "reverse mud flow system". This reverse mud flow system will keep the cuttings within the umbilical, therefore preventing any debris from accumulating in the annuli between the well casing and the umbilical that might prevent the subterranean electric drilling machine from returning to the offshore platform. In other preferred embodiments, the mud flow can be opposite—namely, clean mud flows down the interior of the umbilical, and cuttings laden mud flows up the annuli between the well casing and the umbilical.

For the purposes of this invention, the phrase "offshore platform" includes the following: (a) bottom anchored structures that include artificial islands, gravity based structures, piled truss structures (conventional platforms), and compliant towers; (b) mobile-bottom sitting structures that include submersible structures including submersible barges (in swampy and shallow water areas), mobile gravity base structures (like the concrete islands in the Arctic) and jackup platforms; (c) floating-permanently moored structures including the tension leg platforms (TLP), the SPAR and Semisubmersible, and the floating production, storage, and offloading structures (FPSO); and (d) floating-mobile structures such as shipshape-like drilling rigs, semisubmersibles that are catenary moored, and barges.

It is helpful to review how FIGS. 6, 7, 8, and 9 relate to the drilling process. As was shown in FIG. 6, the expandable casing 126 in its un-expanded state is carried into the hole as an outer sheath over rotary shaft 125 and associated components, which may also be called a "drilling work string". At the lower end of that borehole assembly ("BHA") is anchored into the casing. In one preferred embodiment, the string of expandable casing is 3,000 ft long.

Starting with the drilling machine out of the hole, the expandable casing is run in and suspended in the wellbore from the surface. The top of the casing has an expandable casing hanger installed. FIG. 7 shows the expandable casing hanger. Next, the bottom hole assembly is run through the casing and secured into the bottom joint of the unexpanded suspended casing. The casing hanger setting tool 134 is secured into the casing hanger 130 together with the first and second anchor and weight on bit mechanisms 140 and 142, the downhole electric motor 114, and the remaining portions of the subterranean electric drilling machine 94. The entire subterranean electric drilling machine and expandable casing is then tripped to the bottom of the well. Drilling the next section of the well continues until sufficient hole for the expandable casing has been drilled. With the expandable casing in place, the casing hanger setting tool expands and locks the unexpanded length of expandable casing in the hole. The subterranean electric drilling machine 94 then releases from the casing and is recovered from the well.

In one preferred embodiment, the casing hanger setting tool 134 is a packer-like assembly located beneath the downhole electric motor 114. The casing hanger setting tool initially expands with sufficient pressure to secure the casing to the non-rotating housing that is connected to the swivel and seal unit 124 that centralizes the casing. Once the new hole has been drilled, and the casing hanger 130 is in proper setting position, much higher pressure is pumped into the casing hanger setting tool to plastically expand the hanger and cold forge the hanger into the previously installed borehole casing 96. As an example of this process, various manufacturers connect pipeline repair tools to pipeline ends and connect wellheads to the top of casing strings with this type of "cold forge" process. The cement flowby ports of the casing hanger are left open for circulation of cement behind the casing. When the expandable casing is later expanded, these holes are sealed through contact with overlap in the previous casing string. The casing hanger seal and cement help ensure a leak tight seal.

In one preferred embodiment of the invention, the subterranean electric drilling machine is used to accomplish the many purposes including the following: (a) drill the new borehole 104; (b) convey into the well the expandable casing 126; and (c) then using the casing hanger setting tool 134, the casing hanger is expanded into the previously installed borehole casing 96. Thereafter, the subterranean electric drilling machine releases from the casing hanger, thereby leaving the casing hanger and the expandable casing 126 in its unexpanded state in the well, and the subterranean electric drilling machine is then removed from the well.

Thereafter, another tool called a subterranean liner expansion tool is conveyed into the wellbore. In one preferred embodiment, the subterranean liner expansion tool is labeled with element 284 in FIG. 10. FIG. 10 shows the previously installed borehole casing 96, the existing downhole cement 98, the new borehole 104, a portion the casing hanger 130 after the above expansion steps have been performed in (c) above, one end 222 of the casing hanger shown in FIG. 7, and the other end 223 of the casing hanger shown in that figure. Cement flowby port 224 is also shown.

Figure 11:
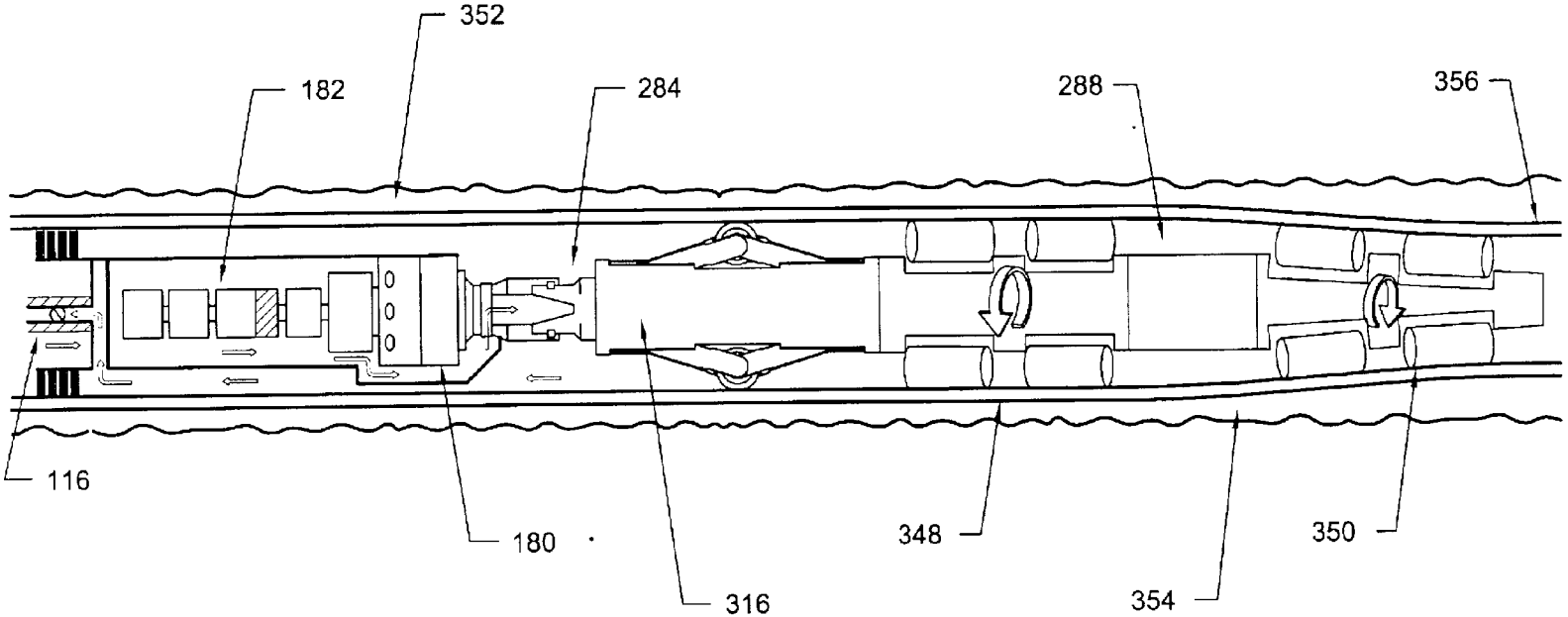
FIG. 11 shows the subterranean liner expansion tool in the process of expanding the expandable casing within the new borehole before the new cement sets up.

The subterranean liner expansion tool 284 is used in a two step process. First, the cement is injected behind the unexpanded expandable casing. That process is shown in FIG. 10. Second, the expandable casing is expanded. That process is shown in FIG. 11. Thereafter, the subterranean liner expansion tool is removed from the well, and the well is either completed, or the well is further extended using the methods and apparatus described above.

In FIG. 10, the subterranean liner expansion tool 284 is positioned within unexpanded casing 286. Counter-rotating roller casing expander tool is generally shown as numeral 288 in FIG. 10. In one preferred embodiment, clockwise rotating roller assembly 290 is on the uphole side of the counter-rotating roller casing expander tool. It has individual rollers 292, 294, 296, and 298. In this embodiment, counter-clockwise rotating roller assembly 300 is on the downhole side counter-rotating roller casing expander tool. It has individual rollers 302, 304, 306 and 308. Electrically powered hydraulic systems within the counter-rotating roller casing expander tool are capable of loading the individual rollers against the interior of the expandable casing. In one preferred embodiment, several of the rollers, such as roller 304, are canted through the angel θ. In one preferred embodiment, the rollers are hydraulically loaded and are canted to advance through the expandable casing as the rotating roller assembles 290 and 300 rotate in their respective directions. Electrically powered systems within the counter-rotating roller casing expander tool are then capable of rotating the appropriate elements of each rotating roller assembly. In FIG. 10, the rollers are in their fully retracted position. The electric motor and related hydraulics for the counter-rotating roller casing expander tool are located within housing 310. That electric motor is labeled with legend 312, and the related hydraulics is labeled with legend 314, although those are not shown in FIG. 10 for simplicity.

The torque resistance section 316 is a component of the counter-rotating roller casing expander. It has longitudinal rollers 318 and 320. An electric motor 322 and associated hydraulics 324 are located within torque resistance section 316 to properly actuate the longitudinal rollers 318 and 320. However, elements 322 and 324 are not shown in FIG. 10 for the purposes of simplicity. The purpose of the torques resistance section 316 is to prevent any unbalanced torque resulting from the operation of the subterranean liner expansion tool that might cause the remainder of the downhole tool attached to the umbilical 116 to twist, thereby possibly breaking the umbilical. Breaking the umbilical downhole would be a catastrophic failure, although the tool can be retrieved using techniques to be described below.

Various electrical wires and connectors along the length of the subterranean liner expansion tool conduct electrical power from the umbilical 116 to the counter-rotating roller casing expander tool 288 (which are designated figuratively by element 326 which are not shown in FIG. 6 for the purposes of brevity). Sensors within the counter-rotating roller casing expander tool provide measurements such as the force delivered by the rollers to the casing, the position of the rollers, etc., which measurements are suitably is digitized and sent thorough suitable electrical circuitry and connectors along the length of subterranean liner expansion tool (designated figuratively by element 328 which is not shown in FIG. 10 for brevity), which digital information is then sent uphole through the fiber optical cable 14 within the umbilical 116 in the form of suitable light pulses. Commands from the surface are also send downhole through the same bidirectional communications path. For example, commands to change the contact of the rollers, or expand the rollers outward to expand the casing may be sent downhole through this bidirectional communications path.

FIG. 10 further shows progressing cavity pump 180 that is driven by a downhole pump motor assembly 182 and shroud 180, which were previously described in FIG. 6. Inflatable cement seal 330 is inflated during cementing operations.

In the preferred embodiment shown in FIG. 10, cement from the surface proceeds through umbilical 116; through umbilical mud valve 204 (which is used for both mud and cementing purposes); to the cross-over system 216 and into region 332; through the cement flowby port 224; through region 334 between the previously installed borehole casing 96 and the exterior of the unexpanded casing 286; then into region 336 between the exterior of the unexpanded casing and the ID of the new borehole that labeled with element 338. The mud valve 204 has a total of three positions: (a) open, namely it allows cement to flow through as shown in FIG. 10; (b) stop (not allow any cement to flow straight through); and (c) vent to the annulus between the umbilical 116 and the ID of the previously installed casing so that cement can be cleaned from within the umbilical (which state is not shown in FIG. 10 for simplicity). The region between the umbilical 116 and the ID of the previously installed casing is shown a element 212 in FIG. 6, although that particular element is not shown in FIG. 10 for simplicity (because of the large number of labeled elements in that vicinity of FIG. 10).

In FIG. 10, the position of the "front" of the cement flow is shown by element 340. Sufficient cement is introduced into region 336 so that when the unexpanded casing 286 is expanded in the next step (as explained below), then the well is properly cemented in place. Various sensors within the subterranean liner expansion tool provide data that allows the computer system 26 on the offshore platform in this embodiment to determine the proper amount of cement to be sent downhole that at least partially fills region 342 that is located between the exterior of the unexpanded casing 286 and OD of the new borehole 338 which is not filled with cement in FIG. 10. The overlapping region between the old cement and the new cement that has not set up in FIG. 10 is shown as element 344. The new cement is now allowed to set up as shown in FIG. 10. However, there is old cement that is hardened in FIG. 10 such as the old cement behind the casing hanger 130 that is identified with numeral 345.

The subterranean liner expansion tool 284 is comprised of a number of components including the counter-rotating roller casing expander tool 284 and the Smart Shuttle™. The subterranean liner expansion tool is transported downhole by the Smart Shuttle™ which is comprised of components including the Smart Shuttle™ seal 210, the progressing cavity pump 180, the downhole pump motor assembly 182, and the shroud 180 which have been previously described in relation to FIG. 6. The Smart Shuttle also returns the subterranean liner expansion tool to the offshore platform in this preferred embodiment.

In a preferred embodiment of the invention shown in FIG. 10, the unexpended casing 286 is 3,000 feet long, has a weight of approximately 40 lbs/foot, and has an unexpanded OD of approximately 8.0 inches OD. In a preferred embodiment shown in FIG. 10, the previously installed borehole casing 96 is a 9 ⅝ inch OD casing having a weight of approximately 40 lbs/foot.

FIG. 11 shows the subterranean liner expansion tool 284. Portions of the subterranean liner expansion tool are shown in FIG. 11 including the counter-rotating roller casing expander tool 288, the torque resistance section 316, and the progressing cavity pump 180 that is attached to the downhole pump motor assembly 182.

After cementing was completed in FIG. 10, the subterranean liner expansion tool is pulled up vertically above the casing hanger 130. Then the rollers of the the clockwise rotating roller assembly 290 the counter-clockwise rotating roller assembly 300 are placed in their extended positions. Then counter-rotating roller casing expander tool 288 is suitably energized, and it begins to expand the expandable casing on its downward travel (to the right-hand side of FIG. 11) within the well. FIG. 11 shows the subterranean liner expansion tool in a location in the formation that is beyond the end of the previously installed casing 100 that is defined in FIG. 10.

In FIG. 11, the expandable casing in its fully expandable form is shown at location 348. In FIG. 11, the expandable casing in its unexpanded form is shown at location 350. Cement surrounding the expandable casing in its fully expandable form is shown as element 352 in FIG. 11. Cement surrounding the expandable casing in its unexpanded form is shown as element 354 in FIG. 11. The counter-rotating roller casing expander tool 288 remains suitable energized, and it eventually completes the expansion of the expandable casing at some extreme distance in the well designed by element 356 in FIG. 11. Thereafter, the liner expansion tool 284 is removed from the wellbore. Thereafter, the cement is allowed to cure. After the cement is cured, the well is completed to produce oil and gas using techniques and procedures typically used in the oil and gas industry or using those methods and apparatus described in the "SDCI IP", entire copies of which are incorporated herein by reference.

In FIG. 11, the expandable casing in its fully expandable form as shown at location 348 can also be called equivalently a "liner" because of its attachment to the previously installed casing 96 in FIG. 10. Hence, the name "subterranean liner expansion tool".

FIG. 12 shows the casing hanger 130, a cement flowby port 224, the previously installed borehole casing 96, and expandable casing 126 in its unexpanded form that is attached to the casing hanger at casing hanger end 222. These elements have been previously defined in FIG. 6 and in FIG. 7. FIG. 12 shows the casing hanger after a portion of it has been expanded with the casing hanger setting tool. The state of the casing hanger 130 in FIG. 12 is similar to that shown in FIG. 10. The inside diameter of the previously installed borehole casing 96 is shown in FIG. 12 by the legend ID2. The wall thickness of the previously installed borehole casing is identified by the legend WT2. The inside diameter of the expandable casing 126 in its unexpanded form is identified by the legend ID3. The wall thickness of the previously installed borehole casing is identified by the legend WT3. This is the configuration before the passage of the subterranean liner expansion tool.

Figure 13:
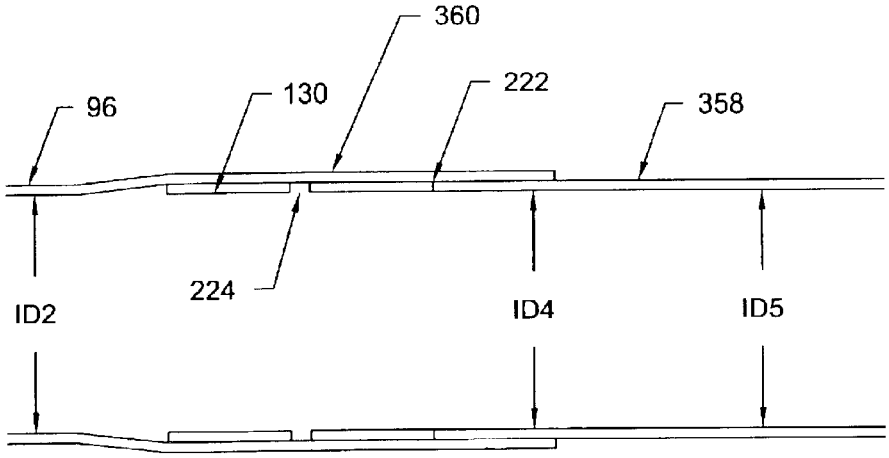
FIG. 13 shows a section view of the monobore well, or near-monobore well, after passage of the subterranean liner expansion tool.

FIG. 13 provides a section view of the configuration of components shown in FIG. 12 after the passage by the subterranean liner expansion tool. Various elements on FIG. 13 have been previously described. In addition, element 358 shows the expandable casing in its expanded state after the passage of the subterranean liner expansion tool. Various inside diameters are defined by legends ID2, ID4, and ID5. In general, ID2 will equal ID4 that will equal ID5. If this is the case, this is a true monobore well. However, there are limitations to the power of the subterranean liner expansion tool. So, if old hard cement is set up behind the overlapping portions of the previously installed casing in the location identified by element 360, the subterranean liner expansion tool may not have sufficient power to crush old hard cement and rock behind that particular location. Such a location is identified by element 345 in FIG. 10. In such event, ID4 would be less than ID2 by as much as 2 times the dimension of WT2 in FIG. 12. This extra thickness may persist for the length of the casing hanger L1 as shown in FIG. 7. Therefore, the installation described in FIG. 13 will provide either a monobore well, or a near-monobore well.

In the following, there are different topics of interest related to the above described preferred embodiment. Subsection titles will be used for the purposes of clarity.

FIG. 14 shows relevant parameters related to fluid flow rates through the umbilical. Umbilical fluid flow rates are sufficient to support drilling as shown in FIG. 9. One preferred embodiment uses a 4.5 inch ID pipe providing 173 gallons per minute (GPM) at a pressure of 1000 pounds per square inch (PSI) pressure loss over a 20 mile offset. Here, the "Pressure Loss" is 1000 PSI. Here, the "Flow Rate" is 173 gallons per minute. This was calculated using a Bingham Plastic mudflow model with 12 lb/gallon mud at a velocity of 3.5 feet per second (fps). This is a "Flow Velocity" of 3.5 feet per second. The umbilical geometry of 4.5 inches ID and 6.0 inches OD may be optimized under different situations as required. However, these particular dimensions are selected for a reverse flow mud system inside a 8.5 inch ID cased hole having a 20-mile offset. The Bingham Plastic mudflow model is described in detail in Section 8.2 entitled "Mathematical and Physical Models" of the book entitled "Petroleum Well Construction" by Michael J. Economides, Larry T. Watters, and Shari Dunn-Norman, John Wiley & Sons, New York, N.Y., 1998, an entire copy of which is incorporated herein by reference. An entire copy of the book referenced in the previous sentence is also incorporated herein by reference. In particular, please refer to Table 8-2 on page 222 of the book for detailed algebraic equations related to the Bingham Plastic Model.

Tripping into the Well

There are various constraints on how rapidly the subterranean electric drilling machine can enter the wellbore. Since the vertically suspended casing string and the subterranean electric drilling machine weight may be greater than can be safely run with the umbilical, the first anchor and weight on bit mechanism (AWOBM) 140 and second anchor and weight on bit mechanism (AWOBM) 142 as shown in FIG. 6 provide an anchor mechanism that acts as a "downhole hoist" to "walk" the casing vertically downhole and eventually into any horizontal section of the well. This "downhole hoist" is also called herein an "anchor mechanism" when used for this particular purpose. The subterranean electric drilling machine and its related anchor mechanism can be fielded from within a lubricator as is standard practice in the industry to maintain well pressure control. Once the downhole weight is within the capacity of the umbilical, use of the anchor mechanism is stopped and the casing load is transferred to the umbilical. The anchor means 144 and 146 and anchor means 148 and 150 as shown in FIG. 6 of the anchor mechanism are then collapsed for rapid transit to the bottom of the well. Further downhole travel of the casing and the subterranean electric drilling machine is accomplished by pumping mud into the annulus space between the well's installed casing and the umbilical. Pressure acting upon this annular piston area generates sufficient force to rapidly move the equipment downhole at about 2 fps in the 15 to 20 mile offset range. A 225,000 lb load with a 0.2 coefficient of friction requires approximately 1,600 psi differential pressure across Smart Shuttle seals (see element 210 in FIG. 6). This pressure capability is obtained with multiple seals load-sharing the pressure. Motion cannot be accomplished without moving mud from below the drilling machine out of the well up through the umbilical ID. The pressure in the casing below the drilling machine (a sealed volume due to cementing) is approximately 3500 psi above static. The downhole mud pump may be used to assist in moving this required mudflow through the umbilical ID. For trip velocities in the range of 2 feet per second the surface mud pumps will need to provide 350 gallons per minute at 4600 pounds per square inch. At shorter distances with less pressure losses, the equipment may move faster (if surface mud pump volume capacity is available).

Figure 15:
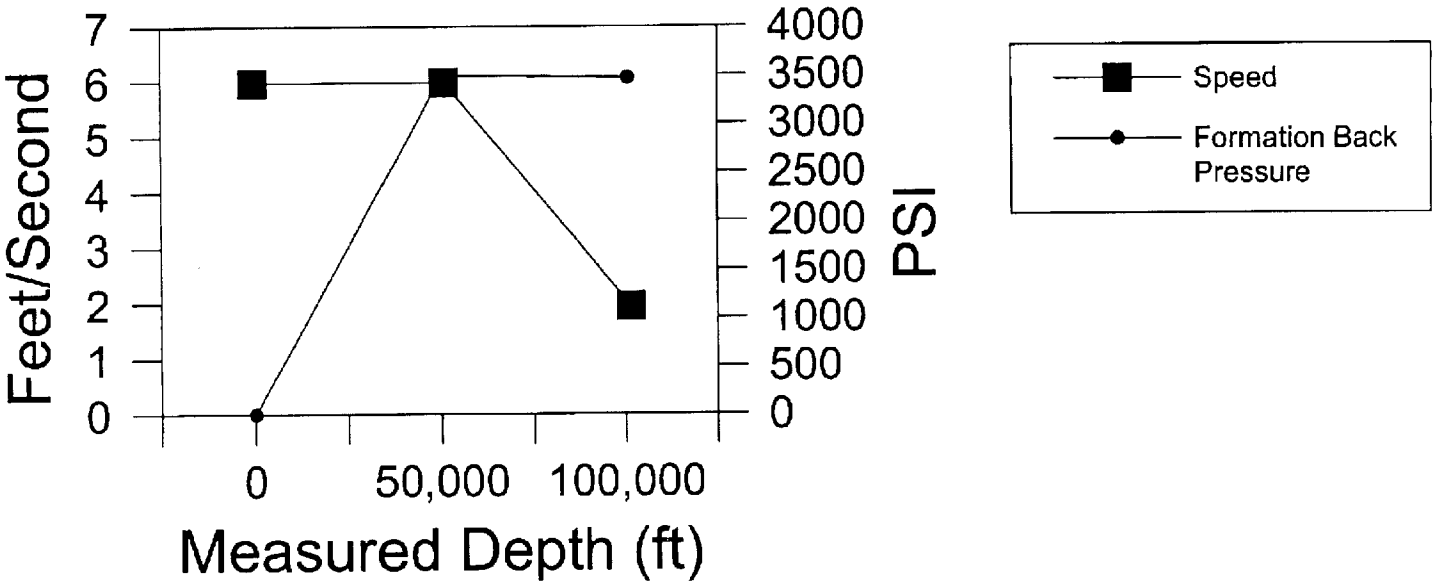
FIG. 15 shows various parameters related to tripping the subterranean electric drilling machine and the expandable casing into the well.

FIG. 15 shows various parameters related to tripping the subterranean electric drilling machine and the expandable casing into the well. A 20 mile well is on the order of 100,000 feet. At this distance, and at 2 feet per second, the formation back pressure is 1000 PSI.

Tripping Out of the Well

The subterranean electric drilling machine 94 is tripped from the well with cuttings filled mud within the umbilical.

Sufficient mudflow is pumped down the annulus between the umbilical and the uphole casing to fill the entire cased wellbore below the drilling machine. The maximum pressure the pump will provide this annulus is 5000 psi and at a 20 mile offset, the volume is limited to approximately 440 gallons per minute or a drilling machine trip speed of approximately 2.4 fps. Simultaneously, the surface linear umbilical traction unit pulls at approximately 12,500 lbs (to overcome the fluid flow drag upon the umbilical, the frictional umbilical drag and the frictional drag of the subterranean electric drilling machine and its seals).

As the subterranean electric drilling machine moves up the wellbore and the annular fluid pressure losses become less, the maximum mud pump pressure no longer limits the trip speed. The limiting factor then becomes the mud volumes, which the mud pumps may provide. For these tripping purposes, a third surface mud pump may be used in another preferred embodiment. It will support higher speed trips and provide redundancies during other operations.

Since all of the mud volumes pass through the downhole mud pump, an accurate metering of the mud volume and pressures is obtained throughout the trip. This keeps pressure off the open formation during trips out of the wellbore.

Surface Mud System

A large volume of working mud is needed to manage the umbilical volume while tripping in the hole. For 20-mile offset operations, an active mud tank volume of 3500 barrels may be required. This is similar in capacity to those used in some large offshore drilling rigs.

In one preferred embodiment, the installed casing is 8.5 inches ID, and the umbilical is a 6 inch OD umbilical with a 4.5 inch ID. During drilling operations, the maximum mud flow rate is 150 gallons per minute with a pressure drop of 825 pounds per square inch, which includes frictional losses only. During tripping out of the hole at 2.4 feet per second, the maximum mud flow rate is 422 gallons per minute with a pressure drop of 4,750 pounds per square inch. During running in the hole with casing at 2 feet per second, the maximum mud flow rate is 350 gallons per minute, with a pressure drop of 3600 pounds per square inch (with cement sealed on the bottom of the well).

Thus, for the tripping out of the well, a minimum of two 750 hp surface mud pumps would be required. One pump is adequate for routine drilling operations. When the subterranean electric drilling machine is at a distance of 20 miles, approximately 14 hours are required to run into the hole, 12 hours are required to come out of the hole, and 11 hours are required for cuttings to circulate from the bottom of the hole to the surface. Therefore, accurate monitoring and management of mudflow and quality into and out of the well and umbilical both at the surface and downhole at the drilling machine is important for reliable well control.

The Drilling Operation

When the subterranean drilling rig reaches the bottom of the hole, the high-speed bit may encounter cement within the bore of the cased hole. The anchor means 144, 146, 148 and 150 as shown in FIG. 6 are engaged, mud circulation started and the bit is rotated. Notice that downhole sensors monitor mudflow composition parameters to minimize circulation time for conditioning the hole. Weight on bit is applied and drilling moves forward out of the previously cased hole. Traditional steering mechanisms and MWD tools are used to guide forward progress of the bit through the formation. Directly behind this BHA is the unexpanded casing.

The mudflow rates and the cutting solids this flow rate can transport out of the hole will limit drilling progress. For example, a drilled 12 ½ inch ID hole and a 4 ½ inch ID umbilical having an internal mud velocity of 3 feet per second carrying 6.5% solids will have a maximum penetration rate of 90 ft/hr.

Significant information will be monitored and communicated real time to the surface for control of the operations. Some of the information includes:

(a) weight on bit
(b) Penetration rate
(c) Bit RPM
(d) Bit power (determined from power consumed by the downhole electric motor 114 of the subterranean drilling machine)
(e) Mud flow rate through bit (by monitoring throughput of the progressing cavity pump 180)
(f) Differential mud pressures across bit and to surface across umbilical
(g) Mud quality sensors for entrained gas, cuttings loading, etc.
(h) Mud temperatures
(i) Basic operating parameters of the various subterranean electric drilling machine functions that include voltage, power, RPM, pressure, temperature, axial load in umbilical at the pump, etc. are all monitored in real time to verify equipment status.

This monitoring will provide for efficient control of the downhole drilling operation. If additional information is required, in one preferred embodiment additional instrumentation or tools may be included in the umbilical at the various connection points (approximately every 5 miles). In one preferred embodiment, it is preferable to have remotely operated downhole BOP's. These devices are packer-like assemblies, which when inflated, anchor to the inside of the casing. An internal valve provides a well fluid isolation point.

This extensive monitoring capability allows drilling operations to use under-balanced fluids, if beneficial to the well program. This equipment capability also allows for direct well control and production testing through the drilling machine.

When the well has drilled forward to the casing point, pressuring the setting tool included in the subterranean electric drilling machine sets the expandable casing hanger. The success of the hanger setting operation may be load tested with the downhole hoist (which when used in this application is also called a "weight on bit mechanism"). Upon verification of a successful operation, the subterranean electric drilling machine releases from the casing and starts its trip from the well. This will leave the well ready for casing cementing and casing expansion.

During all operations in a wellbore, the umbilical is maintained under tension between the downhole tools and the surface equipment. This permits rapid transit in the wellbore by preventing buckling. A constraint is that a minimum number of gentle bends should be included in the wellbore design. This constraint is similar to familiar drill pipe and coiled tubing operational constraints in current well operations. Selected means to provide such tension are shown in FIG. 5. The tension is monitored with computer system 26 in FIG. 5.

Several contingency operations are reviewed to illustrate the capabilities of the subterranean electric drilling system.

The subterranean electric drilling machine can control the well and can control a well "kick", or well kicks. In one preferred embodiment, the well uses a reverse circulation system. The first mud cuttings and bypass port (MCBP) 164 and the second mud cutting and bypass port 166 in of the subterranean electric drilling machine act as a packer within the well directing all returns to the umbilical. The umbilical has sufficient pressure rating to contain any kick and allow it to be circulated from the well. Instrumentation monitoring mud conditions downhole should provide early indication of developing well control problems.

The subterranean electric drilling machine can survive n open hole collapse. The well is drilled with unexpanded casing over the drilling work string (that is element 125 in FIG. 6). Should the formation collapse on the casing, the subterranean electric drilling machine is withdrawn through the unexpanded casing. The casing may subsequently be expanded and drilling operations resumed.

The subterranean electric drilling machine can survive a downhole blackout of power. Assume the failure is in the power transmission or control system during a tripping operation. The umbilical and surface traction winch have sufficient power to pull the dead equipment from the wellbore. Surface pumps would continue to provide mud for displacement replacement. With care, mud pressure below the subterranean electric drilling machine may be used to reduce the load required to pull the machine from the well.

If the failure occurs when the drilling machine is anchored and making hole, then a release between the downhole mud pump and the anchor means of the drilling machine is actuated. That disconnect occurs between the female side of universal mud and electrical connector 176 and the male side of universal mud and electrical connector 178 as shown in FIG. 6. In one preferred embodiment, the release may be triggered with an "over-pull" or operation may be via pumping a dart or ball down the umbilical. Once the release is actuated, the drilling machine controls, and mud pump assembly may be pulled "dead" from the well. Once the fault is isolated and repaired, the recovered equipment is run back into the well where it connects with the drilling equipment left in the hole. The Smart Shuttle portion of the subterranean electric drilling makes this reconnection. Regaining control of the equipment allows either drilling operations to proceed or for the equipment to be recovered from the well.

The Well Construction Process

Drilling and casing operations in the preferred embodiment is a two-trip process. The drilling equipment defined above (the subterranean electric drilling machine) is used to drill the hole, position and anchor the casing (but not expand it) within the hole. The casing is left in position ready for cementing operations (if required) and casing expansion to its final installed dimension is accomplished with the use of a second tool system (the subterranean liner expansion tool).

In this preferred embodiment, the new expandable casing is 3,000 feet long, 54 lbs/ft, and has an unexpanded OD of 8.0 inches OD. The downhole casing hanger and the casing string are then suspended from the surface rig floor. The bottom hole assembly (BHA) is then made up and run into the casing string. In one preferred embodiment, the centralizing casing hanger setting tool is used to lock the casing and drilling equipment together. Next the rotary motor and the anchor mechanism are added to the assembly together with the downhole mud pump that may be used as a Smart Shuttle.

This described equipment is all long and heavy. It is handled as major assemblies with quick connection devices between each assembly. The estimated size and weight of various components appear below in the following.

The bit is about 2 feet long, and weighs 500 lbs in air. The MWD tools are 40 feet long and weigh about 1,200 lbs in air. The rotary steering tool is about 30 feet long, and weighs 1,500 lbs in air. The rotary shaft (element 125 in FIG. 6) also called the "drilling work string" or simply "drill pipe", is about 3,000 feet long and weighs 28,500 lbs in air. The expandable casing has a weight of 54 lbs/ft, is about 3,000 feet long, and weighs 162,000 lbs in air. The rotary section and anchor section of the subterranean electric drilling machine (that includes elements 114, 140 and 142 in FIG. 6) is about 120 feet long and weights 2,800 lbs. The downhole mud pump section of the subterranean electric drilling machine (including elements 180, 196, and 214 in FIG. 6) is about 122 feet long and weighs about 3,900 lbs in air. Any separate control module associated with the subterranean electric drilling machine is about 20 feet long and has a weight of 4,000 lbs. So, the total length of the assembly is about 3,334 feet long that weighs about 200,800 lbs in air.

Cementing and Expanding the Casing

In this preferred embodiment of the invention, subterranean liner expansion tool 284 in FIG. 10 installs the cement and expands the monobore casing in the well. This approach was selected to simplify the subterranean electric drilling machine and to provide operational flexibility when performing these monobore well construction operations.

The subterranean liner expansion tool has two basic functions. The first is to cement the casing in the well (if required). In one embodiment, this is accomplished through a 2 inch cementing line in a 3 ½ inch OD umbilical. Unlike the subterranean electric drilling machine when attached to casing, the Smart Shuttle at speeds up to 10 feet per second pulls this umbilical into the well. The Smart Shuttle operation of the liner expansion tool requires that the inflatable cement seal 330 is collapsed, and then fluids are pumped from the downhole side of the Smart Shuttle™ seal 210 to the uphole side of that seal as has been previously described. To cement the well, inflatable cement seal 330 is inflated. This cement seal is also called a straddle seal (with one side being inflatable) on the tool's outside diameter that ensures the fluid connection between the umbilical and the cement ports in the casing hanger. Once the tool is in place, cement is circulated into the annulus space behind the unexpanded casing. Adequate instrumentation monitors cement placement, volume and Smart Shuttle location and reports all of these monitored parameters to the surface.

The second function of the subterranean liner expansion tool is to expand the casing to its final operating size. The roller mechanisms for this task have already been described in relation to FIG. 10. Rollers provide power, control and reversibility. If the casing were expanded with internal pressure, it would lack any expansion control—for example, if the hole diameter were irregular, then the casing expansion would be irregular as well. Expansion dies have the problem of being a one shot, one size expansion process. Internal casing rollers have experience in buckled casing repair tools and in anchoring casing inside Unibore wellheads. Weatherford has developed a one step expansion tool for expanding casing that is featured on their website. Weatherford International, Inc. may be reached at 515 Post Oak Blvd, Suite 600, Houston, Tex. 77027, having the telephone number of (713) 693-4000, that has the website of www.weatherford.com. In FIG. 10, the counter-rotating roller casing expander tool 288 has contra-rotating rollers to minimize the tool's torque that has to be externally reacted while expanding the casing. The longitudinal rollers 318 and 320 in FIG. 10 provide for this torque reaction. As previously described, a downhole motor powered with a separate electrical circuit from the surface provides the necessary rotary power.

In a preferred embodiment, the surface equipment is similar in arrangement to the drilling machine system. However, this equipment may be smaller as the umbilical OD may be chosen to be 3 ½ inches OD.

As described earlier, in one mode of operation of the, subterranean electric drilling machine, it acts like a Smart Shuttle. The Smart Shuttle will be used to pump the umbilical and the subterranean liner expansion tool to the downhole worksite. The Smart Shuttle works by pumping fluid from one side of the seals to the other with an electric powered progressive cavity pump (PCP) (or any positive displacement pump). At relative low differential pressures, large axial forces ( approximately 4,000 lbs net) are generated that are sufficient to pull the tool and umbilical into the hole. Top-hole speeds are the maximum design speed of 10 fps. At extreme offsets, the speed will be slower (2.5 feet per second) due to fluid drag force on the umbilical, which will be proportional to the transit speed.

The Smart Shuttle system is equipped with sensors to detect location and to easily position the tools straddle seals across the casing hanger of the last casing string. Once in position, the inflatable seal is inflated and circulation through the hole-casing annulus is confirmed. This may be accomplished by pumping from the surface or by using the Smart Shuttle pump to circulate the area. Cement will be spotted into the annulus and the casing will be expanded prior to the cement hardening.

FIG. 10 illustrates the subterranean liner expansion tool with cement being injected from the surface through the umbilical. Approximately 69 gallons per minute will flow at 100,000 ft with a pressure loss of about 9,000 pounds per square inch. Thus, the cementing pump will have to deliver at 10,000 pounds per square inch at these rates. It will require 240 minutes for the cement to be delivered at 100,000 ft from the surface and then another 77 minutes to spot approximately 126 barrels of cement into the hole-casing annulus space. When operating at these large offsets, managing the setting time of the cement and the required volume of cement is important.

Tracers may be added to the fluid pads before and following the cement as it is pumped into the umbilical. Sensors located on the subterranean electric drilling machine will verify when the cement is passing these downhole sensor locations. This will help accurately spot cement into the well. Once the cement is out of the umbilical, a bypass valve is opened and mud is circulated through the annulus to clear the umbilical.

Some casing may not require to be cemented into the hole. It may be possible that the casing can be expanded into the wall of the hole with sufficient pressure that the residual contact stress between the rock and expanded casing are sufficient to form an axial fluid seal. This avoids the cementing step and simplifies operations. However, it places a significant load upon the casing expansion rollers.

Once the cement is in position within the hole-casing annulus, the inflatable cement seal 330 is deflated and the Smart Shuttle pulls the expansion tool back into the previously cased wellbore. The counter-rotating roller casing expander tool is energized, and its roller engage the casing ID by expanding until contact with the casing is established. Rotation of the rollers is begun and the tool slowly moves forward. Forward motion is provided by the slight canted angle of the rollers, which screw the expander into the casing hanger and pipe. This canted angle is shown as the angle θ in FIG. 10. In one preferred embodiment, the counter-rotating roller casing expander tool has sufficient strength to expand the casing hanger and the previously set casing back into the formation to provide a smooth casing ID. This process is illustrated in FIGS. 12 and 13. FIG. 12 shows the casing hanger area prior to tool's passage and FIG. 13 illustrates this same region after the tool has passed. The subterranean liner expansion tool has to have sufficient strength to expand the two casing strings back into the formation rocks.

The subterranean liner expansion tool continues expanding the casing to the bottom of the string. The process of expanding the casing will reposition the cement that is in the annuli. It will be extruded along the reducing annuli until the cement reaches the end of the casing where excess will flow into the uncased hole below the expansion machine. Once the casing has been fully expanded, the rollers of the subterranean liner expansion tool are collapsed to their small transport size and the Smart Shuttle and surface traction winch are used to bring the tool to the surface. This leaves the hole ready for the next drilling cycle.

Drilling and monobore casing operations continue until the well reaches the target reservoir. It is then possible to drill lateral drainholes (using a similar process) or a single large bore completion may be made.

There are various methods to handle contingencies with the subterranean liner expansion tool. Similar to the subterranean electric drilling machine, considerable flexibility exists in the cementing and expansion tool concepts to handle most contingencies. A few of these contingencies illustrate this capability.

Suppose the power to the subterranean liner expansion tool is cut off during a tip into the well. A bypass valve around the Smart Shuttle pump will open and allow the tool to be pulled from the wellbore using the surface linear winch and the strength of the umbilical. Alternatively, in some wells, it may be possible to pump mud down the cement line in the umbilical and apply pressure below the Smart Shuttle to assist in its retrieval.

Suppose there is a loss of power with cement in the umbilical. Then, a downhole bypass valve will open connecting the umbilical bore with the cased well annulus. Mud pumps may then be used to flow the cement to the surface.

Suppose the subterranean liner expansion tool fails without expanding the entire casing string. The tool is then recovered and the cement in the well annulus is assumed to harden. The next drilling operation will be to mill out of the wellbore and sidetrack to resume drilling to target.

Suppose the expansion strength of the subterranean liner expansion tool is not sufficient to expand the casing hanger to a full bore ID. The subterranean liner expansion tool has the capability of operating at various diameters. It will expand the casing to gage diameter where ever possible. Some areas, (like the casing hanger area) may not achieve gage—especially if the formation is exceptionally hard/strong. The under gage diameter is not desirable, but not a significant problem as all of the tool systems should pass through this reduced diameter. Should it not be possible to achieve the minimum gage diameter, then a mill may be used to increase inside diameter as a last resort.

Casing Flotation Techniques

Casing flotation techniques may be used to dramatically reduce the well annuli pressure required to pump casing into the well or reduce the required downhole hoist capacity. Air or nitrogen may be enclosed within the casing at the surface to reduce its apparent weight in mud during running operations. Once on bottom, the near buoyant casing would be flooded and filled with mud so that operations as previously described would continue. This and other related weight saving concepts have the potential to reduce the well annuli running pressure or downhole hoist capacity by 90% as compared to the loads identified above in the section entitled "The Well Construction Process". This capability allows much longer and/or heavier strings of casing to be optionally run.

Casing flotation techniques will not have an impact upon the umbilical's design criteria. The umbilical's internal working pressure defines its required axial strength. A 10,000 psi internal pressure for well control requires an umbilical axial load strength of approximately 160,000 lbs to resist the surface pressure effects.

Alternative Embodiments of Drilling Systems

In FIG. 6, first anchor and weight on bit mechanism (AWOBM) 140 and second anchor and weight on bit mechanism (AWOBM) 142 are an example of "anchors" or "anchor means". In the following summary, the term "Anchor Means" may be capitalized.

In FIG. 6, the expandable casing 126 is being "pushed" deeper into the wellbore by the anchor means. Therefore, this configuration is called a "Drill & Push" configuration. In this situation, the anchor means are on the uphole side of the subterranean electric drilling machine. On the other-hand, if the anchor means were instead on the downhole side of the subterranean electric drilling machine, then this configuration would be called a "Drill & Drag" configuration.

In FIG. 6, the anchor means are located on the inside of the previously installed borehole casing 96. In this configuration, the anchor means are located within the "Wellbore". On the other-hand, if the anchor means are instead located within the new borehole 104, then the anchor means are located in the "Open-Hole".

In FIG. 6, the downhole electric motor 114 rotates the rotary shaft 125 that is also called the "drilling work string" or simply the "Drill Pipe". In FIG. 6, the downhole electric motor rotates the Drill Pipe. Therefore, the "rotary means", in FIG. 6 is described by the following: "Rotates Drill Pipe". In FIG. 6, the expandable pipe 126 is not rotated. However, there are other configurations of the rotary means including: "Rotates Drill Pipe and Casing", and "In Open Hole Rotates Bit". In the below defined list of different preferred embodiments, the term "rotary means" is capitalized as "Rotary Means".

In FIG. 6, the expandable casing 126 is not rotated. Therefore, in this configuration, the expandable casing is "Non-Rotating". In other preferred embodiments, the expandable casing can be rotated by the rotary means. In this configuration, the expandable pipe is "Rotated".

In FIG. 6, the progressing cavity pump 180 is driven by a downhole pump motor assembly generally designated by element 182 that comprises the mud pump, or "Mud Pump" in FIG. 6. In this preferred embodiment, the Mud Pump is located within the Wellbore.

Accordingly, the preferred embodiment shown in FIG. 6 can be described as follows (Preferred Embodiment "A"):

Arrangement: Drill & Push
Anchor Means: In Wellbore
Mud Pump: In Wellbore
Rotary Means: Rotates Drill Pipe
Expandable Casing: Non-Rotating
Comments: Preferred Embodiment shown in FIG. 6.

Accordingly, another preferred embodiment of the invention may be succinctly described as follows (Preferred Embodiment "B"):

Arrangement: Drill & Push
Anchor Means: In Wellbore
Mud Pump: In Wellbore
Rotary Means: Rotates Drill Pipe and Expandable Casing
Expandable Casing: Rotating
Comments: This requires higher rotary torque than Preferred Embodiment "A".

Accordingly, another preferred embodiment of the invention may be succinctly described as follows (Preferred Embodiment "C"):

Arrangement: Drill & Drag
Anchor Means: In Open Hole
Mud Pump: In Wellbore
Rotary Means: In Open Hole, Rotates Drill Bit
Expandable Casing: Non-Rotating, Drags Behind Anchor Means
Comments: This requires stable formations for Open Hole Anchor Means.

Accordingly, another preferred embodiment of the invention may be succinctly described as follows (Preferred Embodiment "D"):

Arrangement: "Drainhole Drilling"
Anchor Means: In Wellbore
Mud Pump: In Wellbore
Rotary Means: Rotates Drill Pipe
Expandable Casing: Non-Rotating
Comments: Similar to Preferred Embodiment "A", except smaller diameters of expandable casing used.

In the above, Preferred Embodiment "C" is further described in the following document: U.S. Disclosure Document No. 494374 filed on May 26, 2001 that is entitled in part "Continuous Casting Boring Machine", an entire copy of which is incorporated herein by reference.

In the above, Preferred Embodiment "D" is further described in the following document: U.S. Disclosure Document No. 495112 filed on Jun. 11, 2001 that is entitled in part "Liner/Drainhole Drilling Machine", an entire copy of which is incorporated herein by reference.

The subterranean electric drilling machine has been illustrated performing hydrocarbon drilling applications. However, there are other preferred embodiments of the invention. The subterranean electric drilling machine has the capability of performing directional drilling over large distances both onshore and offshore. This includes drilling pipelines under large and deep rivers, across large topographical features like cliffs or subsea escarpments. Other applications for the subterranean electric drilling machine include near surface drilling in urban areas for installation or replacement of utilities like water lines, gas mains, sewers, storm drains, underground power lines, and communication lines, including broadband cables and fiber optic cables. The selected drill bit would be sized for the application. These preferred embodiments are not further described herein in the interests of brevity.

Figure 16:
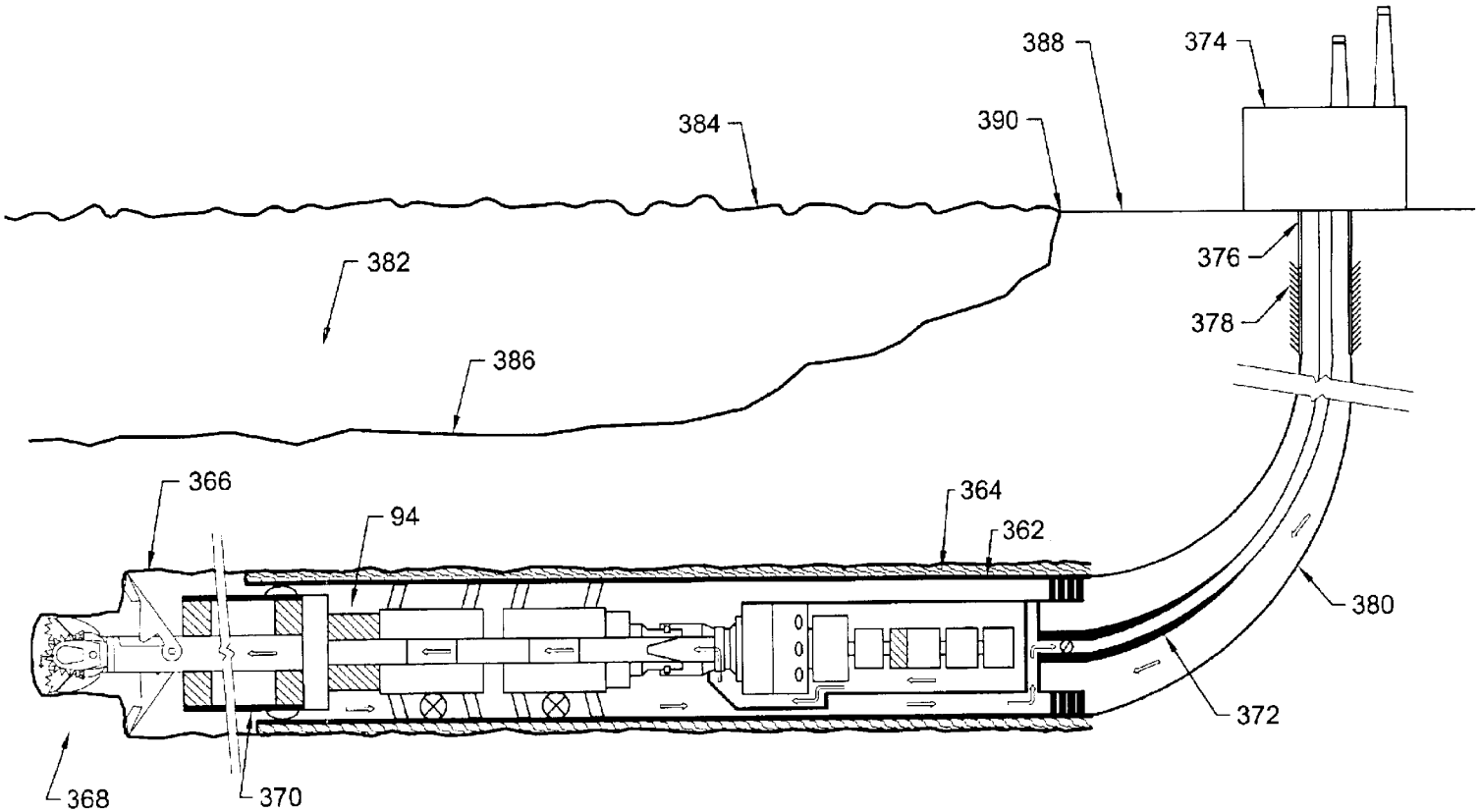
FIG. 16 shows a subterranean electric drilling machine boring a new borehole under the ocean bottom from an onshore wellsite.

FIG. 16 is similar to FIG. 9, except here the well is being drilled from an onshore wellsite. Subterranean electric drilling machine 94 is disposed within a previously installed borehole casing 362 that is surrounded by existing downhole cement 364. The subterranean electric drilling machine 94 was described in relation to FIG. 6. The subterranean electric drilling machine is in the process of drilling a new borehole 366 into geological formation 368. Expandable casing 370 is carried into the new borehole by the subterranean electric drilling machine. Umbilical 372 connects the subterranean electric drilling machine to a land-based drill center 374 that has the hoist, the computer systems, the umbilical carousel, etc. Surface casing 376 is surrounded by cement 378. The bottom of the surface casing is connected to previously installed casing 362 by casing string 380. The ocean 382 has ocean surface 384 and ocean bottom 386. Here, the new borehole is being drilled beneath the ocean from a land-based drill center. The land 388 joins the ocean at a beach 390.

Figure 17:
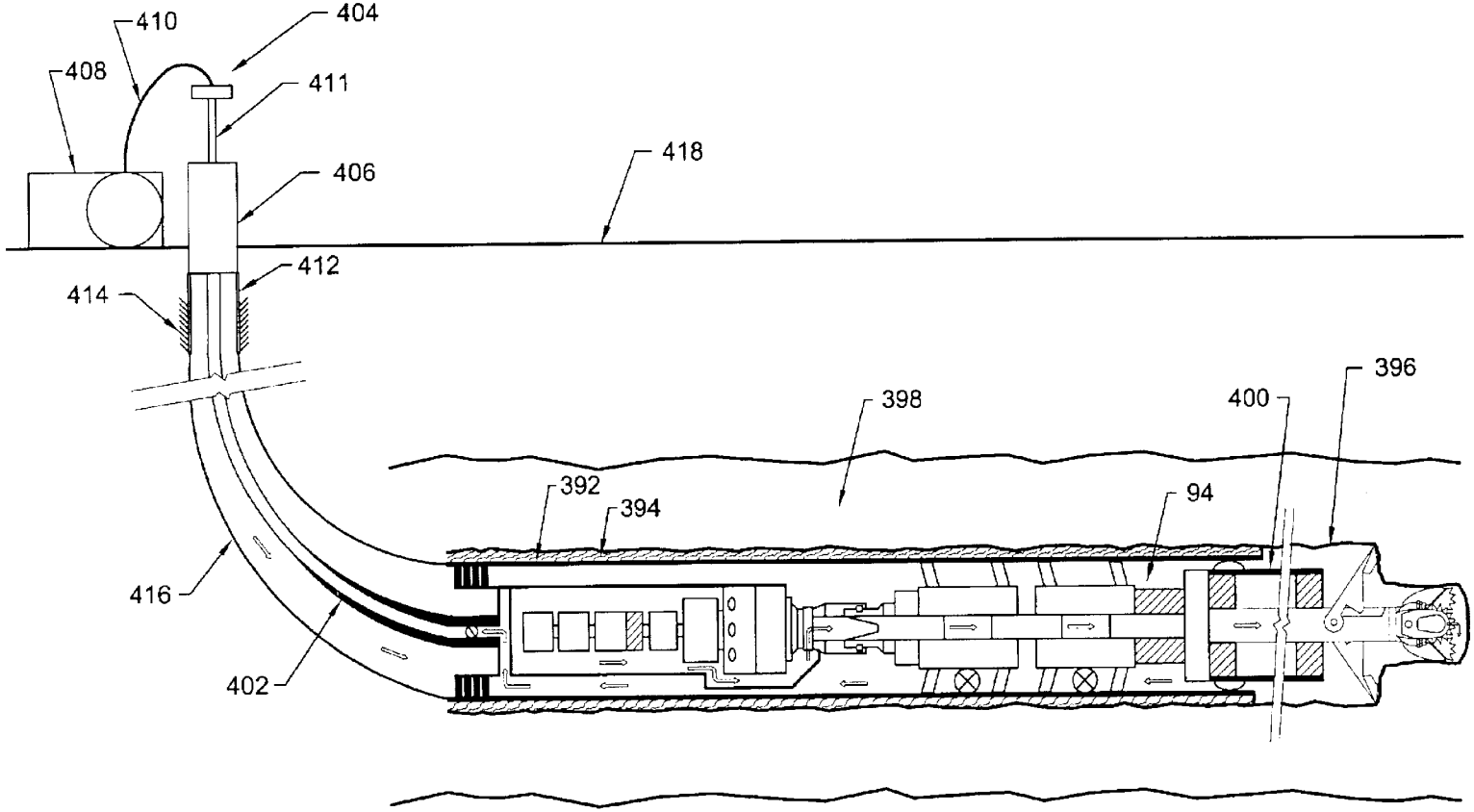
FIG. 17 shows a subterranean electric drilling machine boring a new borehole under the earth from a land based drill site.

FIG. 17 is similar to FIG. 9 and FIG. 16, except here the well is being drilled from a land based drill site. Subterranean electric drilling machine 94 is disposed within a previously installed borehole casing 392 that is surrounded by existing downhole cement 394. The subterranean electric drilling machine 94 was described in relation to FIG. 6. The subterranean electric drilling machine is in the process of drilling a new borehole 396 into geological formation 398. Expandable casing 400 is carried into the new borehole by the subterranean electric drilling machine. Umbilical 402 connects the subterranean electric drilling machine to the land based drill site generally designated by element 404. Shown figuratively are hoist 406; the umbilical carousel, computers, etc. 408; and another section of umbilical 410. Element 411 figuratively shows a lubricator. Surface casing 412 is surrounded by cement 414. The bottom of the surface casing is connected to previously installed casing 392 by casing string 416. The surface of the earth is identified by element 418.

Figure 18:
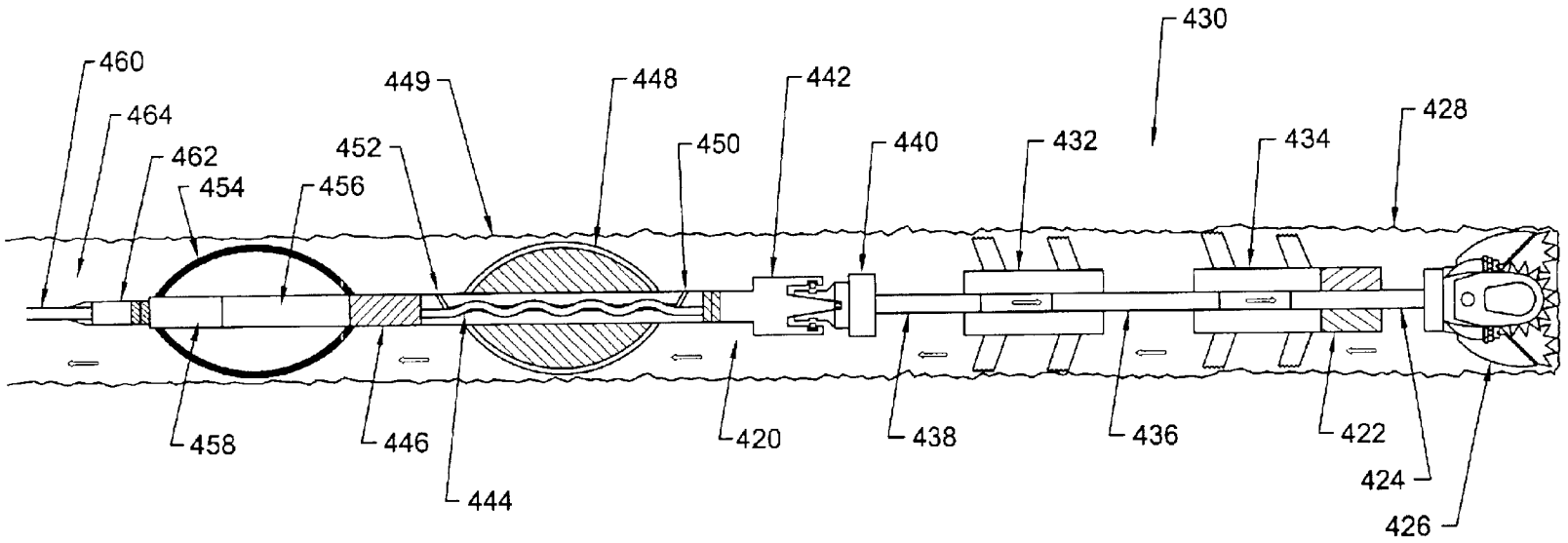
FIG. 18 shows an open hole subterranean electric drilling machine that is drilling an open borehole in the earth.

FIG. 18 shows a subterranean electric drilling machine 420 that is drilling an open borehole in the earth. Element 420 is called an open hole subterranean electric drilling machine. Electric motor 422 turns shaft 424 that rotates the rotary drill bit 426 that drills borehole 428 in geological formation 430. First anchor and weight on bit mechanism (AWOBM) 432 is connected to second anchor and weight on bit mechanism (AWOBM) 434 by extensible shaft 436, which elements comprise an anchor mechanism. Shaft 438 connects the female side of universal mud and electrical connector 440 to the male side of universal mud and electrical connector 442. Progressing cavity pump 444 is driven by its pump motor 446. Inflatable seal 448 surrounds the progressing cavity pump that makes a positive seal against the borehole wall of geological formation 449. The progressing cavity pump has inlet 450 and outlet 452. The inflatable seal 448 and the progressing cavity pump form a Smart Shuttle that can be used to move the open hole subterranean electric drilling machine shown in FIG. 18 in and out of the hole. Centralizer 454 is attached to the portions of the tool body having electronics 456 and bidirectional communications 458 with the surface. Mud carrying umbilical 460 is connected to the cable head 462 that provides electrical power and mud to the open hole subterranean electric drilling machine. Mud from the surface through the umbilical proceeds down the interior of various elements of the drilling machine that are not shown for simplicity, and then mud laden cuttings return to the surface through the annulus 464 between the borehole wall and the outside diameter of the umbilical. The arrows in FIG. 18 show the direction of mud flow. The inflatable seal 448 surrounding the progressing cavity pump is partially collapsed during actual drilling operations to allow the mud to pass. The inflatable seal 448 is inflated when quickly transporting the open hole subterranean electric drilling in and out of the well. In view of the detailed description provided in FIG. 6 and elsewhere, and in view of the description herein, it is now evident how the open hole subterranean electric drilling machine functions. Accordingly, no further detail will be presented here in the interests of brevity.

Figure 19:
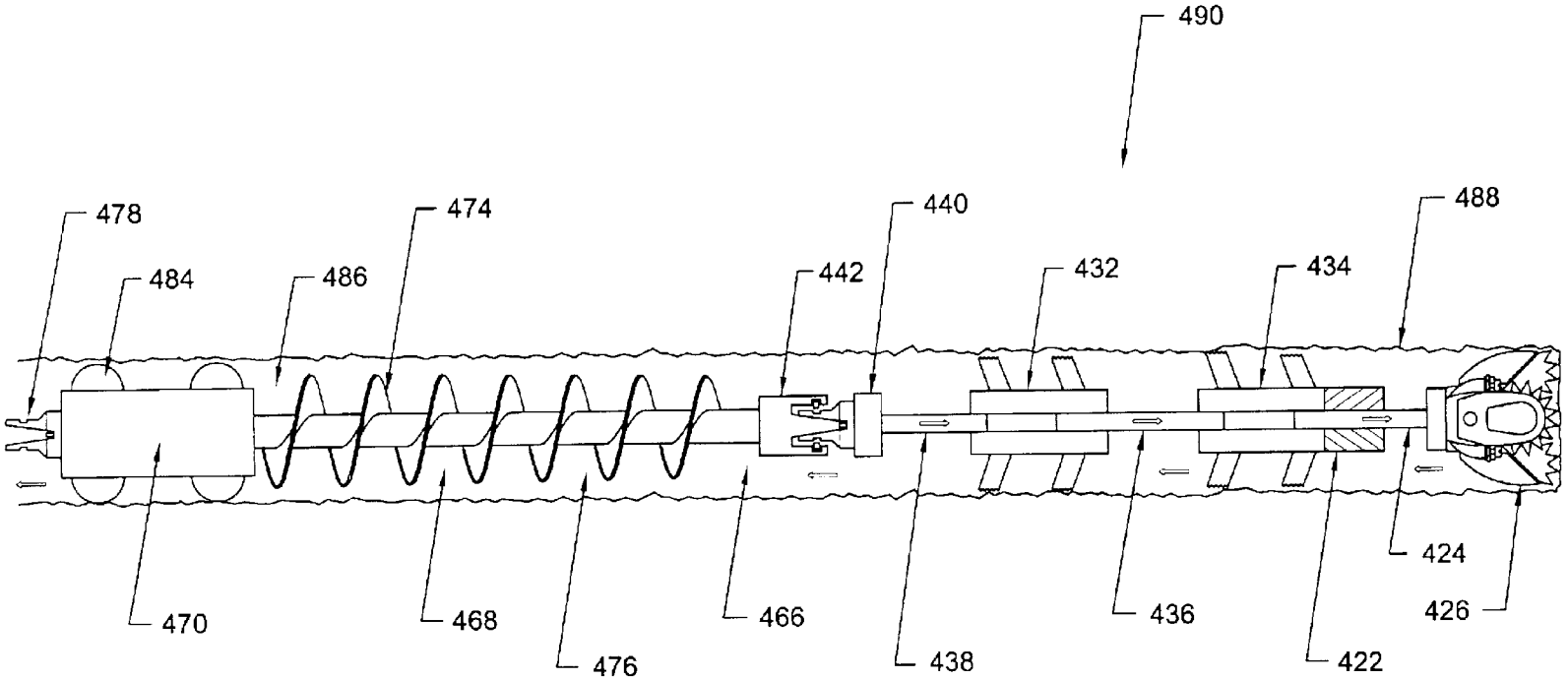
FIG. 19 shows screw drive subterranean electric drilling machine that is drilling an open borehole in the earth.

FIG. 19 shows another subterranean electric drilling machine 466 that is drilling an open borehole in the earth. Element 466 is another embodiment of an open hole subterranean electric drilling machine called a "screw drive subterranean electric drilling machine". FIG. 19 is similar to FIG. 18. Elements 422, 424, 426, 432, 434, 436, 438, 440 and 442 have been defined in relation to FIG. 18.

The fundamental change in FIG. 19 is that the form of the Smart Shuttle shown in FIG. 18 has been replaced by the screw translator device 468. Element 470 has an electric motor 472 (not shown for simplicity), related electronics, and bidirectional communications electronics. When electric motor 472 rotates the screw blades 474, then friction against the mud in the hole 476 causes the screw translation device 468 to translate within the hole (if the anchor means of elements 432 and 434 are in their retracted positions). Reversing the rotation of the screw blades reverses the direction of translation within the borehole. The female side of universal mud and electrical connector 478 is attached to the male side of universal mud and electrical connector 480, that is in turn connected to umbilical 482, however, elements 480 and 482 are not shown in FIG. 19 for the purposes of simplicity. Centralizers 484 centralize element 470 within the wellbore 486. The arrows show the path of the mud flow during drilling operations. In view of the previous disclosure, it is evident how the screw drive subterranean electric drilling machine is used to drill the new borehole 488 in the geological formation 490.

In another preferred embodiment in FIG. 19, the screw blades 474 have a variable pitch, where the distance between successive blades is a smaller distance to the right-hand side of FIG. 19 than to the left-hand side of FIG. 19. In yet another preferred embodiment, the pitch between the screw blades 474 is variable and controlled by the surface computer system 26. Various embodiments of the "screw drive subterranean electric drilling machine" are further described in U.S. Disclosure Document No. 494374 filed on May 26, 2001, that is entitled in part "Continuous Casting Boring Machine", an entire copy of which is incorporated herein by reference.

Figure 20:
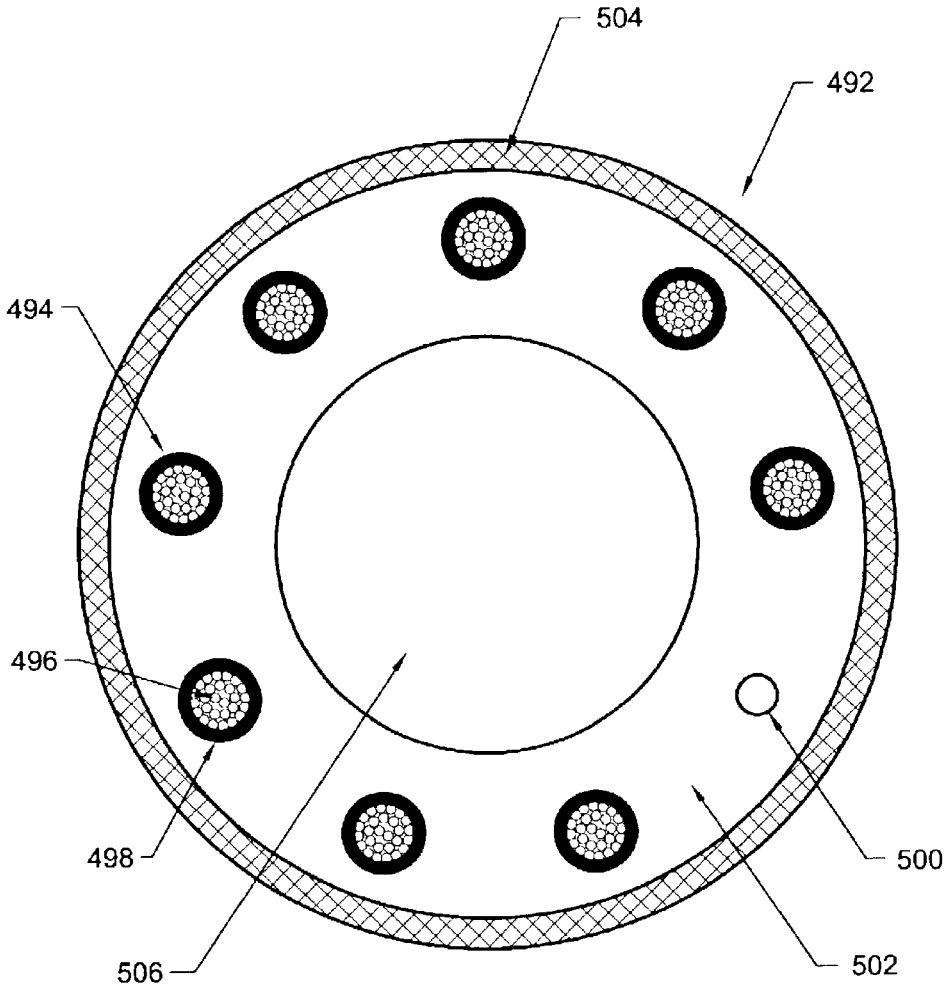
FIG. 20 shows a cross section of another embodiment of an umbilical used for subterranean electric drilling machines, for open hole subterranean electric drilling machines, and for other applications.

FIG. 20 shows a cross section of another embodiment of an umbilical used for subterranean electric drilling machines and for open hole subterranean electric drilling machines. A version of FIG. 20 was originally filed in the U.S.P.T.O. on the date of Oct. 2, 2000 as a portion of U.S. Disclosure Document 480550. Umbilical 492 contains at least one insulated electrical conductor 494. Each such conductor has electrical copper conductors 496 encapsulated by electrical insulation 498. As shown in FIG. 20, there are a total of 8 such insulated electrical conductors. In one embodiment, the insulated electrical conductors may be chosen to be the same as shown in FIG. 1. Also shown is high speed bidirectional data communications means 500, which may be a fiber optic cable or a coaxial cable. The insulated electrical conductors and the high speed bidirctional data communication means is encapsulated by first composite material 502. Second composite material 504 surrounds first composite material. As described above, the specific gravities of composite materials 502 and 504 may be engineered so that the umbilical 492 is substantially neutrally buoyant in wellbore fluids.

In one preferred embodiment of the invention in FIG. 20, the second composite material 502 is chosen for its good strength, durability against abrasion in the well, and perhaps for its electrical insulation properties. In one embodiment of FIG. 20, the first composite material is chosen so with a particular specific gravity such that the overall umbilical is neutrally buoyant in typical well fluids (in 12 lb per gallon mud, for example, or in salt water, as another example). As previously discussed, syntactic foam materials having silica microspheres as provided by the Cumming Corporation (www.emersoncumming.com) for such purposes. The details on pressure balanced silica microspheres in syntactic foam may be reviewed in Attachment 28 to the Provisional Patent Application No. 60/384,964 filed on Jun. 3, 2002 that is entitled "Umbilicals for Well Conveyance Systems and Additional Smart Shuttles and Related Drilling Systems", an entire copy of which is incorporated herein by reference.

The interior 506 of the umbilical is used to provide drilling fluids or cement downhole as required. Therefore, different embodiments of umbilicals provide electric power downhole, bidirectional communications, and provide the ability to conduct fluids to and from the borehole, which are neutrally buoyant in the fluids present. Umbilicals handling well fluids are also useful with a number of well services including the use with straddle packers, injection tools, oil gas separators, flow line cleaning tools, valves, etc. In another preferred embodiment, the interior 506 may be filled with composite materials to provide extra strength for certain applications that is also substantially neutrally buoyant.

Figure 21:
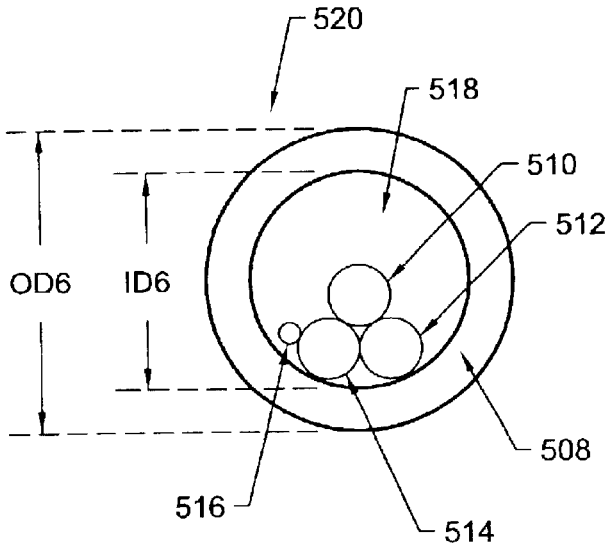
FIG. 21 shows yet another neutrally buoyant composite umbilical in 12 lb per gallon mud.

FIG. 21 shows yet another neutrally buoyant composite umbilical in 12 lb per gallon mud. Outer spoolable composite tubing 508 has an OD shown by legend OD6, and has an ID shown by legend ID6. In a preferred embodiment, OD6 is equal to 1.75 inches O.D., and ID6 is equal to 1.25 inches I.D. In one preferred embodiment, the composite tubing is chosen to have a specific gravity of 1.50.

Three each 0.355 inch O.D. insulated No. 4 AWG Wires 510, 512 and 514 are disposed within the I.D. of the spoolable composite tubing. Optical fiber 516 is also disposed within the spoolable composite tubing. The remaining available volume within the spoolable composite 518 is then filled with pressure balanced silica microspheres in syntactic foam that has a specific gravity of 0.60. A calculation shows that this umbilical in 12 lbs/gallon mud weighs-50 lbs for every 1,000 feet. Assuming a coefficient of friction of 0.2, at 20 miles the umbilical could pull back with a frictional force of 1,056 lbs. So, this umbilical is substantially neutrally buoyant (or simply "neutrally buoyant" as defined below).

In FIG. 21, the insulated wire is rated at 14,000 volts. This particular wire is Part Number FEP4FLEXSC available through Allied Wire & Cable located in Bridgeport, Pa. This wire was previously described in relation to FIG. 1. As is evident from the discussion involving FIG. 1, the three power conductors can provide 160 horsepower (119 kilowatts) at 20 miles to do work at that distance. No fluids are conducted down the interior of this umbilical generally designated by element 520 in FIG. 21. This umbilical is also useful for other applications to be discussed later.

Selecting different specific gravities for the pressure balanced silica microspheres in syntactic foam that fills the volume within the spoolable composite 518 allows different preferred embodiments to be designed to be neutrally buoyant within different well fluids having different densities. As a practical matter, an umbilical having a particular density will be used within a range of acceptable densities of well fluids.

Figure 22:
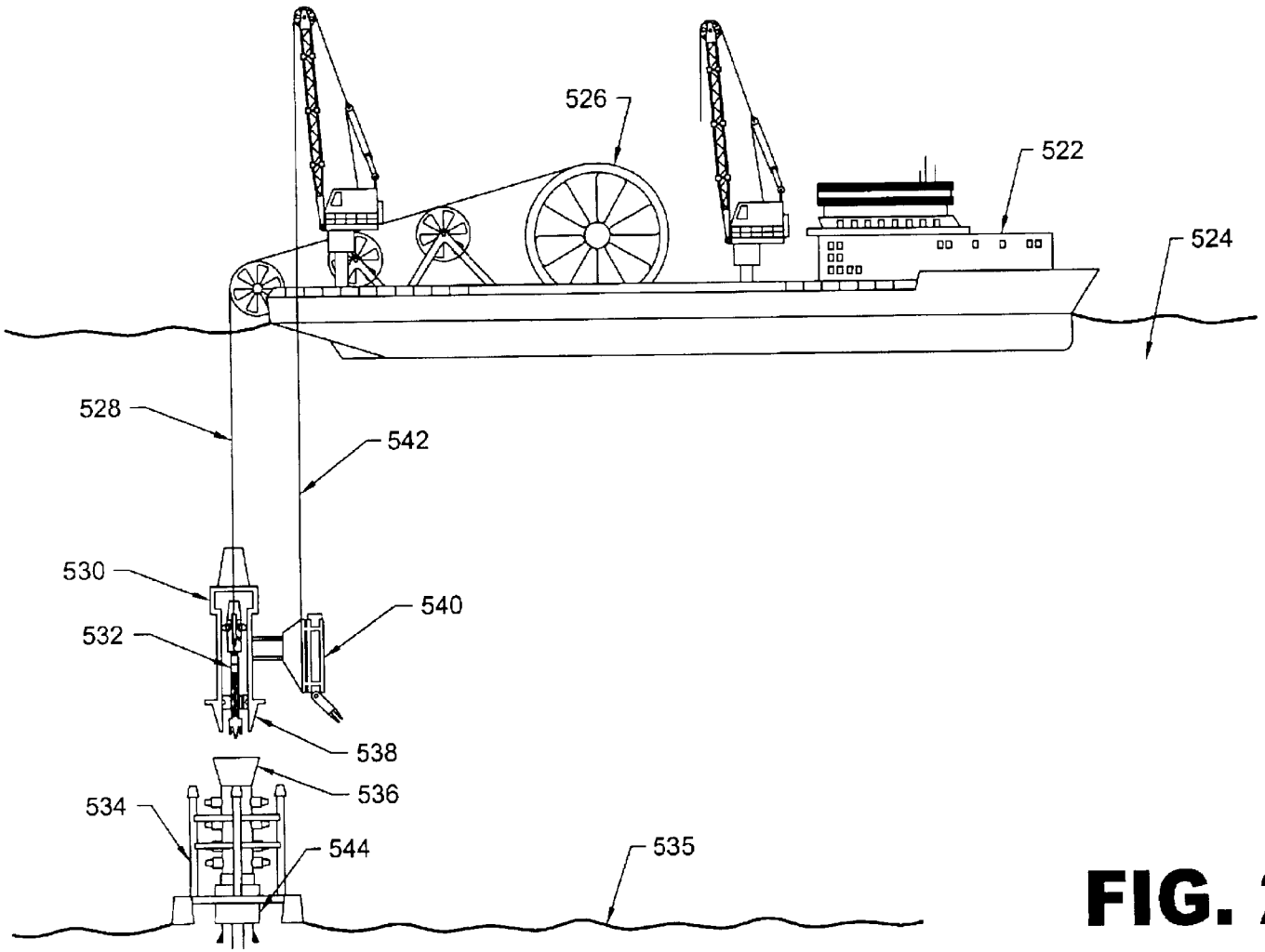
FIG. 22 shows an umbilical providing power in excess of 60 kilowatts and communications to a remotely operated vehicle

FIG. 22 is a schematic drawing that shows a ship performing subsea well servicing. Ship 522 in ocean 524 possesses an umbilical carousel 526 having umbilical 528 that proceeds through lubricator 530 that houses Smart Shuttle 532. Subsea well 534 on the ocean bottom 535 has mating equipment 536 that mates to mating equipment 538 of the lubricator 530. The lubricator is guided into place by remotely operated vehicle 540 obtaining its power and communications from umbilical 542. The umbilical carousel for umbilical 542 is not shown for simplicity.

Upon entering the subsea well, the Smart Shuttle is to proceed through the base of the lubricator 544 and into the wellbore below (not shown in FIG. 22). There, the Smart Shuttle is to perform a well workover that requires fluids to be injected into formation such as acids. Umbilical 528 may be selected to be a suitable umbilical including umbilical 2 in FIG. 1, and umbilical 492 in FIG. 20. Equipment resembling what is shown in FIG. 5 is on board the ship so that a computer system can control the workover operations.

In this case, umbilical 542 need not provide fluids to the remotely operated vehicle 540. Therefore, umbilical 542 may be chosen from umbilicals that includes umbilical 520 in FIG. 21. Equipment resembling what is shown in FIG. 5 is also onboard ship so that a computer system can control the remotely operated vehicle 540. The upper end of umbilical 542 proceeding to its carousel is not shown on the left-hand side of FIG. 22 for simplicity. In this case, the umbilical 542 is designed to have any desired buoyancy in sea water, that specifically includes densities greater than sea water, as is conventional in the industry. The apparatus and methods to control the power and communications is similar to that shown in FIGS. 2, 3, 4 and 5 and will not be repeated here for the purpose of brevity. In one preferred embodiment, over 60 kilowatts of power is provided by umbilical 542 to remotely operated vehicle 540. This power is provided to the load of the remotely operated vehicle, which in several preferred embodiments, is an electric motor that drives a propeller that provides thrust for the remotely operated vehicle. For simplicity, FIG. 22 does not show a free floating remotely operated vehicle (ROV) tethered to the ship by a free floating umbilical.

Figure 23:
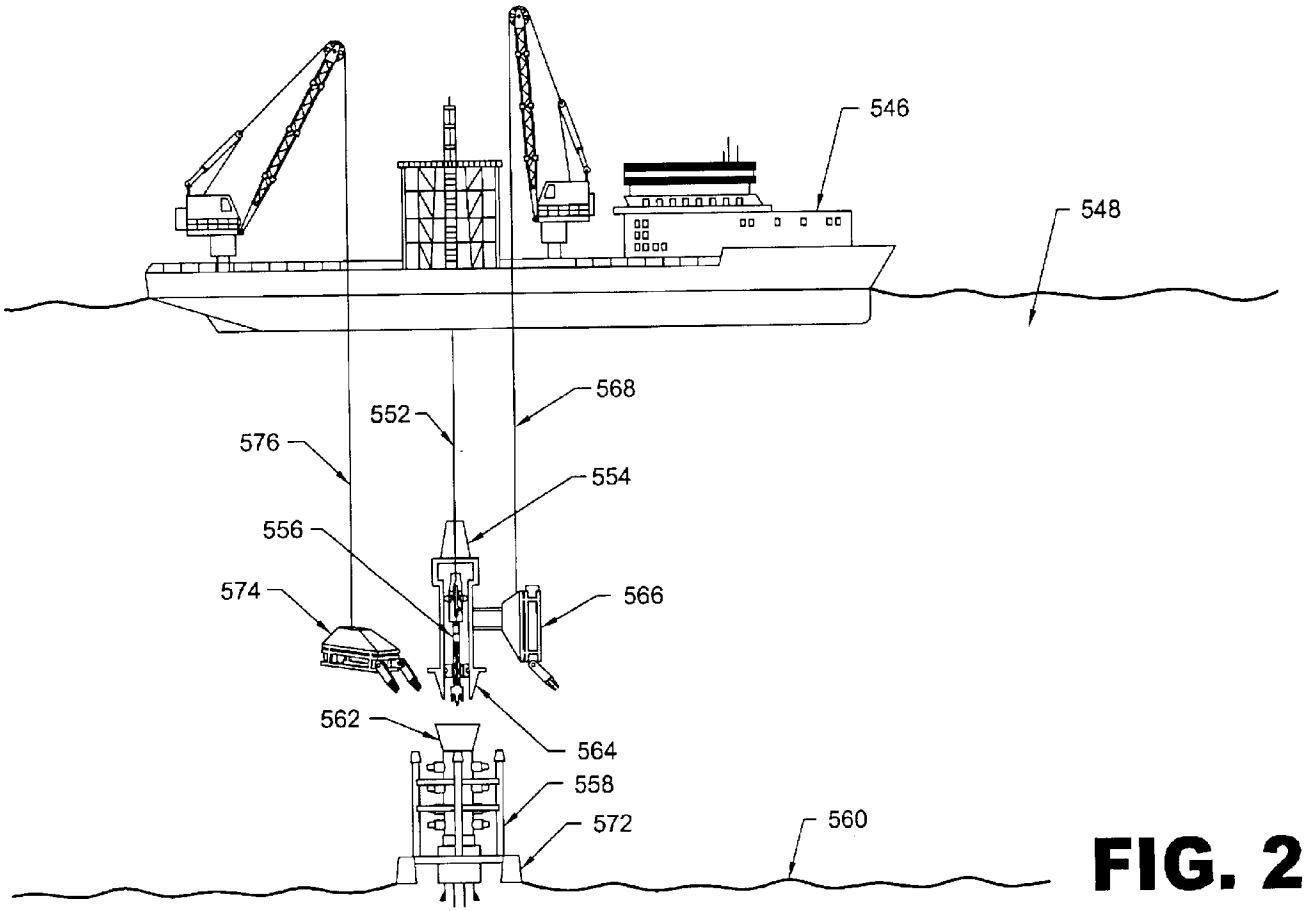
FIG. 23 shows a umbilical providing power in excess of 60 kilowatts, communications, and fluids to a remotely operated vehicle.

FIG. 23 is a schematic drawing similar to FIG. 22. FIG. 23 also shows a ship performing subsea well servicing. Ship 546 in ocean 548 possesses a first umbilical carousel 550 (not shown in FIG. 23 for simplicity) having umbilical 552 that proceeds through lubricator 554 that houses Smart Shuttle 556. Subsea well 558 on the ocean bottom 560 has mating equipment 562 that mates to mating equipment 564 of the lubricator 554. The lubricator is guided into place by first remotely operated vehicle 566 that obtains its power and communications from umbilical 568 that is deployed from second umbilical carousel 570 (not shown in FIG. 23 for simplicity). In this case, the umbilical 568 is designed to have any desired buoyancy in sea water, that specifically includes densities greater than sea water as is conventional in the industry. The upper end of umbilical 568 proceeding to carousel 570 near the top of the crane on the right-hand side of FIG. 23 is not shown for simplicity.

Upon entering the subsea well, the Smart Shuttle is to proceed through the base of the lubricator 572 and into the wellbore below (not shown in FIG. 22). There, the Smart Shuttle is to perform a well workover that does not necessarily require fluids to be injected into formation. Therefore, umbilical 552 may be selected to be a suitable umbilical including umbilical 520 in FIG. 21. Equipment resembling what is shown in FIG. 5 is on board the ship so that a computer system can control the Smart Shuttle, and any equipment attached to the Smart Shuttle, during workover operations.

In this case, umbilical 568 need not provide fluids to first remotely operated vehicle 566. Therefore, umbilical 568 may be chosen from umbilicals that includes umbilical 520 in FIG. 21. Equipment resembling what is shown in FIG. 5 is also onboard ship so that a computer system can control first remotely operated vehicle 566. In this case, the umbilical 568 is designed to have any desired buoyancy in sea water, that specifically includes densities greater than sea water as is conventional in the industry. The apparatus and methods to control the power and communications to first remotely operated vehicle are similar to that shown in FIGS. 2, 3, 4 and 5 and will not be repeated here for the purpose of brevity.

FIG. 23 shows second remotely operated vehicle 574 that obtains its power and communications from umbilical 576 that is deployed from third umbilical carousel 578 (not shown in FIG. 23 for simplicity). Second remotely operated vehicle 574 is to suitably attach to the subsea well 558 and is to remove fluids from the wellbore. Therefore, umbilical 576 may be selected to be a suitable umbilical including umbilical 2 in FIG. 1 and umbilical 492 in FIG. 20. The upper end of umbilical 576 proceeding to carousel 578 near the top of the crane on the left-hand side of FIG. 23 is not shown for simplicity. Equipment resembling what is shown in FIG. 5 is on board the ship so that a computer system can control the operation of second remotely operated vehicle 574. In this case, the umbilical 576 is designed to have any desired buoyancy in sea water, that specifically includes densities greater than sea water as is conventional in the industry. In one preferred embodiment, over 60 kilowatts of power is provided by umbilical 576 to remotely operated vehicle 574. This power is provided to the load of the remotely operated vehicle, which in several preferred embodiments, is an electric motor that drives a propeller that provides thrust for the remotely operated vehicle. In other embodiments, this power is provided to an electric motor that drives a downhole pump. For simplicity, FIG. 23 does not show a free floating remotely operated vehicle (ROV) tethered to the ship by a free floating umbilical.

In FIGS. 22 and 23, the feedback control of the voltage, RPM, current, and other parameters of an electric motor within an remotely operated vehicle is accomplished by analogy to that disclosed in relation to the electric motor of the subterranean electric drilling machine. In the interests of brevity, this feedback control of remotely operated vehicles will not be further discussed.

Figure 24:
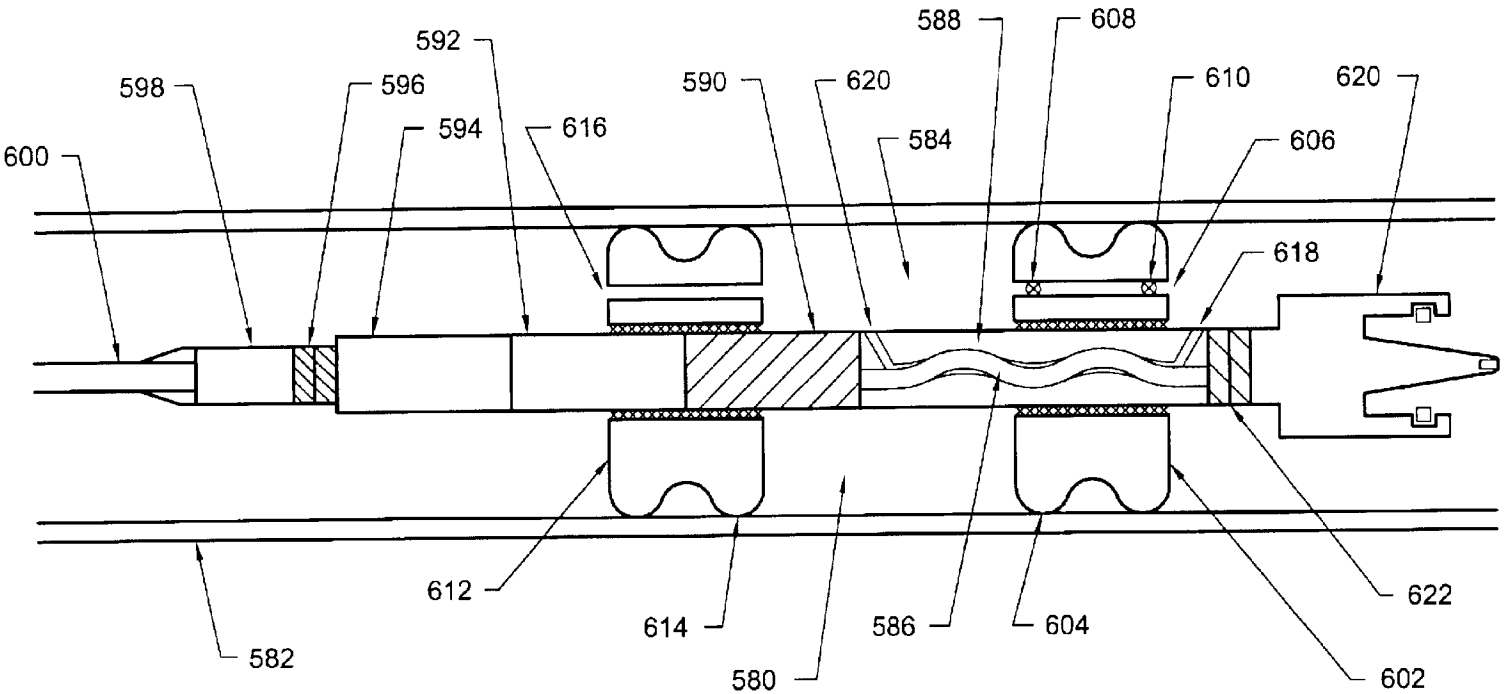
FIG. 24 shows a sectional view of one preferred embodiment of a Smart Shuttle™.

FIG. 24 shows one embodiment of the Smart Shuttle™ generally designated with the numeral 580 that is located within a "pipe means" 582 that includes a casing, drill pipe, tubing, etc. The Smart Shuttle is comprised of a progressive cavity pump 584 that has a rotor 586 and stator 588 as is typical of such pumps. The progressive cavity pump is coupled to gear box 590 that is in turn coupled to the electrical submersible motor 592, which in turn is connected to electronics assembly 594 having any downhole computer, the downhole sensors, and communications system, which in turn is connected by the quick change collar 596 to the umbilical head 598 that is connected the umbilical 600.

The lower wiper plug assembly 602 has sealing lobe 604 and this assembly is firmly attached to the body of the progressive cavity pump at the location shown in FIG. 24. Lower wiper plug assembly has lower bypass passage 606 which has electrically operated valves 608 and 610. The upper wiper plug assembly 612 has sealing lobe 614 and this assembly is firmly attached to the sections of the apparatus having the gear box and the electrical submersible motor at the location shown in FIG. 24. The upper wiper assembly also has permanently open upper bypass port 616 in the embodiment shown in FIG. 24.

In terms of FIG. 24, and when the electrical submersible motor is suitably turning the rotor of the progressive cavity pump (PCP), a volume of fluid $\Delta V2$ per unit time in the wellbore is pumped into the lower side port 618 of the PCP and out of the upper side port 620 of the PCP. With valves 608 and 610 closed, the fluid $\Delta V2$ is then forced through the upper bypass port 616 into the portion of the well above the upper surface of the upper wiper plug assembly. In this manner, the Smart Shuttle is then forced downward into the wellbore. The Retrieval Sub 620 is attached to the body of the Smart Shuttle by quick change collar 622 that in turn is connected to the lower body of the progressive cavity pump. This, and related embodiments of the Smart Shuttle is used to transport equipment attached to the Retrieval Sub into wells and out of wells. The Smart Shuttle is an example of a "well conveyance means", or simply, a "conveyance means". Fluid conduction means 624 is able to conduct any fluids available from umbilical 600 through the Retrieval Sub 620, although that fluid conduction means 624 is not shown in FIG. 24 for simplicity. Fluid conduction means 624 is fabricated using tubing and technology currently available in the oil and gas industry.

Figure 25:
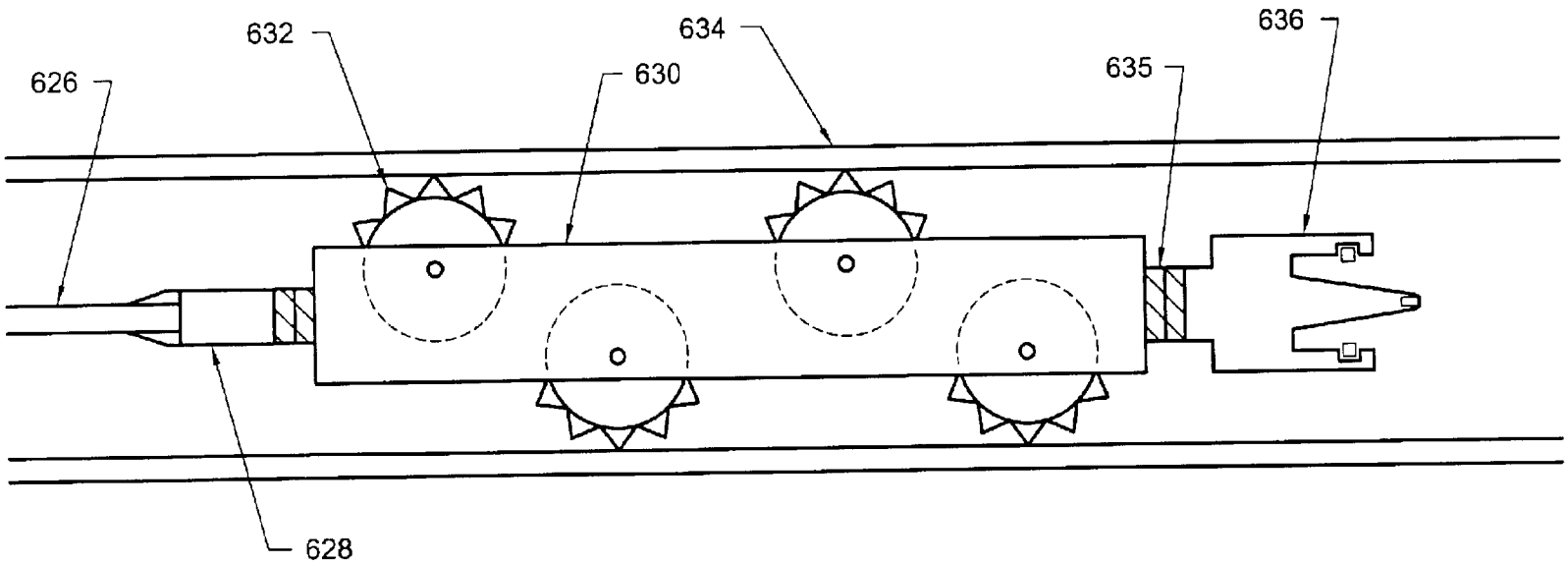
FIG. 25 shows a sectional view of a tractor deployer operated from an umbilical.

FIG. 25 shows another well conveyance means. Umbilical 626 possesses one or more electrical conductors. In several preferred embodiments, umbilical 626 possesses one or more high power electrical conductors. Umbilical head 628 connects the umbilical to tractor conveyor 630. The tractor conveyor has at least one friction wheel 632 which engages the interior of pipe 634. The tractor conveyor has four friction wheels as shown in FIG. 25. Quick change collar assembly 635 connects the tractor conveyor to the Retrieval Sub 636.

The tractor conveyor 630 with its Retrieval Sub 636 installed in FIG. 25 is an example of a "tractor conveyance means", a "tractor deployer", or a "downhole tractor deployment device". Electrical energy delivered via the umbilical to the tractor conveyor is used to drive electrical motors and/or electro-hydraulic systems 637 to provide rotational energy to the friction wheels (although the details of element 637 are not shown in FIG. 25 for simplicity). That rotational energy causes the tractor conveyor to move within the well.

The tractor conveyance means in FIG. 25 provides similar operational features as different embodiments previously described heretofore as Smart Shuttles. Fluid conduction means 638 is able to conduct any fluids available from umbilical 626 through the Retrieval Sub 636, although that fluid conduction means 638 is not shown in FIG. 24 for simplicity. Fluid conduction means 638 is fabricated using tubing and technology currently available in the oil and gas industry.

By analogy with the Smart Shuttle, one embodiment of the tractor conveyance means may be used as a portion of an "automated well drilling and completion system". As described herein, this automated system is called the "tractor conveyance system" or the "automated tractor conveyance system". The tractor conveyance means is substantially under the control of a computer system that executes a sequence of programmed steps that has at least one computer system located on the surface of the earth and has means to convey at least one completion device attached to the Retrieval Sub into the wellbore under the automated control of the computer system. The automated system has at least one sensor means located within the tractor conveyance means, has first communications means that provides commands from the computer system to the tractor conveyance means, has second communications means that provides information from the sensor means to the computer system, where the execution of the programmed steps of the computer system to control the tractor conveyance means takes into account information received from the sensor means to optimize the steps executed by the computer system to drill and complete the well.

Figure 26:
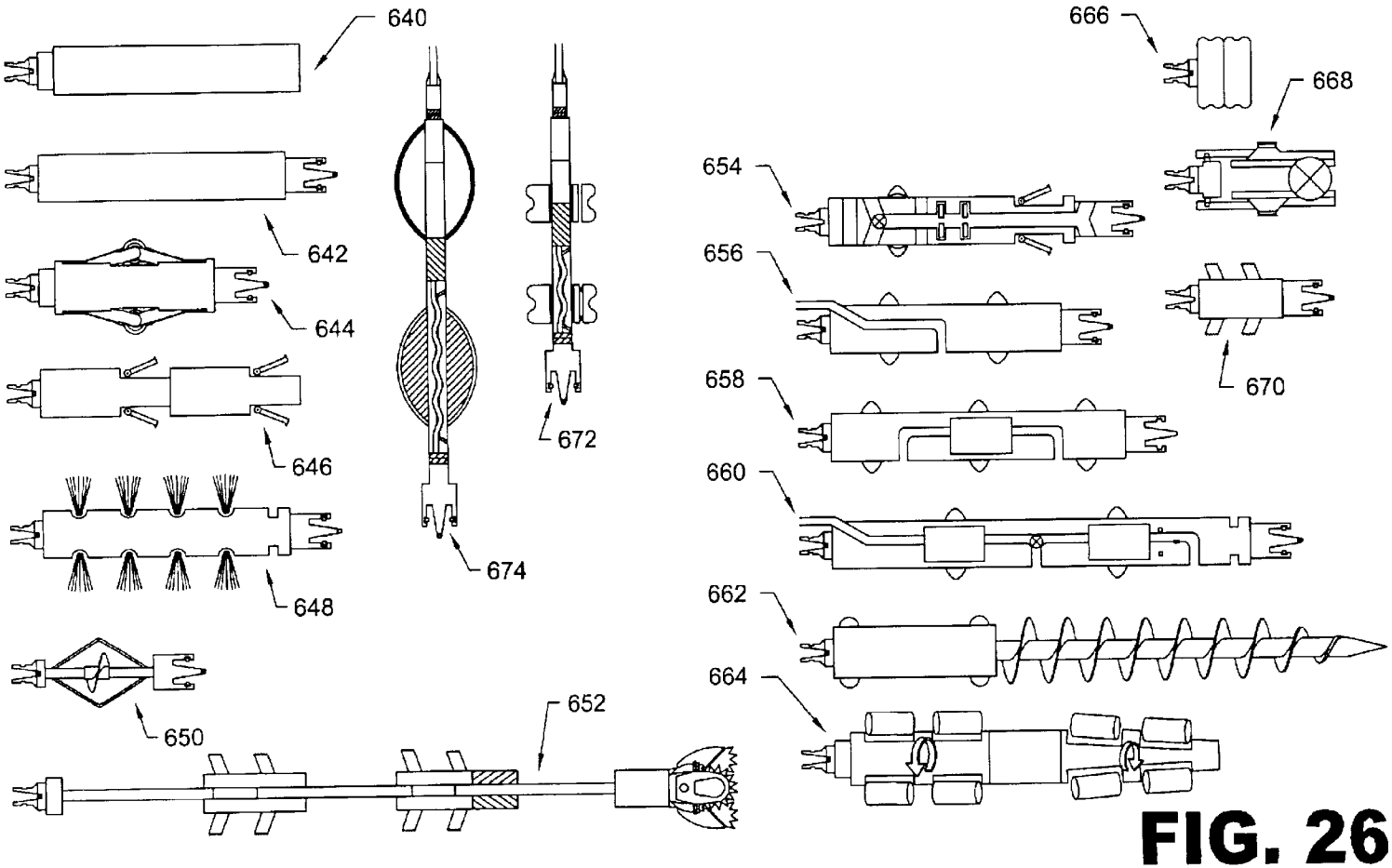
FIG. 26 shows various devices that may be attached to the Retrieval Sub of the Smart Shuttle and the tractor conveyor.

The Retrieval Sub can be attached to a number of the devices shown in FIG. 26. Those devices include any commercial tool or device 640; any logging tool 642; any torque reaction centralizer 644; any scraper 646; any perforating tool 648; any flow meter 650; any Downhole Rig with rotary bit 652; any Universal Completion Device™ 654; any straddle packer 656; any injection tool 658; any oil/gas separator 660; any flow line cleaning tool 662; any casing expanding tool 664; any plug 666; any valve 668; and any locking mechanism 670. These different tools are either defined in applicant's applications or are tools used in the oil and gas industry. The point is that any of these devices can be attached to the Retrieval Sub of the Cased Hole Smart Shuttle 672 or to the Retrieval Sub of the Open Hole Smart Shuttle 674. These devices may similarly be attached to the Retrieval Sub of the tractor conveyance means. Each such device in this paragraph may be called a "completion device" and collectively, these may be referenced as "completion devices".

Figure 27:
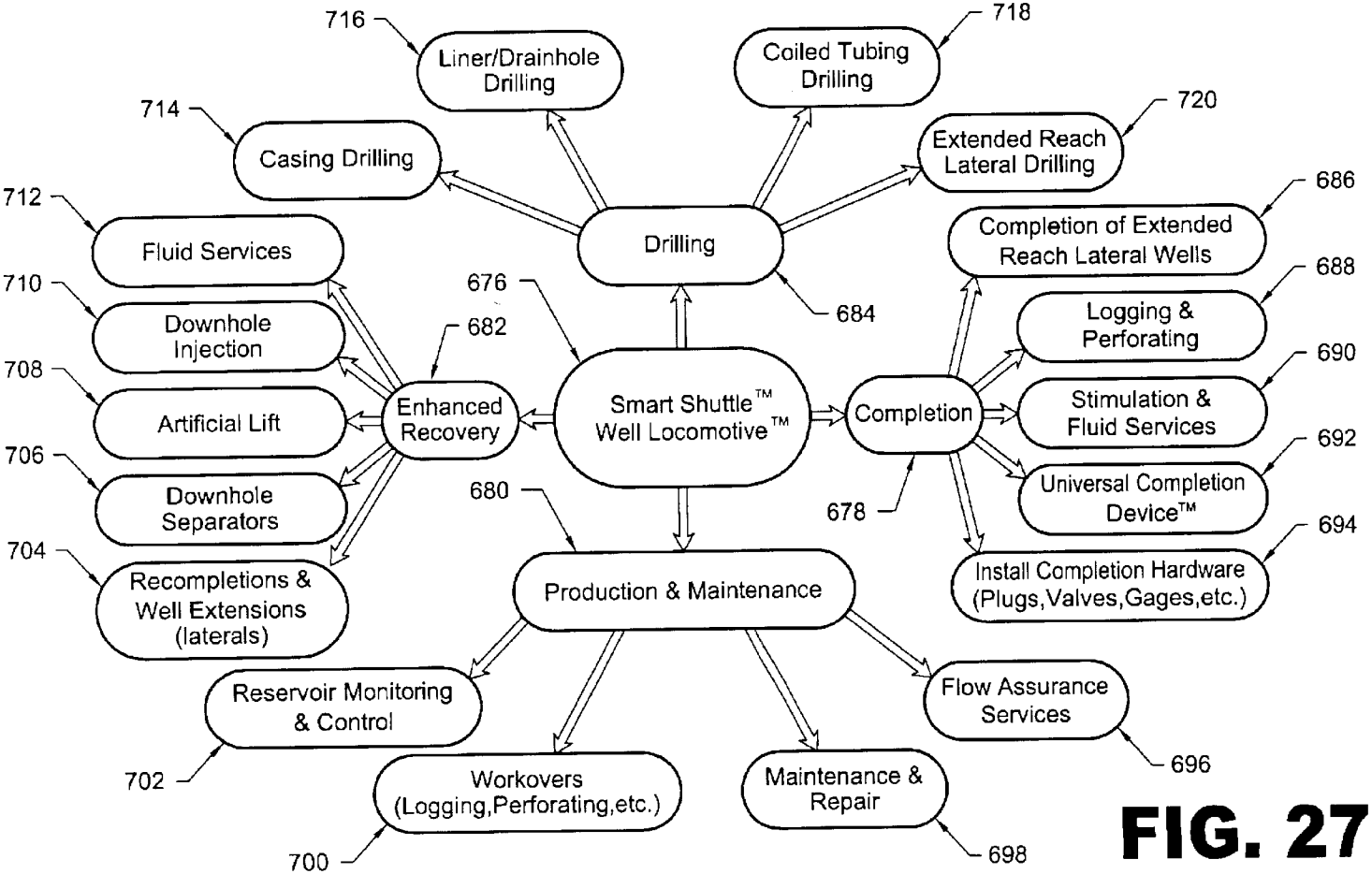
FIG. 27 shows a diagrammatic representation of functions that may be performed with the Smart Shuttle and the tractor conveyance system.

These devices specified in the previous paragraph may be used for a variety of different purposes in the oil and gas industry. Many of those tools can be used to serve wells. Please refer to FIG. 27 that shows a diagrammatic representation of functions that may be performed with the Smart Shuttle or the Well Locomotive. FIG. 27 shows that the Smart Shuttle or the Well Locomotive shown diagrammatically as element 676 may be used for the purposes of completion 678 (ie., to perform completion services on a well); production & maintenance 680 (ie., to perform production and maintenance services on a well); enhanced recovery 682 (ie., to perform enhanced recovery services on a well); and for drilling 684. Under completion functions, or "completion services", the Smart Shuttle and Well Locomotive may be used for the completion of extended reach lateral wells 686; for logging and perforating 688; for stimulation and fluid services 690; may be used to install the Universal Completion Device™ 692; and may be used to install completion hardware such as plugs, valves, gages, etc. 694. Under production and maintenance functions, or "production and maintenance services", the Smart Shuttle and Well Locomotive may be used for flow assurance services 696; for maintenance and repair 698; for workovers, that include logging, perforating, etc., 700; and for reservoir monitoring and control 702. Under enhanced recovery functions, or "enhanced recovery services", the Smart Shuttle and Well Locomotive may be used for recompletions, well extensions, and laterals 704; to install downhole separators 706; to perform artificial lift 708; to facilitate downhole injection 710; and for fluid services 712. Under drilling functions, or under "drilling services", the Smart Shuttle and the Well Locomotive may be used for casing drilling purposes 714; for liner drainhole drilling purposes 716; for coiled tubing drilling 718; and for extended reach lateral drilling 720. Extensive details are provided in about each of these functions in the related U.S. Disclosure Documents and in the related Provisional Patent Applications cited above.

Any one or more of the functions provided in the previous paragraph is called a "well service". Two or more of such functions are called "well services". The execution of the programmed steps of the automated computer system to control the Smart Shuttle™, or tractor conveyance means, takes into account information received from the sensor means within the tractor conveyance means to optimize the steps executed by the computer system to service the well.

The above umbilicals have stated calculations pertaining to lengths of 20 miles. However, the umbilicals can be any length from 100's of feet to 20 miles. The extreme distance of 20 miles was chosen to show neutrally buoyant umbilicals can provide high power and high speed data communications at great distances that has heretofore not been recognized in the oil and gas industry.

As stated previously, the phrase "substantially neutrally buoyant", "essentially neutrally buoyant", "near neutral buoyant", and "approximately neutrally buoyant" may be used interchangeably. In several preferred embodiments of the invention, the meaning of these terms is that in the presence of the well fluids, that the buoyancy of the umbilical causes the typical friction of the umbilical against the well to be substantially reduced.

As stated earlier, the tractor conveyor tractor conveyor 630 with its Retrieval Sub 636 in FIG. 25 is an example of a "conveyance means", a "tractor conveyance means", a "tractor deployer", or a "downhole tractor deployment device". There are many "well tractors", or devices related to well tractors, a selection of which are described in the following documents: U.S. Pat. Nos. 6,347,674; 6,345,669; 6,318,470; 6,296,066; 6,273,189; 6,257,332; 6,241,031; 6,241,028; 6,225,719; 6,179,058; 6,179,055; 6,173,787; 6,089,323; 6,082,461; 5,954,131; 5,794,703; 5,547,314; 5,375,668; 5,209,304; 5,184,676; 5,121,694; 5,018,451; 5,040,619; 4,960,173; 4,686,653; 4,643,377; 4,624,306; 4,570,709; 4,463,814; 4,243,099; 4,192,380; 4,085,808; 4,071,086; 4,031,750; 3,969,950; 3,890,905; 3,888,319; 3,827,512; in EP0564500B1; and in WO9806927; WO9521987; WO9318277; and WO9116520; entire copies of which are incorporated herein by reference. Entire copies of the 39 cited references in this paragraph are incorporated herein by reference. Many of these devices are means to cause or generate movement within wellbores. Such "movement means" may be attached to a device similar to the Retrieval Sub 636. Devices similar to Retrieval Sub 636 are called "retrieval means". So, movement means may be coupled to retrieval means to make a "tractor conveyance means", or tractor deployers, or downhole tractor deployment devices.

In view of the above, several embodiments of this invention use a closed-loop system to service a well for producing hydrocarbons from a borehole in the earth having at least one computer system located on the surface of the earth, which possess at least one conveyance means to convey at least one completion device into the borehole under the automated control of the computer system that executes a series of programmed steps, which possess at least one sensor means located within the conveyance means, which have first communications means that provides commands from the computer system to the conveyance means and possessing second communications means that provides information from the sensor means to the computer system, whereby the execution of the programmed steps by the computer system to control the conveyance means takes into account information received from the sensor means to optimize the steps executed by the computer to service the well. Such system is called a "closed-loop tractor conveyance system". The closed-loop system may also be used to monitor and control production of hydrocarbons from the wellbore.

The above described umbilicals, and other variations of such umbilicals that meet the above defined operational specifications, could be manufactured on a contractual basis by a firm called ABB Offshore Systems that is located in Stavanger, Norway, that has its U.S.A. office that may be reached through ABB Offshore Systems, Inc., having the address of 8909 Jackrabbit Road, Houston, Tex. 77095, having the telephone number of (281) 855-3200, that has its website that can be reached through www.abb.com. The above described umbilicals, and other variations of such umbilicals that meet the above defined operational specifications, might be manufactured on a contractual basis by a firm called the Fiberspar Corporation that may be reached at 28 Patterson Brook Road, West Warehan, Mass. 02576, having the telephone number (508) 291-9000, which has its website at www.fiberspar.com. This firm is capable of supplying various spoolable composite tubes capable of being spooled onto a reel having relevant anisotropic characteristic, a specified burst pressure, a specified collapse pressure, a specified tensile strength, a specified compression strength, a specified load carrying capacity, which is also bendable. Some of these tubes include an inner liner material, an interface layer, fiber composite layers, a pressure barrier layer, and an outer protective layer. The fiber composite layers can have triaxial braid structure. The composites may be fabricated from carbon-based composites.

In the above, syntactic foam materials were described in various preferred embodiments to change the apparent buoyancy of an umbilical in the presence of other surrounding fluids. However, any material of a different density may be used for this purpose.

A preferred embodiment above has described an apparatus to drill oil and gas wells having subterranean electric drilling machine disposed in a wellbore such as that shown as element 94 FIG. 6. The subterranean electric drilling machine possesses at least one downhole electric motor that is shown as element 114 in FIG. 6. This electric motor rotates a rotary drill bit identified as elements 106, 110 and 112 in FIG. 6. This electric motor rotates the drill bit at a selected RPM determined by the frequency, current and voltage applied to input terminals of the electric motor as shown in FIG. 2 and in FIG. 3. One advantage of such an electrically operated drill bit operating at relatively high RPM is that it produces very fine rock cuttings that are easily transported to the surface by mud flow. The input terminals of the electric motor are identified as the inputs to the downhole electrical load 22 in FIG. 2, which in several embodiments is an electric motor, which are also attached to the sensing unit 24. The input terminals of the electric motor are shown a the leads attached to either side of element 34 in FIG. 2. The electric motor operates properly with a particular voltage level applied to its electrical input. Please refer to the preferred embodiment discussed in relation to electric motor 34 in FIG. 3. It is important to note that in several preferred embodiments, the electrical motor 34 in FIG. 3 is dissipating 160 horsepower (119 kilowatts). A surface power supply means located on the surface of the earth provides a voltage output that is identified with element 20 in FIG. 2. An umbilical means disposed in the wellbore surrounded by well fluids connecting the surface power supply means to the subterranean electric drilling machine provides electrical power to the electrical input of the electric motor. For example, such an umbilical means is shown as element 116 in FIG. 6 and in FIG. 9. The umbilical means possesses insulated electric wires as shown in FIGS. 1, and 20. The umbilical means possess high speed data communications means such as high speed data link 14 in FIG. 1. The umbilical means possesses a fluid conduit for conveying drilling fluids through the interior of the umbilical means such as element 8 in FIG. 1 and 506 in FIG. 20. The preferred embodiment has means to measure first voltage applied to the first electrical input of the electrical motor as shown by element 24 in FIG. 2. The preferred embodiment possesses means to transmit information related to the measured first voltage through a high speed data communications means within the umbilical to a computer located on the surface of the earth by using the high speed data link 14 in FIG. 1. The embodiment further possesses computer controlled means to adjust the first voltage output as shown by element 28 in FIG. 2. The computer system 26 in FIG. 2 is used to maintain first voltage input at a particular voltage level to provide proper operation of the electric motor within the subterranean electric drilling machine.

In several preferred embodiments, the electric motor 34 in FIG. 3 dissipates in excess of 60 kilowatts. This is important because it is the recollection of the inventors that several scientists and senior managers of a major oil services company stated their opinions that it would be impossible to provide over 60 kilowatts to an electric motor, or any other electrical load, at distances of up to 20 miles from a wellsite through any type of reasonably sized umbilical that would be practical to use within wellbores. According to the recollection of the inventors, these senior managers and scientists clearly stated their opinions before the invention herein was disclosed to those particular individuals. Yet further from this recollection, it apparently never occurred to these same scientists and senior managers that any such umbilical delivering in excess of 60 kilowatts could also be neutrally buoyant. However, only after disclosure of the invention herein to those scientists and senior managers, did they apparently accept that such umbilicals could be designed and built. Accordingly, because the individuals involved are well known in the oil and gas industry, and are experts in fields directly pertaining to the invention, the preferred embodiment described herein is not obvious to one having ordinary skill in the art.

Therefore, a preferred embodiment is an apparatus to drill oil and gas wells comprising:

(a) a subterranean electric drilling machine disposed in a wellbore that possesses at least one electric motor that rotates a rotary drill bit at a selected RPM, whereby the electric motor possesses first electrical input, whereby the electric motor properly operates with a particular voltage level applied to first electrical input, and whereby the electric motor dissipates in excess of 60 kilowatts with the particular voltage level applied to the first electrical input;

(b) surface power supply means located on the surface of the earth providing first voltage output;

(c) umbilical means disposed in the wellbore surrounded by well fluids connecting the surface power supply means to the subterranean electric drilling machine that provides electrical power to the first electrical input of the electric motor, whereby the umbilical means possesses insulated electric wires, whereby the umbilical means possesses high speed data communications means, and whereby the umbilical possesses a fluid conduit for conveying drilling fluids through the interior of the umbilical means;

(d) means to measure first voltage applied to the first electrical input of the electrical motor;

(e) means to transmit information related to the measured first voltage through the high speed data communications means within the umbilical to a computer located on the surface of the earth;

(f) computer controlled means to adjust the first voltage output so as to maintain first voltage input at the particular voltage level to provide proper operation of the electric motor within the subterranean electric drilling machine.

Another preferred embodiment of the invention described in the previous paragraph provides an umbilical means that a approximately neutrally buoyant within the well fluids to reduce the frictional drag on the neutrally buoyant umbilical.

In view of the above disclosure, yet another preferred embodiment is the method of feed-back control of an electric motor having at least one voltage input located within a subterranean electric drilling machine located in a borehole that dissipates at least 60 kilowatts that receives power from a surface power supply through an umbilical surrounded by well fluids that possesses at least two insulated electric wires, whereby the umbilical also possesses high speed data link for data communications, comprising the steps of:

(a) measuring the voltage input to the electric motor;

(b) sending information related to the measured voltage input through the high speed data link to a computer located on the surface of the earth; and (c) using the computer to adjust the voltage output of the surface power supply that is used to control the voltage input to the electrical motor.

Another preferred embodiment of the invention described in the previous paragraph provides an umbilical that is a approximately neutrally buoyant within the well fluids to reduce the frictional drag on the umbilical.

In view of the above disclosure, yet another preferred embodiment is the method of providing in excess of 60 kilowatts of electrical power to the electrical motor of a subterranean electric drilling machine through a substantially neutrally buoyant composite umbilical containing electrical conductors to reduce the frictional drag on the neutrally buoyant umbilical.

In view of the disclosure related to FIGS. 22 and 23, it is evident that the invention may be used to provide electrical power to an electric motor located within a remotely operated vehicle. Accordingly, a preferred embodiment of the invention provides a method of feed-back control of an electric motor having at least one voltage input located within a remotely operated vehicle that dissipates at least 60 kilowatts that receives power from a power supply located on a ship through an umbilical surrounded by sea water that possesses at least two insulated electric wires, whereby the umbilical also possesses high speed data link for data communications, comprising the steps of:

(a) measuring the voltage input to the electric motor;

(b) sending information related to the measured voltage input through the high speed data link to a computer located on the ship; and (c) using the computer to adjust the voltage output of the power supply located on the ship that is used to control the voltage input to the electrical motor.

Accordingly, yet another preferred embodiment of the invention is the method of providing in excess of 60 kilowatts of electrical power to the electric motor of a remotely operated vehicle through an umbilical containing electrical conductors and at least one high speed data communications means.

Several of the above preferred embodiments describe the Subterranean Electric Drilling Machine™, or simply the Subterranean Drilling Machine™ (SDM™), that performs Subterranean Electric Drilling™ (SED™) that is used to construct a Subterranean Electric Drilled Monobore Well™ or an SED Monobore Well™. Several of the above preferred embodiments also describe the Subterranean Liner Expansion Tool™ (SLET™) otherwise called the Casing Expansion Tool™ (CET™).

While the above description contains many specificities, these should not be construed as limitations on the scope of the invention, but rather as exemplification of preferred embodiments thereto. As have been briefly described, there are many possible variations. Accordingly, the scope of the invention should be determined not only by the embodiments illustrated, but by the appended claims and their legal equivalents.

What is claimed is:

1. An apparatus to drill oil and gas wells comprising:

(a) a subterranean electric drilling machine disposed in a wellbore that possesses at least one electric motor that rotates a rotary drill bit at a selected RPM, whereby said electric motor possesses first electrical input, whereby said electric motor properly operates with a particular voltage level applied to first electrical input, and whereby said electric motor dissipates in excess of 60 kilowatts with said particular voltage level applied to said first electrical input;

(b) surface power supply means located on the surface of the earth providing first voltage output;

(c) umbilical means disposed in the wellbore surrounded by well fluids connecting said surface power supply means to said subterranean electric drilling machine that provides electrical power to said first electrical input of said electric motor, whereby said umbilical means possesses insulated electric wires, whereby said umbilical means possesses high speed data communications means, and whereby said umbilical possesses a fluid conduit for conveying drilling fluids through the interior of said umbilical means;

(d) means to measure first voltage applied to said first electrical input of said electrical motor;

(e) means to transmit information related to said measured first voltage through said high speed data communications means within said umbilical to a computer located on the surface of the earth (f) computer controlled means to adjust said first voltage output so as to maintain first voltage input at said particular voltage level to provide proper operation of said electric motor within said subterranean electric drilling machine.

2. The apparatus in claim 1 wherein said umbilical means is approximately neutrally buoyant within said well fluids to reduce the frictional drag on said neutrally buoyant umbilical.

3. The method of feed-back control of an electric motor having at least one voltage input located within a subterranean electric drilling machine located in a borehole that dissipates at least 60 kilowatts that receives power from a surface power supply through an umbilical surrounded by well fluids that possesses at least two insulated electric wires, whereby said umbilical also possesses high speed data link for data communications, comprising the steps of:

(a) measuring the voltage input to said electric motor;

(b) sending information related to said measured voltage input through said high speed data link to a computer located on the surface of the earth; and (c) using said computer to adjust the voltage output of said surface power supply that is used to control the voltage input to said electrical motor.

4. The method in claim 3 wherein said umbilical is approximately neutrally buoyant within said well fluids to reduce the frictional drag on said umbilical.

5. The method of feed-back control of an electric motor having at least one voltage input located within a remotely operated vehicle that dissipates at least 60 kilowatts that receives power from a power supply located on a ship through an umbilical surrounded by sea water that possesses at least two insulated electric wires, whereby said umbilical also possesses high speed data link for data communications, comprising the steps of:

(a) measuring the voltage input to said electric motor;

(b) sending information related to said measured voltage input through said high speed data link to a computer located on said ship; and (c) using said computer to adjust the voltage output of said power supply located on said ship that is used to control the voltage input to said electrical motor.

6. An apparatus to drill an extended reach oil and gas well to lateral radial distance of between 7 miles to 20 miles from the location of a surface drill site, comprising:

(a) a subterranean electric drilling machine disposed in a wellbore that possesses at least one electric motor that rotates a rotary drill bit at a selected RPM, whereby said electric motor possesses first electrical input, whereby said electric motor properly operates with a particular voltage level applied to first electrical input, and whereby said electric motor dissipates in excess of 60 kilowatts with said particular voltage level applied to said first electrical input;

(b) surface power supply means located on the surface of the earth providing first voltage output;

(c) umbilical means disposed in the wellbore surrounded by well fluids connecting said surface power supply means to said subterranean electric drilling machine that provides electrical power to said first electrical input of said electric motor, whereby said umbilical means possesses insulated electric wires, whereby said umbilical means possesses high speed data communications means, whereby said umbilical possesses a fluid conduit for conveying drilling fluids through the interior of said umbilical means and whereby said umbilical means is a approximately neutrally buoyant within said well fluids to reduce the frictional drag on said neutrally buoyant umbilibal;

(d) means to measure first voltage applied to said first electrical input of said electrical motor;

(e) means to transmit information related to said measured first voltage through said high speed data communications means within said umbilical to a computer located on the surface of the earth (f) computer controlled means to adjust said first voltage output so as to maintain first voltage input at said particular voltage level to provide proper operation of said electric motor within said subterranean electric drilling machine.

7. The method of feed-back control of an electric motor having at least one voltage input located within a subterranean electric drilling machine located in a borehole that dissipates at least 60 kilowatts that receives power from a surface power supply through an umbilical surrounded by well fluids that possesses at least two insulated electric wires, whereby said umbilical also possesses a high speed data link for data communications, whereby said umbilical is approximately neutrally buoyant within said well fluids to reduce the frictional drag on said umbilibal, comprising steps of:

(a) measuring the voltage input to said electric motor;

(b) sending information related to said measured voltage input through said high speed data link to a computer located on the surface of the earth;

(c) using said computer to adjust the voltage output of said surface power supply that is used to control the voltage input to said electrical motor; and (d) using said feed-back control of said electric motor of said subterranean electric drilling machine to drill an extended reach oil and gas well to lateral radial distances of between 7 miles to 20 miles from the location of the surface drill site.

* * * * *